US011338194B2

(12) United States Patent
Helgesen et al.

(10) Patent No.: US 11,338,194 B2
(45) Date of Patent: May 24, 2022

(54) AUTOMATIC CARD SHUFFLERS AND RELATED METHODS OF AUTOMATIC JAM RECOVERY

(71) Applicant: SG Gaming, Inc., Las Vegas, NV (US)

(72) Inventors: James Helgesen, Eden Prairie, MN (US); James Stasson, Chaska, MN (US)

(73) Assignee: SG Gaming, Inc., Las Vegas, NV (US)

( * ) Notice: Subject to any disclaimer, the term of this patent is extended or adjusted under 35 U.S.C. 154(b) by 592 days.

(21) Appl. No.: 16/147,039

(22) Filed: Sep. 28, 2018

(65) Prior Publication Data

US 2020/0101369 A1 Apr. 2, 2020

(51) Int. Cl.

| | |
|---|---|
| ***A63F 1/12*** | (2006.01) |
| ***A63F 1/06*** | (2006.01) |
| ***A63F 1/00*** | (2006.01) |

(52) U.S. Cl.

CPC ..... *A63F 1/12* (2013.01); *A63F 1/067* (2013.01); *A63F 2001/003* (2013.01); *A63F 2001/005* (2013.01)

(58) Field of Classification Search

CPC ..... A63F 1/12; A63F 1/14; A63F 1/067
USPC ..... 273/149 R, 149 P
See application file for complete search history.

(56) References Cited

U.S. PATENT DOCUMENTS

| | | | |
|---|---|---|---|
| 130,281 | A | 8/1872 | Coughlin |
| 205,030 | A | 6/1878 | Ash |
| 609,730 | A | 8/1898 | Booth |
| 673,154 | A | 4/1901 | Bellows |
| 793,489 | A | 6/1905 | Williams |
| 892,389 | A | 7/1908 | Bellows |
| 1,014,219 | A | 1/1912 | Hall |
| 1,043,109 | A | 11/1912 | Hurm |
| 1,157,898 | A | 10/1915 | Perret |
| 1,256,509 | A | 2/1918 | Belknap |
| 1,380,898 | A | 6/1921 | Hall |
| 1,556,856 | A | 10/1925 | Lipps |
| 1,757,553 | A | 5/1930 | Tauschek |
| 1,850,114 | A | 3/1932 | McCaddin |
| 1,885,276 | A | 11/1932 | McKay |

(Continued)

FOREIGN PATENT DOCUMENTS

| | | | |
|---|---|---|---|
| AU | 2383667 | A | 1/1969 |
| AU | 5025479 | A1 | 3/1980 |

(Continued)

OTHER PUBLICATIONS

Canadian Office Action for CA 2,580,309 dated Mar. 20, 2012 (6 pages).

(Continued)

*Primary Examiner* — Michael D Dennis
(74) *Attorney, Agent, or Firm* — TraskBritt

(57) ABSTRACT

Automatic card shufflers may include a card input mechanism for inputting cards into the card shuffler, a card storage device for receiving cards from the card input mechanism and temporarily storing cards within the card shuffler, and a card output mechanism for outputting cards from the card shuffler. The automatic card shufflers may randomly select an internal compartment to be an overflow compartment for inserting cards when a failure of insertion of a card to a selected primary card position occurs.

18 Claims, 22 Drawing Sheets

(56) References Cited

U.S. PATENT DOCUMENTS

| | | | |
|---|---|---|---|
| 1,889,729 | A | 11/1932 | Hammond |
| 1,955,926 | A | 4/1934 | Matthaey |
| 1,992,085 | A | 2/1935 | McKay |
| 1,998,690 | A | 4/1935 | Shepherd et al. |
| 2,001,220 | A | 5/1935 | Smith |
| 2,001,918 | A | 5/1935 | Nevius |
| 2,016,030 | A | 10/1935 | Woodruff et al. |
| 2,043,343 | A | 6/1936 | Warner |
| 2,060,096 | A | 11/1936 | McCoy |
| 2,065,824 | A | 12/1936 | Plass |
| 2,159,958 | A | 5/1939 | Sachs |
| 2,185,474 | A | 1/1940 | Nott |
| 2,254,484 | A | 9/1941 | Hutchins |
| D132,360 | S | 5/1942 | Gardner |
| 2,282,040 | A | 5/1942 | Doran |
| 2,328,153 | A | 8/1943 | Laing |
| 2,328,879 | A | 9/1943 | Isaacson |
| D139,530 | S | 11/1944 | Schindler |
| 2,364,413 | A | 12/1944 | Wittel |
| 2,525,305 | A | 10/1950 | Lombard |
| 2,543,522 | A | 2/1951 | Cohen |
| 2,588,582 | A | 3/1952 | Sivertson |
| 2,615,719 | A | 10/1952 | Fonken |
| 2,659,607 | A | 11/1953 | Skillman et al. |
| 2,661,215 | A | 12/1953 | Stevens |
| 2,676,020 | A | 4/1954 | Ogden |
| 2,692,777 | A | 10/1954 | Miller |
| 2,701,720 | A | 2/1955 | Ogden |
| 2,705,638 | A | 4/1955 | Newcomb |
| 2,711,319 | A | 6/1955 | Morgan et al. |
| 2,714,510 | A | 8/1955 | Oppenlander et al. |
| 2,717,782 | A | 9/1955 | Droll |
| 2,727,747 | A | 12/1955 | Semisch, Jr. |
| 2,731,271 | A | 1/1956 | Brown |
| 2,747,877 | A | 5/1956 | Howard |
| 2,755,090 | A | 7/1956 | Aldrich |
| 2,757,005 | A | 7/1956 | Nothaft |
| 2,760,779 | A | 8/1956 | Ogden et al. |
| 2,770,459 | A | 11/1956 | Wilson et al. |
| 2,778,643 | A | 1/1957 | Williams |
| 2,778,644 | A | 1/1957 | Stephenson |
| 2,782,040 | A | 2/1957 | Matter |
| 2,790,641 | A | 4/1957 | Adams |
| 2,793,863 | A | 5/1957 | Liebelt |
| 2,815,214 | A | 12/1957 | Hall |
| 2,821,399 | A | 1/1958 | Heinoo |
| 2,914,215 | A | 11/1959 | Neidig |
| 2,937,739 | A | 5/1960 | Levy |
| 2,950,005 | A | 8/1960 | MacDonald |
| RE24,986 | E | 5/1961 | Stephenson |
| 3,067,885 | A | 12/1962 | Kohler |
| 3,107,096 | A | 10/1963 | Osborn |
| 3,124,674 | A | 3/1964 | Edwards et al. |
| 3,131,935 | A | 5/1964 | Gronneberg |
| 3,147,978 | A | 9/1964 | Sjostrand |
| D200,652 | S | 3/1965 | Fisk |
| 3,185,482 | A | 5/1965 | Russell |
| 3,222,071 | A | 12/1965 | Lang |
| 3,235,741 | A | 2/1966 | Plaisance |
| 3,288,308 | A | 11/1966 | Gingher |
| 3,305,237 | A | 2/1967 | Granius |
| 3,312,473 | A | 4/1967 | Friedman et al. |
| 3,452,509 | A | 7/1969 | Hauer |
| 3,530,968 | A | 9/1970 | Palmer |
| 3,588,116 | A | 6/1971 | Miura |
| 3,589,730 | A | 6/1971 | Slay |
| 3,595,388 | A | 7/1971 | Castaldi |
| 3,597,076 | A | 8/1971 | Hubbard et al. |
| 3,598,396 | A | 8/1971 | Andrews et al. |
| 3,618,933 | A | 11/1971 | Roggenstein et al. |
| 3,627,331 | A | 12/1971 | Lyon, Jr. |
| 3,666,270 | A | 5/1972 | Mazur |
| 3,680,853 | A | 8/1972 | Houghton et al. |
| 3,690,670 | A | 9/1972 | Cassady et al. |
| 3,704,938 | A | 12/1972 | Fanselow |
| 3,716,238 | A | 2/1973 | Porter |
| 3,751,041 | A | 8/1973 | Seifert |
| 3,761,079 | A | 9/1973 | Azure, Jr. |
| 3,810,627 | A | 5/1974 | Levy |
| D232,953 | S | 9/1974 | Oguchi |
| 3,861,261 | A | 1/1975 | Maxey |
| 3,897,954 | A | 8/1975 | Erickson et al. |
| 3,899,178 | A | 8/1975 | Watanabe |
| 3,909,002 | A | 9/1975 | Levy |
| 3,929,339 | A | 12/1975 | Mattioli |
| 3,944,077 | A | 3/1976 | Green |
| 3,944,230 | A | 3/1976 | Fineman |
| 3,949,219 | A | 4/1976 | Crouse |
| 3,968,364 | A | 7/1976 | Miller |
| 3,981,163 | A | 9/1976 | Tillotson |
| 4,023,705 | A | 5/1977 | Reiner et al. |
| 4,033,590 | A | 7/1977 | Pic |
| 4,072,930 | A | 2/1978 | Lucero et al. |
| 4,088,265 | A | 5/1978 | Garczynski |
| 4,151,410 | A | 4/1979 | McMillan et al. |
| 4,159,581 | A | 7/1979 | Lichtenberg |
| 4,162,649 | A | 7/1979 | Thornton |
| 4,166,615 | A | 9/1979 | Noguchi et al. |
| 4,232,861 | A | 11/1980 | Maul |
| 4,280,690 | A | 7/1981 | Hill |
| 4,283,709 | A | 8/1981 | Lucero et al. |
| 4,310,160 | A | 1/1982 | Willette et al. |
| 4,339,134 | A | 7/1982 | Macheel |
| 4,339,798 | A | 7/1982 | Hedges et al. |
| 4,361,393 | A | 11/1982 | Noto |
| 4,368,972 | A | 1/1983 | Naramore |
| 4,369,972 | A | 1/1983 | Parker |
| 4,374,309 | A | 2/1983 | Walton |
| 4,377,285 | A | 3/1983 | Kadlic |
| 4,385,827 | A | 5/1983 | Naramore |
| 4,388,994 | A | 6/1983 | Suda et al. |
| 4,397,469 | A | 8/1983 | Carter, III |
| 4,421,312 | A | 12/1983 | Delgado et al. |
| 4,421,501 | A | 12/1983 | Scheffer |
| D273,962 | S | 5/1984 | Fromm |
| D274,069 | S | 5/1984 | Fromm |
| 4,457,512 | A | 7/1984 | Stevenson |
| 4,467,424 | A | 8/1984 | Hedges et al. |
| 4,494,197 | A | 1/1985 | Troy et al. |
| 4,497,488 | A | 2/1985 | Plevyak et al. |
| 4,512,580 | A | 4/1985 | Matviak |
| 4,513,969 | A | 4/1985 | Samsel, Jr. |
| 4,515,367 | A | 5/1985 | Howard |
| 4,531,187 | A | 7/1985 | Uhland |
| 4,534,562 | A | 8/1985 | Cuff et al. |
| 4,549,738 | A | 10/1985 | Greitzer |
| 4,566,782 | A | 1/1986 | Britt et al. |
| 4,575,367 | A | 3/1986 | Karmel |
| 4,586,712 | A | 5/1986 | Lorber et al. |
| 4,659,082 | A | 4/1987 | Greenberg |
| 4,662,637 | A | 5/1987 | Pfeiffer |
| 4,662,816 | A | 5/1987 | Fabrig |
| 4,667,959 | A | 5/1987 | Pfeiffer et al. |
| 4,741,524 | A | 5/1988 | Bromage |
| 4,750,743 | A | 6/1988 | Nicoletti |
| 4,755,941 | A | 7/1988 | Bacchi |
| 4,759,448 | A | 7/1988 | Kawabata |
| 4,770,412 | A | 9/1988 | Wolfe |
| 4,770,421 | A | 9/1988 | Hoffman |
| 4,807,884 | A | 2/1989 | Breeding |
| 4,822,050 | A | 4/1989 | Normand et al. |
| 4,832,342 | A | 5/1989 | Plevyak et al. |
| 4,858,000 | A | 8/1989 | Lu |
| 4,861,041 | A | 8/1989 | Jones et al. |
| 4,876,000 | A | 10/1989 | Mikhail |
| 4,900,009 | A | 2/1990 | Kitahara et al. |
| 4,904,830 | A | 2/1990 | Rizzuto |
| 4,921,109 | A | 5/1990 | Hasuo et al. |
| 4,926,327 | A | 5/1990 | Sidley |
| 4,948,134 | A | 8/1990 | Suttle et al. |
| 4,951,950 | A | 8/1990 | Normand et al. |
| 4,969,648 | A | 11/1990 | Hollinger et al. |
| 4,993,587 | A | 2/1991 | Abe |
| 4,995,615 | A | 2/1991 | Cheng |

(56) References Cited

U.S. PATENT DOCUMENTS 5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Gamer
5,690,324 A 11/1997 Otomo et al.
5,692,748 A 12/1997 Frisco et al.
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky
5,941,769 A 8/1999 Order
5,944,310 A 8/1999 Johnson et al.
D414,527 S 9/1999 Fedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.
6,113,101 A 9/2000 Wirth
6,117,012 A 9/2000 McCrea, Jr.
D432,588 S 10/2000 Fedham
6,126,166 A 10/2000 Lorson et al.
6,131,817 A 10/2000 Miller
6,139,014 A 10/2000 Breeding et al.
6,149,154 A * 11/2000 Grauzer ..... A63F 1/12
273/149 R
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.

(56) References Cited

U.S. PATENT DOCUMENTS 6,254,484 B1 7/2001 McCrea, Jr.
6,257,981 B1 7/2001 Acres et al.
6,267,248 B1 * 7/2001 Johnson ..... A63F 1/12 209/547
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Messing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,543,770 B1 4/2003 Kaji et al.
6,561,897 B1 5/2003 Bourbour et al.
6,568,678 B2 5/2003 Breeding et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hard
6,585,856 B2 7/2003 Zwick et al.
6,588,750 B1 * 7/2003 Grauzer ..... A63F 1/12 273/149 R
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,638,161 B2 10/2003 Soltys et al.
6,645,068 B1 11/2003 Kelly et al.
6,645,077 B2 11/2003 Rowe
6,651,981 B2 * 11/2003 Grauzer ..... A63F 1/12 273/149 P
6,651,982 B2 11/2003 Grauzer et al.
6,651,985 B2 11/2003 Sines et al.
6,652,379 B2 11/2003 Soltys et al.
6,655,684 B2 12/2003 Grauzer et al.
6,655,690 B1 12/2003 Oskwarek
6,658,135 B1 12/2003 Morito et al.
6,659,460 B2 12/2003 Blaha et al.
6,659,461 B2 12/2003 Yoseloff
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 1/2004 Johnson et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Messing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico et al.
6,874,786 B2 4/2005 Bruno
6,877,657 B2 4/2005 Ranard et al.
6,877,748 B1 4/2005 Patroni et al.
6,886,829 B2 5/2005 Messing et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fisher et al.
6,950,948 B2 9/2005 Neff
6,955,599 B2 10/2005 Bourbour et al.
6,957,746 B2 10/2005 Martin et al.
6,959,925 B1 11/2005 Baker et al.
6,960,134 B2 11/2005 Martl et al.
6,964,612 B2 11/2005 Soltys et al.
6,986,514 B2 1/2006 Snow
6,988,516 B2 1/2006 Debaes
7,011,309 B2 3/2006 Soltys et al.
7,020,307 B2 3/2006 Hinton et al.
7,028,598 B2 4/2006 Teshima
7,029,009 B2 4/2006 Grauzer et al.
7,036,818 B2 5/2006 Grauzer et al.
7,046,458 B2 5/2006 Nakayama
7,046,764 B1 5/2006 Kump

(56) References Cited

U.S. PATENT DOCUMENTS 7,048,629 B2 5/2006 Sines et al.
7,059,602 B2 6/2006 Grauzer et al.
7,066,464 B2 6/2006 Blad et al.
7,068,822 B2 6/2006 Scott
7,073,791 B2 7/2006 Grauzer et al.
7,079,010 B2 7/2006 Champlin
7,084,769 B2 8/2006 Bauer et al.
7,089,420 B1 8/2006 Durst et al.
D527,900 S 9/2006 Dewa
7,106,201 B2 9/2006 Tuttle
7,113,094 B2 9/2006 Garber et al.
7,114,718 B2 10/2006 Grauzer et al.
7,124,947 B2 10/2006 Storch
7,128,652 B1 10/2006 Lavoie et al.
7,137,627 B2 11/2006 Grauzer et al.
7,139,108 B2 11/2006 Andersen et al.
7,140,614 B2 11/2006 Snow
7,162,035 B1 1/2007 Durst et al.
7,165,769 B2 1/2007 Crenshaw et al.
7,165,770 B2 1/2007 Snow
7,175,522 B2 2/2007 Hartl
7,186,181 B2 3/2007 Rowe
7,201,656 B2 4/2007 Darder
7,202,888 B2 4/2007 Tecu et al.
7,203,841 B2 4/2007 Jackson et al.
7,213,812 B2 5/2007 Schubert
7,222,852 B2 5/2007 Soltys
7,222,855 B2 5/2007 Sorge
7,231,812 B1 6/2007 Lagare
7,234,698 B2 6/2007 Grauzer et al.
7,237,969 B2 7/2007 Bartman
7,243,148 B2 7/2007 Keir et al.
7,243,698 B2 7/2007 Siegel
7,246,799 B2 7/2007 Snow
7,255,344 B2 8/2007 Grauzer et al.
7,255,351 B2 8/2007 Yoseloff et al.
7,255,642 B2 8/2007 Sines et al.
7,257,630 B2 8/2007 Cole et al.
7,261,294 B2 8/2007 Grauzer et al.
7,264,241 B2 9/2007 Schubert et al.
7,264,243 B2 9/2007 Yoseloff et al.
7,277,570 B2 10/2007 Armstrong
7,278,923 B2 10/2007 Grauzer et al.
7,294,056 B2 11/2007 Lowell et al.
7,297,062 B2 11/2007 Gatto et al.
7,300,056 B2 11/2007 Gioia et al.
7,303,473 B2 12/2007 Rowe
7,303,475 B2 12/2007 Britt et al.
7,309,065 B2 12/2007 Yoseloff et al.
7,316,609 B2 1/2008 Dunn et al.
7,316,615 B2 1/2008 Soltys et al.
7,322,576 B2 1/2008 Grauzer et al.
7,331,579 B2 2/2008 Snow
7,334,794 B2 2/2008 Snow
7,338,044 B2 3/2008 Grauzer et al.
7,338,362 B1 3/2008 Gallagher
7,341,510 B2 3/2008 Bourbour et al.
D566,784 S 4/2008 Palmer
7,357,321 B2 4/2008 Yoshida
7,360,094 B2 4/2008 Neff
7,367,561 B2 5/2008 Blaha et al.
7,367,563 B2 5/2008 Yoseloff et al.
7,367,565 B2 5/2008 Chiu
7,367,884 B2 5/2008 Breeding et al.
7,374,170 B2 5/2008 Grauzer et al.
7,384,044 B2 6/2008 Grauzer et al.
7,387,300 B2 6/2008 Snow
7,389,990 B2 6/2008 Mourad
7,390,256 B2 6/2008 Soltys et al.
7,399,226 B2 7/2008 Mishra
7,407,438 B2 8/2008 Schubert et al.
7,413,191 B2 8/2008 Grauzer et al.
7,434,805 B2 10/2008 Grauzer et al.
7,436,957 B1 10/2008 Fisher et al.
7,448,626 B2 11/2008 Fleckenstein
7,458,582 B2 12/2008 Snow et al.
7,461,843 B1 12/2008 Baker et al.
7,464,932 B2 12/2008 Darling
7,464,934 B2 12/2008 Schwartz
7,472,906 B2 1/2009 Shai
7,478,813 B1 1/2009 Hofferber et al.
7,500,672 B2 3/2009 Ho
7,506,874 B2 3/2009 Hall
7,510,186 B2 3/2009 Fleckenstein
7,510,190 B2 3/2009 Snow et al.
7,510,194 B2 3/2009 Soltys et al.
7,510,478 B2 3/2009 Benbrahim et al.
7,513,437 B2 4/2009 Douglas
7,515,718 B2 4/2009 Nguyen et al.
7,523,935 B2 4/2009 Grauzer et al.
7,523,936 B2 4/2009 Grauzer et al.
7,523,937 B2 4/2009 Fleckenstein
7,525,510 B2 4/2009 Beland et al.
7,537,216 B2 5/2009 Soltys et al.
7,540,497 B2 6/2009 Tseng
7,540,498 B2 6/2009 Crenshaw et al.
7,549,643 B2 6/2009 Quach
7,554,753 B2 6/2009 Wakamiya
7,556,197 B2 7/2009 Yoshida
7,556,266 B2 7/2009 Blaha et al.
7,575,237 B2 8/2009 Snow
7,578,506 B2 8/2009 Lambert
7,584,962 B2 9/2009 Breeding et al.
7,584,963 B2 9/2009 Krenn et al.
7,584,966 B2 9/2009 Snow
7,591,728 B2 9/2009 Gioia et al.
7,593,544 B2 9/2009 Downs
7,594,660 B2 9/2009 Baker et al.
7,597,623 B2 10/2009 Grauzer et al.
7,644,923 B1 1/2010 Dickinson et al.
7,661,676 B2 2/2010 Smith et al.
7,666,090 B2 2/2010 Hettinger
7,669,852 B2 3/2010 Baker et al.
7,669,853 B2 3/2010 Jones
7,677,565 B2 * 3/2010 Grauzer ..... A63F 1/12
273/149 R
7,677,566 B2 3/2010 Krenn et al.
7,686,681 B2 3/2010 Soltys et al.
7,699,694 B2 4/2010 Hill
7,735,657 B2 6/2010 Johnson
7,740,244 B2 6/2010 Ho
7,744,452 B2 6/2010 Cimring et al.
7,753,373 B2 7/2010 Grauzer et al.
7,753,374 B2 7/2010 Ho
7,753,798 B2 7/2010 Soltys
7,758,425 B2 7/2010 Poh et al.
7,762,554 B2 7/2010 Ho
7,764,836 B2 7/2010 Downs et al.
7,766,332 B2 * 8/2010 Grauzer ..... A63F 1/14
273/149 R
7,766,333 B1 8/2010 Stardust
7,769,232 B2 8/2010 Downs, III
7,769,853 B2 8/2010 Nezamzadeh
7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick
7,846,020 B2 12/2010 Walker et al.
7,854,430 B2 12/2010 Toyama
7,867,080 B2 1/2011 Nicely et al.
7,874,559 B1 1/2011 Tseng
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,933,448 B2 4/2011 Downs, III
7,946,586 B2 5/2011 Krenn et al.
7,967,294 B2 6/2011 Blaha et al.
7,976,023 B1 7/2011 Hessing et al.
7,931,533 B2 8/2011 LeMay et al.
7,988,152 B2 8/2011 Sines et al.
7,988,554 B2 8/2011 LeMay et al.

(56) References Cited

U.S. PATENT DOCUMENTS 7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 1/2013 Scheper et al.
8,342,526 B1 1/2013 Sampson
8,342,529 B2 1/2013 Snow
8,353,513 B2 1/2013 Swanson
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,548,327 B2 10/2013 Hirth et al.
8,550,464 B2 10/2013 Soltys et al.
8,556,263 B2 10/2013 Grauzer et al.
8,579,289 B2 11/2013 Rynda et al.
8,590,895 B2 11/2013 Kwon
RE44,616 E 12/2013 Blaha et al.
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,777,727 B2 7/2014 Jones
8,820,745 B2 9/2014 Grauzer et al.
8,844,930 B2 9/2014 Sampson
8,899,587 B2 12/2014 Grauzer et al.
8,919,775 B2 12/2014 Wadds et al.
8,960,674 B2 * 2/2015 Stasson ..... A63F 1/12 273/149 R
8,998,211 B2 * 4/2015 Grauzer ..... A63F 1/14 273/149 R
9,101,821 B2 8/2015 Snow
9,251,661 B2 2/2016 Tammesoo
9,254,435 B2 2/2016 Miller et al.
9,266,012 B2 2/2016 Grauzer
9,280,866 B2 3/2016 Nayak et al.
9,316,597 B2 4/2016 Blazevic
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,573,047 B1 2/2017 Riordan et al.
9,679,603 B2 6/2017 Kelly et al.
9,731,190 B2 8/2017 Sampson et al.
9,849,368 B2 * 12/2017 Stasson ..... H05K 999/99
10,092,820 B2 10/2018 Riordan et al.
10,124,241 B2 * 11/2018 Stasson ..... H05K 999/99
10,668,361 B2 6/2020 Stasson et al.
10,857,448 B2 12/2020 Kelly et al.
2001/0035604 A1 11/2001 Jones
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Messing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Messing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108255 A1 6/2004 Johnson
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062227 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.

(56) References Cited

U.S. PATENT DOCUMENTS

2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys
2005/0121852 A1 6/2005 Soltys et al.
2005/0137005 A1 6/2005 Soltys et al.
2005/0140090 A1 6/2005 Breeding et al.
2005/0146093 A1 7/2005 Grauzer et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs
2005/0272501 A1 12/2005 Tran et al.
2005/0277463 A1 12/2005 Knust
2005/0288083 A1 12/2005 Downs
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0055114 A1 3/2006 White et al.
2006/0063577 A1 3/2006 Downs, III et al.
2006/0066048 A1 3/2006 Krenn et al.
2006/0084502 A1 4/2006 Downs et al.
2006/0151946 A1 7/2006 Ngai
2006/0181022 A1 8/2006 Grauzer et al.
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2006/0281534 A1 12/2006 Grauzer et al.
2007/0001395 A1 1/2007 Gioia et al.
2007/0006708 A1 1/2007 Laakso
2007/0015583 A1 1/2007 Tran
2007/0018389 A1 1/2007 Downs, III
2007/0045959 A1 3/2007 Soltys
2007/0049368 A1 3/2007 Kuhn et al.
2007/0057454 A1 3/2007 Fleckenstein
2007/0057469 A1 3/2007 Grauzer et al.
2007/0066387 A1 3/2007 Matsuno et al.
2007/0069462 A1 3/2007 Downs, III et al.
2007/0072677 A1 3/2007 Lavoie et al.
2007/0102879 A1 5/2007 Stasson
2007/0111773 A1 5/2007 Gururajan et al.
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0222147 A1 9/2007 Blaha et al.
2007/0225055 A1 9/2007 Weisman
2007/0233567 A1 10/2007 Daly
2007/0238506 A1 10/2007 Ruckle
2007/0241498 A1 10/2007 Soltys
2007/0259709 A1 11/2007 Kelly et al.
2007/0267812 A1 11/2007 Grauzer et al.
2007/0272600 A1 11/2007 Johnson
2007/0278739 A1 12/2007 Swanson
2007/0287534 A1 12/2007 Fleckenstein
2007/0290438 A1 12/2007 Grauzer et al.
2007/0298865 A1 12/2007 Soltys
2008/0004107 A1 1/2008 Nguyen et al.
2008/0006997 A1 1/2008 Scheper et al.
2008/0006998 A1 1/2008 Grauzer et al.
2008/0022415 A1 1/2008 Kuo et al.
2008/0032763 A1 2/2008 Giobbi
2008/0039192 A1 2/2008 Laut
2008/0039208 A1 2/2008 Abrink et al.
2008/0096656 A1 4/2008 LeMay et al.
2008/0111300 A1 5/2008 Czyzewski et al.
2008/0113700 A1 5/2008 Czyzewski et al.
2008/0113783 A1 5/2008 Czyzewski et al.
2008/0136108 A1 6/2008 Polay
2008/0143048 A1 6/2008 Shigeta
2008/0176627 A1 7/2008 Lardie
2008/0217218 A1 9/2008 Johnson
2008/0234046 A1 9/2008 Kinsley
2008/0234047 A1 9/2008 Nguyen
2008/0248875 A1 10/2008 Beally
2008/0284096 A1 11/2008 Toyama et al.
2008/0303210 A1 12/2008 Grauzer et al.
2008/0315517 A1 12/2008 Toyama et al.
2009/0026700 A2 1/2009 Shigeta
2009/0048026 A1 2/2009 French
2009/0054161 A1 2/2009 Schuber et al.
2009/0072477 A1 3/2009 Tseng et al.
2009/0121429 A1 3/2009 Walsh et al.
2009/0091078 A1 4/2009 Grauzer et al.
2009/0100409 A1 4/2009 Toneguzzo
2009/0104963 A1 4/2009 Burman
2009/0134575 A1 5/2009 Dickinson et al.
2009/0140492 A1 6/2009 Yoseloff et al.
2009/0166970 A1 7/2009 Rosh et al.
2009/0176547 A1 7/2009 Katz
2009/0179378 A1 7/2009 Amaitis et al.
2009/0186676 A1 7/2009 Amaitis et al.
2009/0189346 A1 7/2009 Krenn et al.
2009/0191933 A1 7/2009 French
2009/0194988 A1 8/2009 Wright et al.
2009/0197662 A1 8/2009 Wright et al.
2009/0224476 A1 9/2009 Grauzer et al.
2009/0227318 A1 9/2009 Wright et al.
2009/0227360 A1 9/2009 Gioia et al.
2009/0250873 A1 10/2009 Jones
2009/0253478 A1 10/2009 Walker et al.
2009/0253503 A1 10/2009 Krise et al.
2009/0267296 A1 10/2009 Ho et al.
2009/0267297 A1 10/2009 Blaha et al.
2009/0283969 A1 11/2009 Tseng et al.
2009/0298577 A1 12/2009 Gagner et al.
2009/0302535 A1 12/2009 Ho et al.
2009/0302537 A1 12/2009 Ho et al.
2009/0312093 A1 12/2009 Walker et al.
2009/0314188 A1 12/2009 Toyama et al.
2010/0013152 A1 1/2010 Grauzer
2010/0038849 A1 2/2010 Scheper et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0244376 A1 9/2010 Johnson
2010/0244382 A1 9/2010 Snow
2010/0252992 A1 10/2010 Sines
2010/0255899 A1 10/2010 Paulsen
2010/0276880 A1 11/2010 Grauzer et al.
2010/0311493 A1 12/2010 Miller et al.
2010/0311494 A1 12/2010 Miller et al.
2010/0314830 A1 12/2010 Grauzer et al.
2010/0320685 A1 12/2010 Grauzer
2011/0006480 A1 1/2011 Grauzer
2011/0012303 A1 1/2011 Kourgiantakis et al.
2011/0024981 A1 2/2011 Tseng
2011/0052049 A1 3/2011 Rajaraman et al.
2011/0062662 A1 3/2011 Ohta
2011/0078096 A1 3/2011 Bounds
2011/0079959 A1 4/2011 Hartley
2011/0105208 A1 5/2011 Bickley
2011/0109042 A1 5/2011 Rynda
2011/0130185 A1 6/2011 Walker
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci

(56) References Cited

U.S. PATENT DOCUMENTS

| | | | | |
|---|---|---|---|---|
| 2011/0183748 | A1 | 7/2011 | Wilson et al. | |
| 2011/0230148 | A1 | 9/2011 | Demuynck et al. | |
| 2011/0230268 | A1 | 9/2011 | Williams | |
| 2011/0233863 | A1 | 9/2011 | Toyama | |
| 2011/0269529 | A1 | 11/2011 | Baerlocher | |
| 2011/0272881 | A1 | 11/2011 | Sines | |
| 2011/0285081 | A1 | 11/2011 | Stasson | |
| 2011/0287829 | A1 | 11/2011 | Clarkson et al. | |
| 2012/0015724 | A1 | 1/2012 | Ocko et al. | |
| 2012/0015725 | A1 | 1/2012 | Ocko et al. | |
| 2012/0015743 | A1 | 1/2012 | Lam et al. | |
| 2012/0015747 | A1 | 1/2012 | Ocko et al. | |
| 2012/0021835 | A1 | 1/2012 | Keller et al. | |
| 2012/0034977 | A1 | 2/2012 | Kammler | |
| 2012/0062745 | A1 | 3/2012 | Han et al. | |
| 2012/0074646 | A1 | 3/2012 | Grauzer et al. | |
| 2012/0091656 | A1 | 4/2012 | Blaha et al. | |
| 2012/0095982 | A1 | 4/2012 | Lennington et al. | |
| 2012/0161393 | A1 | 6/2012 | Krenn et al. | |
| 2012/0175841 | A1 | 7/2012 | Grauzer | |
| 2012/0181747 | A1 | 7/2012 | Grauzer et al. | |
| 2012/0187625 | A1 | 7/2012 | Downs, III et al. | |
| 2012/0242782 | A1 | 9/2012 | Huang | |
| 2012/0286471 | A1 | 11/2012 | Grauzer et al. | |
| 2012/0306152 | A1 | 12/2012 | Krishnamurty et al. | |
| 2013/0020761 | A1 | 1/2013 | Sines et al. | |
| 2013/0023318 | A1 | 1/2013 | Abrahamson | |
| 2013/0026709 | A1 | 1/2013 | Sampson et al. | |
| 2013/0085638 | A1 | 4/2013 | Weinmann et al. | |
| 2013/0099448 | A1 | 4/2013 | Scheper et al. | |
| 2013/0109455 | A1 | 5/2013 | Grauzer et al. | |
| 2013/0132306 | A1 | 5/2013 | Kami et al. | |
| 2013/0147116 | A1 | 6/2013 | Stasson | |
| 2013/0161905 | A1 | 6/2013 | Grauzer et al. | |
| 2013/0228972 | A1 | 9/2013 | Grauzer et al. | |
| 2013/0241147 | A1 | 9/2013 | McGrath | |
| 2013/0300059 | A1 | 11/2013 | Sampson et al. | |
| 2013/0337922 | A1 | 12/2013 | Kuhn | |
| 2014/0027979 | A1* | 1/2014 | Stasson ..... | H05K 999/00 273/149 R |
| 2014/0094239 | A1 | 4/2014 | Grauzer et al. | |
| 2014/0103606 | A1 | 4/2014 | Grauzer et al. | |
| 2014/0138907 | A1 | 5/2014 | Rynda et al. | |
| 2014/0145399 | A1 | 5/2014 | Krenn et al. | |
| 2014/0171170 | A1 | 6/2014 | Krishnamurty et al. | |
| 2014/0175724 | A1 | 6/2014 | Huhtala et al. | |
| 2014/0183818 | A1 | 7/2014 | Czyzewski et al. | |
| 2014/0309006 | A1 | 10/2014 | Shigeta | |
| 2014/0346732 | A1 | 11/2014 | Blaha et al. | |
| 2015/0021242 | A1 | 1/2015 | Johnson | |
| 2015/0069699 | A1 | 3/2015 | Blazevic | |
| 2015/0196834 | A1 | 7/2015 | Snow | |
| 2015/0238848 | A1 | 8/2015 | Kuhn et al. | |
| 2015/0251079 | A1 | 9/2015 | Wright | |
| 2015/0290528 | A1 | 10/2015 | Sampson et al. | |
| 2015/0290529 | A1 | 10/2015 | Bourbour et al. | |
| 2017/0157499 | A1 | 6/2017 | Krenn et al. | |
| 2018/0085658 | A1 | 3/2018 | Uelsen et al. | |
| 2018/0089956 | A1 | 3/2018 | Nagaragatta et al. | |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 101044520 | A | 9/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 201832397 | U | 5/2011 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CN | 103025393 | B | 5/2015 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | A | 7/1934 |
| GB | 672616 | A | 5/1952 |
| GB | 2382567 | A | 6/2003 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003-154320 | A | 5/2003 |
| JP | 2003250950 | A | 9/2003 |
| JP | 2005198668 | A | 7/2005 |
| JP | 2006-092140 | A | 4/2006 |
| JP | 2008246061 | A | 10/2008 |
| JP | 4586474 | B2 | 11/2010 |
| KR | 2018-0090299 | A | 8/2018 |
| TW | M335308 | U | 7/2008 |
| TW | M357307 | U | 5/2009 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 0156670 | A1 | 8/2001 |
| WO | 0178854 | A3 | 10/2001 |
| WO | 0205914 | A1 | 1/2002 |
| WO | 03004116 | A1 | 1/2003 |
| WO | 03026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 2008005285 | A2 | 1/2008 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |

(56) References Cited

FOREIGN PATENT DOCUMENTS

| | | | |
|---|---|---|---|
| WO | 2009137541 | A2 | 11/2009 |
| WO | 2010052573 | A2 | 5/2010 |
| WO | 2010055328 | A2 | 5/2010 |
| WO | 2010117446 | A2 | 10/2010 |
| WO | 2012/053074 | A1 | 4/2012 |
| WO | 2013019677 | A2 | 2/2013 |
| WO | 2016058085 | A9 | 4/2016 |

OTHER PUBLICATIONS

Canadian Office Action for Canadian Application No. 2,461,726, dated Jul. 19, 2010, 3 pages.
Canadian Office Action for Canadian Application No. 2,461,726, dated Dec. 11, 2013, 3 pages.
CasinoTrac TableTrac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Quick Installation Guide, Feb. 20, 2013 (36 pages).
CONNECT2TABLE Connect2Table System Summary, generated Oct. 21, 2016 (2 pages).
CONNECT2TABLE User Manual, Feb. 7, 2013 (35 pages).
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N.D. III.); Oct. 13, 2016; pp. 1, 9-21, 30-69, 150-167, 186-188, 228-231, 290-315,411; Henderson Legal Services, Inc.; Washington, DC.
Gros, Roger; New Card Management System To Be Tested At Bally's Park Place; Casino Journal; Apr. 1989; 5 pages.
http://www.google.com/search?tbm=pts&q=Card+handling+devicve+with+input+and+outpu . . . Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuffling+zone+onOopposite+site+of+input+. . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI 20062710, May 9, 2009, 4 pages.
NEON Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
Olsen, Eddie; Automatic Shuffler ready' for Atlantic City experiment; Blackjack Confidential; Jul./Aug. 1989; pp. 6-7.
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page (WO06/039308).
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
International Invitation to Pay Additional Fees and Partial Search Report for International Application PCT/US2019/048442, dated Dec. 6, 2019, 10 pages.
International Search Report from International Application No. PCT/US2019/048442, dated Jan. 28, 2020, 6 pages.
International Written Opinion from International Application No. PCT/US2019/048442, dated Jan. 28, 2020, 9 pages.
Shuffle Master, Inc. (1996). Let It Ride, The Tournament, User Guide, 72 pages.
Philippines Patent Application Formality Examination Report—Philippines Patent Application No. 1-2006-000302, Jun. 13, 2006.
"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of_neon_across_grosvenor_s_55_uk_casinos> (1 page).

(56) References Cited

OTHER PUBLICATIONS

Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp., et al.* 1:15-cv-3702 (N.D. III.) undated; pp. 1-4.
Scarne's Encyclopedia of Games by John Scame, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Waster, Inc.
Service Manual/User Manual for Single Deck Shufflers: BG1, BG2 and BG3 by Shuffle Master © 1997, 151 page.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Waster, Inc.* vs. *VendingData Corporation*, In the U.S. District Court, District of Nevada, No. CV-S-04-1373-JCM-LRL, Nov. 29, 2004.
Solberg, Halvard; Deposition; *Shuffle Tech International* v. *Scientific Games Corp., et al.* 1:15-cv-3702 (N D. III.) Oct. 18, 2016; pp. 187, 224-246, 326-330, 338-339, 396; Baytowne Reporting; Panama City, FL.
Statement of Relevance of Cited References, Submitted as Part of a Third-Party Submission Under 37 CFR 1.290 on Dec. 7, 2012 (12 pages).
"TableScanner (TM) from ADVANSYS", Casino Inside Magazine, No. 30, pp. 34-36 (Dec. 2012) (4 pages).
TableScanner "Accounting & Cage". Product Information Datasheets [online], Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online], Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
tbm=pts&hl=en Google Search for card handling device with storage area, card removing system pivoting arm and processor http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
"TYM @ A Glance—Table Games Yield Management", TYM Live Product Information Datasheets [online]. TANGAM Systems, 2016. Retrieved on Oct. 3, 2016 from the Internet: <URL: http://tangamgaming.com/wp-content/uploads/2016/12/TG_TYMGIance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.
1/3" B/W CCD Camera Module EB100 by EverFocus Electronics Corp., Jul. 31, 2001, 3 pgs.
"ACE, Single Deck Shuffler," Shuffle Master, Inc., (2005), 2 pages.
Advansys, "Player Tracking" http://advansys.si/products/tablescanner/player-tracking/[Sep. 23, 2016 1:41:34 PM], 4 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
"Error Back propagation," http://willamette.edu~gorr/classes/cs449/backprop.html (4 pages), Nov. 13, 2008.
"i-Deal," Bally Technologies, Inc., (2014), 2 pages.
"shufflers—SHFL entertainment," Gaming Concepts Group, (2012), 6 pages.
"TAG Archives: Shuffle Machine," Gee Wiz Online, (Mar. 25, 2013), 4 pages.
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).

(56) References Cited

OTHER PUBLICATIONS

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents Binder 6,1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One2Si| Shuffler (Oct. 7, 2003).
DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler.
DVD labeled Solberg Decl.Ex.C, which is not a video at all, is (see Binder 4-1, p. 34/206, Solberg Decl., para.8) Computer source code for operating a computer-controlled card shuffler (an early Roblejo prototype card shuffler) and descriptive comments of how the code works.
DVD labeled Luciano Decl. Ex. K is (see Binder 2-1, p. 215/237, Luciano Decl., para.14): A video demonstration (11minutes) of a Luciano Packaging prototype shuffler.
*Shuffle Tech International LLC et al.* vs. *Scientific Games Corporation et al.*, Order Denying Motion for Summary Judgement: Memorandum Opinion and Order, In the U.S. District Court, For The Northern District of Illinois Eastern Division, No. 15 C 3702, Sep. 1, 2017, 35 pages.
Australian Examination Report, for Australian Application No. 2016363815, dated Feb. 3, 2021, 4 pages, with English Translation.
International Preliminary Reporton Patentability Chapter 1 for PCT/US19/50436, dated Mar. 16, 2021, 8 pages.
International Preliminary Report on Patentability, for International Application No. PCT/US2019/027460, dated, Mar. 9, 2021, 10 pages.
Philippines Office Action, for Philippines Application No. 1/2018/501139, dated Apr. 8, 2021, 3 pages.
Singapore Patent Application Examination Report—Singapore Patent Application No. SE 2008 01914 A, Jun. 18, 2008, 9 pages.
Canadian Office Action for Canadian Application No. 3,033,280, dated Apr. 14, 2021, 4 pages.
Taiwan Examination Report, for Taiwan Application No. 106131789, dated Mar. 31, 2021, 19 pages with English Translation.

* cited by examiner

AUTOMATIC CARD SHUFFLERS AND RELATED METHODS OF AUTOMATIC JAM RECOVERY

CROSS-REFERENCE TO RELATED APPLICATIONS

This application related to U.S. patent application Ser. No. 15/363,374, filed Nov. 29, 2016, now U.S. Pat. No. 10,124,241, issued Nov. 13, 2018, which is a continuation of U.S. patent application Ser. No. 14/575,689, filed Dec. 18, 2014, now U.S. Pat. No. 9,849,368, issued Dec. 26, 2017, which is a continuation application of U.S. patent application Ser. No. 13/560,792, filed Jul. 27, 2012, now U.S. Pat. No. 8,960,674, issued Feb. 24, 2015, the disclosure of each of which is hereby incorporated herein in its entirety by this reference.

TECHNICAL FIELD

The present disclosure relates to automatic card shufflers for use in randomizing an order of a group of cards, such as standard playing cards, to methods of manufacturing such automatic card shufflers, and to methods of randomizing an order of a group of cards using such automatic card shufflers.

BACKGROUND

Card shufflers are used to randomize an order of cards in a stack of cards, and are frequently used in the gaming industry for use with playing cards, such as decks of standard playing cards which include four suits (i.e., clubs, diamond, hearts, and spades) of cards, wherein each suit includes a group of thirteen (13) differently ranked cards sequentially numbered from two (2) through ten (10), as well as a Jack, a Queen, a King, and an Ace. Such a standard deck of playing cards may also include one or more additional cards, such as one or two additional Jokers. Thus, a complete deck may comprise, for example, fifty-two (52), fifty-three (53) or fifty-four (54) playing cards.

Card shufflers are known in the art that, in addition to shuffling cards, may be used to sort cards into a predetermined order, such as what is referred to in the art as "new deck" order. To accomplish such a sorting operation, a card shuffler must be capable of accurately identifying indicia on each card, such as the rank and suit of standard playing cards. Card shufflers capable of sorting cards often include a card imaging system, which may include a camera that acquires an image of at least a portion of each card. An algorithm may be used to analyze the image and compare the image to images of cards of known identity. By determining to which known image the acquired image most closely corresponds, the identity of each card may be determined and used by the card shuffler to sort cards into a predetermined order.

Many previously known card shufflers are not capable of truly randomizing an order of the cards in any given set of cards due to limitations in the physical mechanism or system used to shuffle the cards. Thus, there remains a need in the art for card shufflers that are capable of truly randomizing an order of cards in a set of cards to a sufficient degree to be considered random in the shuffler arts. Additionally, it may be desirable to shuffle and/or sort cards using a card shuffler quickly so as to increase the amount of shuffling and/or sorting operations that may be performed by a card shuffler in any given amount of time.

The ACE® card shuffler, previously offered by Shuffle Master, Inc. of Las Vegas, Nev. in the past, and as described in U.S. Pat. No. 6,149,154, is a batch-type card shuffler with a vertically moving rack comprising multiple compartments fixed relative to an adjacent compartment. This structure lacks card recognition. Shuffling is accomplished through random loading of the racks, and random unloading of formed packs. Packs of cards are formed in compartments. The order in which the cards are delivered to hand-forming compartments is substantially random. The composition of the pack is random. Cards placed in the discard rack are not randomly ordered. More than two cards are delivered to each compartment.

U.S. Pat. No. 6,267,248 describes a carousel-type card shuffler that uses a card imaging system to identify cards as they move from a card infeed tray to compartments in a rotatable carousel. The card shuffler randomly loads cards into compartments in the carousel, and sequentially unloads the compartments. More than two cards may be delivered to each compartment. U.S. Pat. No. 6,651,981 describes a flush-mounted batch card shuffler that elevates shuffled cards to the game play surface. U.S. Pat. No. 7,677,565 describes a similar card shuffler that also includes card recognition capability. These card shufflers form a single stack of a shuffled deck or multiple decks. The stack formed in the shuffler is gripped at randomly selected elevations. A section of the stack of cards beneath the grippers is lowered, which creates an insertion opening into the stack into which additional cards may be inserted to shuffle the cards. Products as described in these patents have been commercialized by Shuffle Master, Inc. either currently or in the past as DECK MAIL® and MD2® and MD3™ card shufflers.

U.S. Pat. No. 7,766,332 describes a hand-forming card shuffler that includes card recognition capability. The device described in this patent has been commercialized by Shuffle Master, Inc. as the I-DEAL® card shuffler.

BRIEF SUMMARY

In some embodiments, the present disclosure includes an automatic card shuffler. The automatic card shuffler comprise a card input mechanism, a rack with card storage compartments for holding more than one card, an elevator configured to move the rack relative to the card input mechanism, and a control system. The control system is configured to select at least one card storage compartment as an overflow compartment, randomly select a primary card position for each card of the cards moving through the card input mechanism, align the rack relative to the card input mechanism such that each card moving through the card input mechanism is inserted into the respective randomly selected primary card position for each card, and align the rack relative to the card input mechanism such at least one card is inserted into the overflow compartment responsive to the at least one card failing to be inserted into its selected primary card position.

In some embodiments, the present disclosure includes an automatic card shuffler. The automatic card shuffler comprises a card infeed area, a rack having compartments configured to hold at least two cards delivered to the rack from the card infeed area, a card mover configured to move cards from the card infeed area into the compartments of the rack when aligned with the card infeed area, and a control system. The control system is configured to control the rack to move to a first position of a first compartment when a first card is located within the first compartment, control the card mover to at least partially insert a second card from the card infeed area into the first compartment with the rack aligned with the first position, control the rack to move to a second position of the first compartment, and control the card mover to complete insertion of the second card into the first compartment with the rack aligned with the second position of the first compartment.

In some embodiments, the present disclosure includes a method of handling cards. The method comprises randomly determining and correlating primary card positions with cards to be shuffled by a card shuffler, randomly determining at least one compartment of a rack of the card shuffler to be an overflow compartment, transferring a first card with a card mover from a card infeed area into a first compartment according to its randomly defined primary card position, and transferring a second card with the card mover from the card infeed area into the overflow compartment responsive to the card mover failing to insert in its randomly defined primary card position.

DETAILED DESCRIPTION

The illustrations presented herein are not meant to be actual views of any particular card shuffler or component thereof, but are merely idealized representations that are used to describe embodiments of the disclosure.

As used herein, the term "shuffle," when used with reference to cards, means to randomize an order of cards in a stack of cards.

Figure 1:
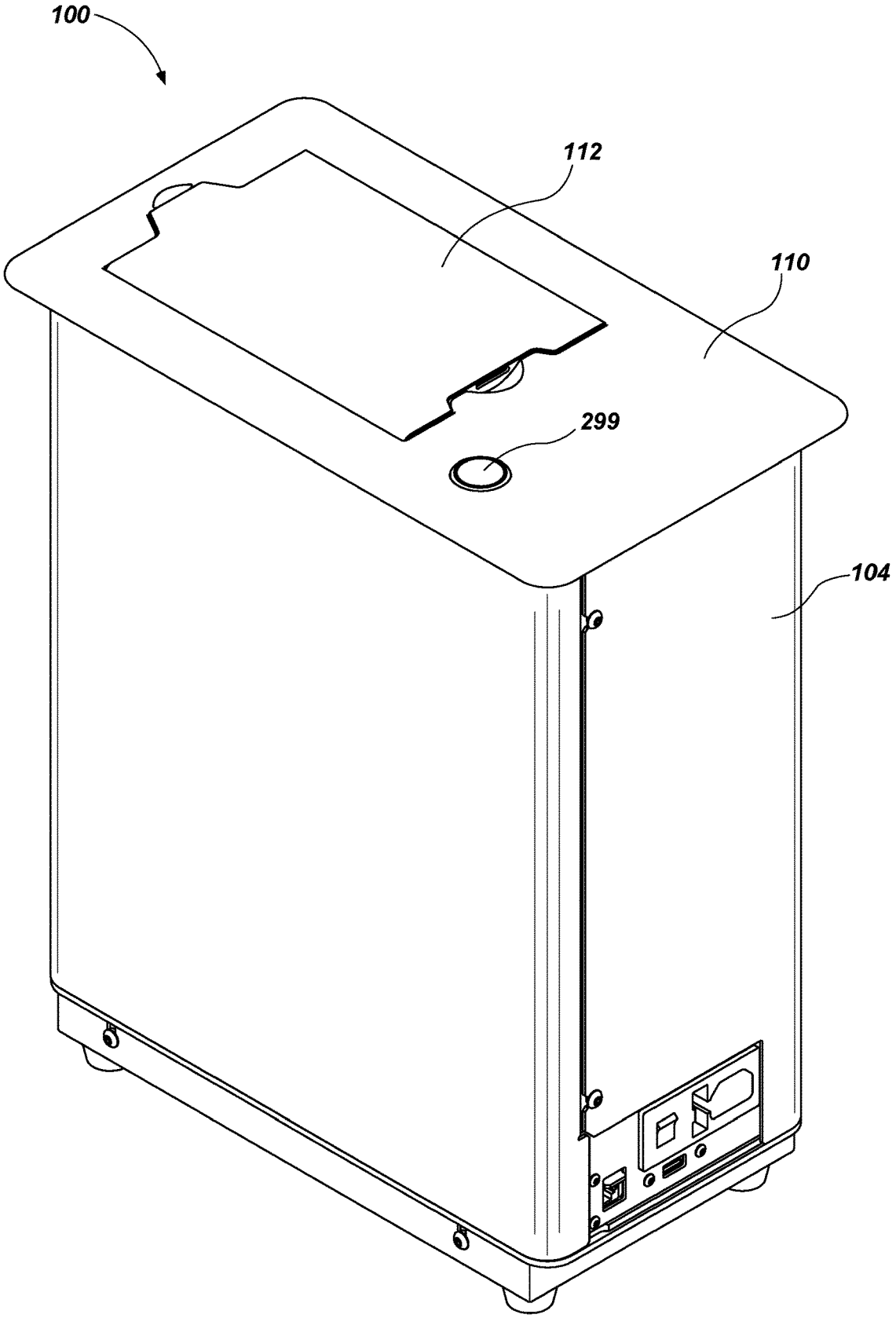
FIG. 1 is a back isometric view of an exterior of an automatic card shuffler including a lid to cover a card input area and a card output area, wherein the lid is illustrated in a closed position.

FIG. 1 is a perspective view of an automatic card shuffler 100. The card shuffler 100 is configured to automatically randomize an order of cards in a stack of cards, such as a 52-card deck of cards, for example. The cards may be playing cards for use in playing card games, such as poker, single deck blackjack or double deck blackjack, or other hand-pitched games. The card shuffler 100 is a batch card shuffler, in that a plurality of cards are inserted into the card shuffler 100 in the form of a first stack, the card shuffler 100 randomly reorders the cards and assembles the cards into a second shuffled stack, which is then output from the card shuffler 100 in batch form as a stack of shuffled cards.

The card shuffler 100 may be capable of performing additional operations on one or more cards inserted into the card shuffler 100. For example, the card shuffler 100 may be configured to sort cards in a stack of cards inserted into the card shuffler 100 into a predefined order, such as original deck order. The card shuffler 100 may be configured to verify the presence or absence of cards in a predefined set of different cards having one or more distinguishing characteristics (e.g., rank and/or suit of standard playing cards and/or special card markings). The card shuffler 100 may be configured to detect and identify cards that are damaged to allow the cards to be removed from a set of cards prior to use of the set of cards in a playing card game. Thus, although the card handling machine is referred to herein as a card "shuffler," it may also be characterized as a card sorter, a card verifier, etc.

As discussed in further detail below, the card shuffler 100 includes an internal card storage device, a card input mechanism for moving cards from a card input area into the internal card storage device, and a card output mechanism for moving cards from the internal card storage device to a card output area. The card shuffler 100 also may include a card reading system for capturing data from one or more images of cards inserted into the card shuffler 100. Examples of suitable card reading systems include complementary metal-oxide-semiconductor (CMOS) 2D imaging systems and contact image sensor (CIS) and CMOS line scanners. The card shuffler 100 further includes a control system for controlling the various active components of the card shuffler 100, for receiving input from a user of the card shuffler 100, and for outputting information to a user of the card shuffler 100.

Figure 2:
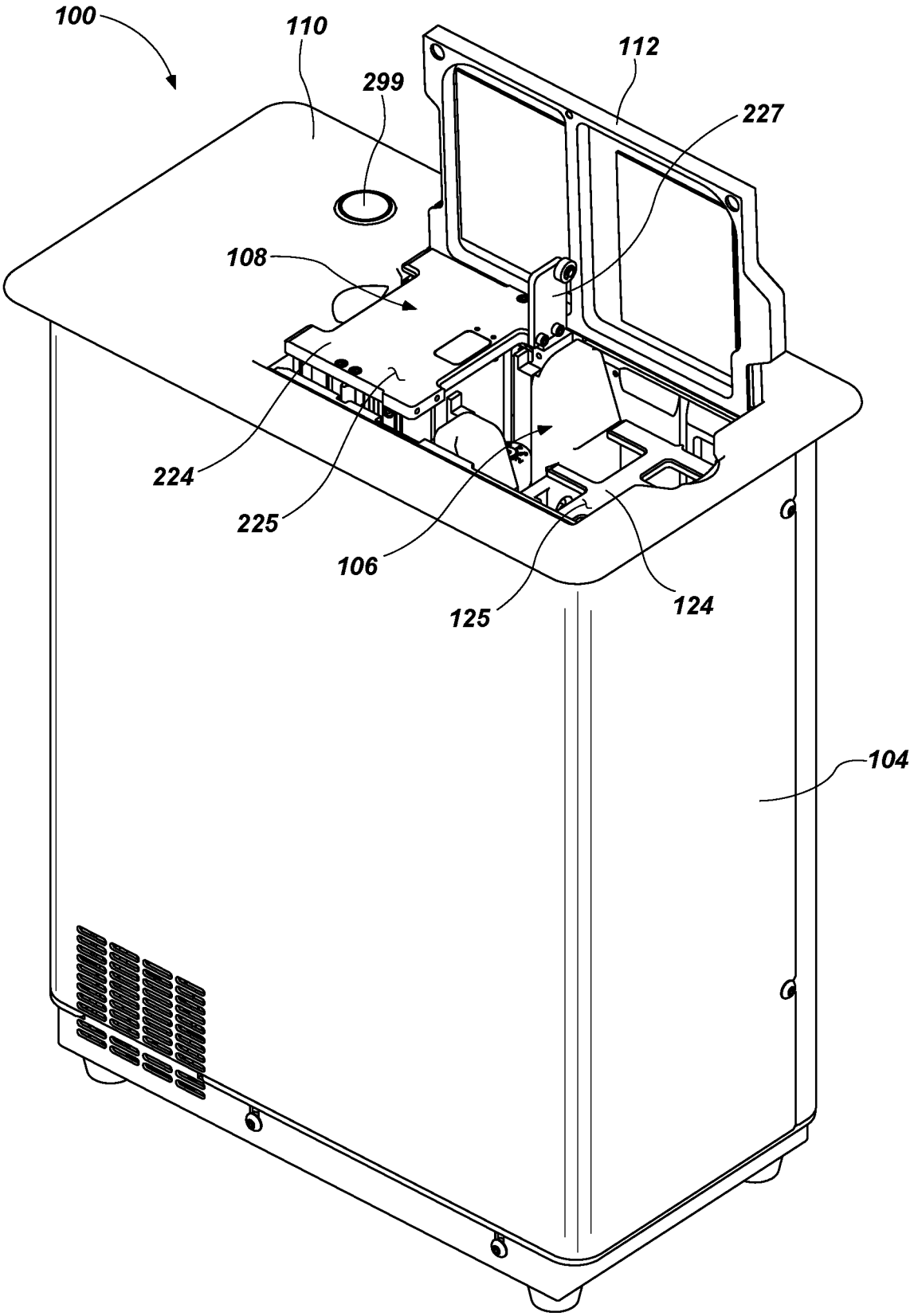
FIG. 2 is a front isometric view of the card shuffler of FIG. 1 illustrating the lid in an open position exposing the card input area and the card output area.
Figure 4:
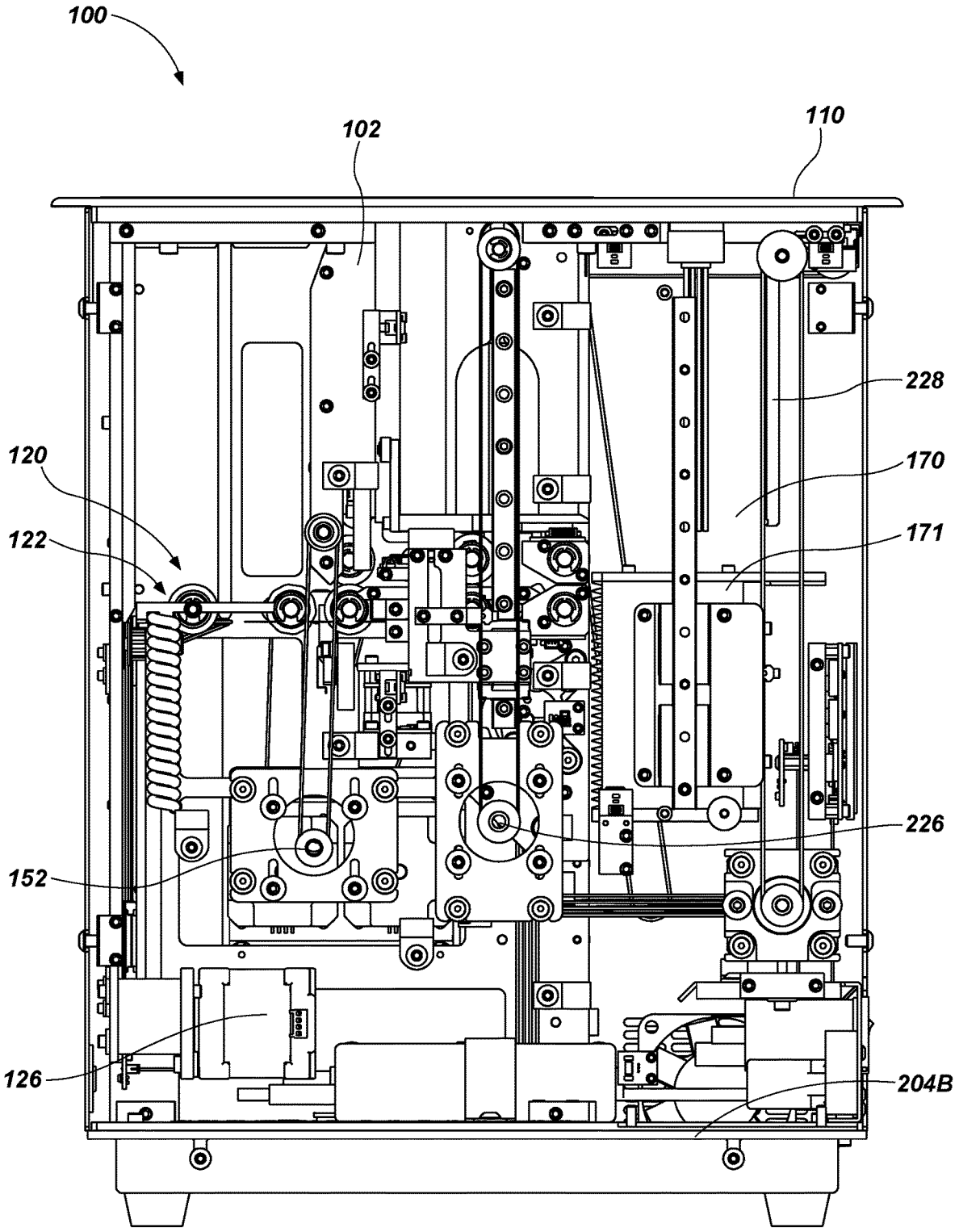
FIG. 4 is a second side elevational view of a right side of the card shuffler with the outer cover removed.
Figure 5:
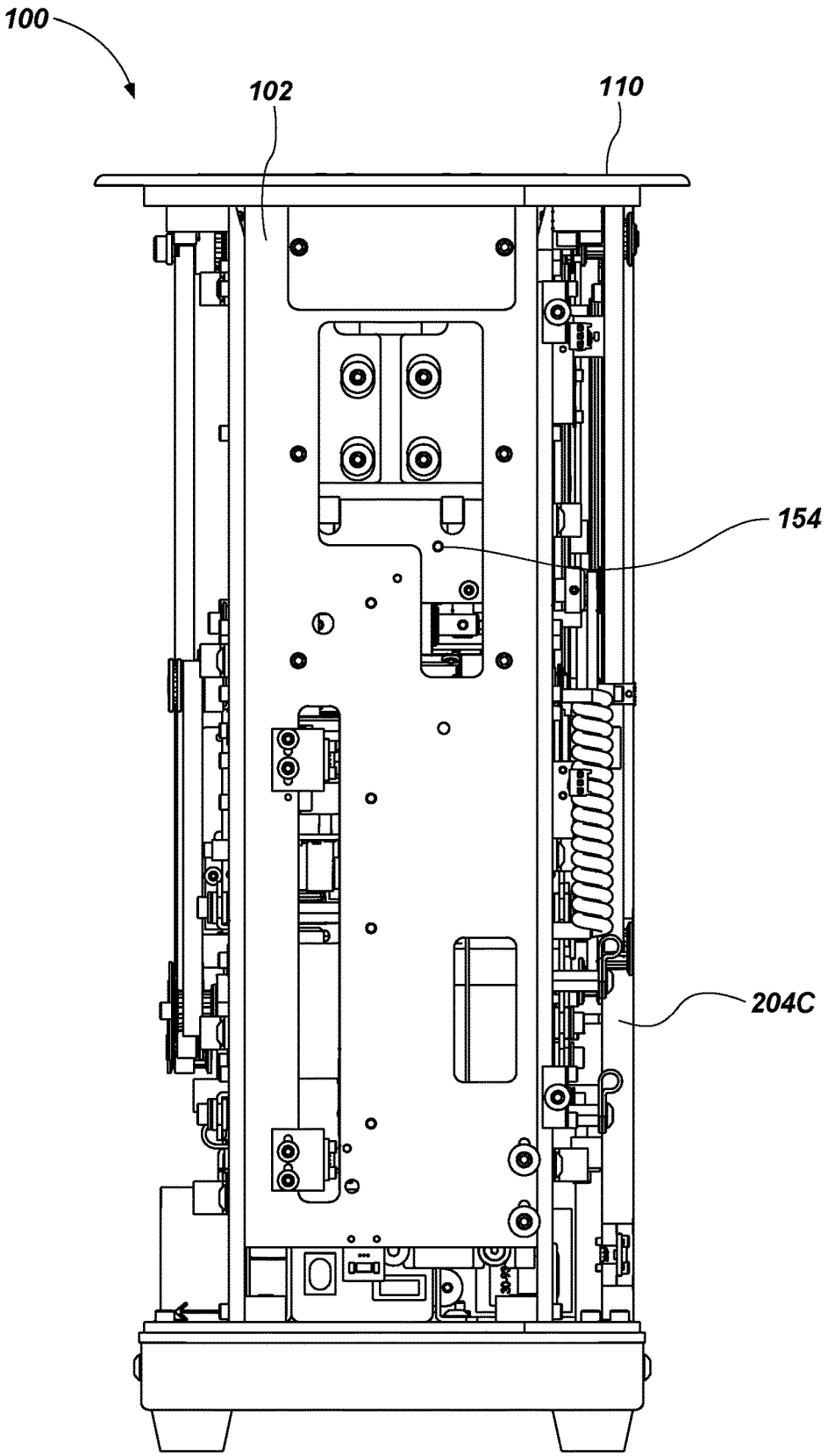
FIG. 5 is a third side elevational view of a front side of the card shuffler with the outer cover removed.

Referring briefly to FIG. 4, the card shuffler 100 includes an internal structural frame 102, to which the various components of the card shuffler 100 may be directly or indirectly coupled. The frame 102 may comprise a plurality of members that may be coupled together to form the frame 102. Referring again to FIG. 1, an outer cover 104 may be coupled to the internal structural frame 102 around the internal components of the card shuffler 100. The outer cover 104 covers and protects the internal components of the card shuffler 100. The card shuffler 100 includes a card input area 106 and a separate card output area 108, as shown in FIG. 2. Cards to be shuffled may be assembled into a first stack, which may be placed into the card input area 106. After shuffling or sorting the cards, the card shuffler 100 may deliver a second stack of shuffled/sorted cards to the card output area 108. As mentioned above, the second stack may be formed by randomly reordering the cards in the first stack placed in the card input area 106.

The card shuffler 100 may be configured to be mounted such that an upper surface 110 of the card shuffler 100 is at least substantially level (i.e., flush) with a surface of a playing card table, such as a poker table for example. A lid 112 may be used to cover the card input area 106 and the card output area 108 at times other than when cards are being loaded into the card input area 106 or being removed from the card output area 108. The lid 112 may be attached to the frame 102 and/or the top surface 110 of the outer cover 104 (FIG. 4) and may be configured to open and close automatically during operation of the card shuffler 100. FIG. 1 illustrates the card shuffler 100 with the lid 112 in the closed position, and FIG. 2 illustrates the card shuffler 100 while the lid 112 is in the open position for loading and/or unloading cards.

Figure 3:
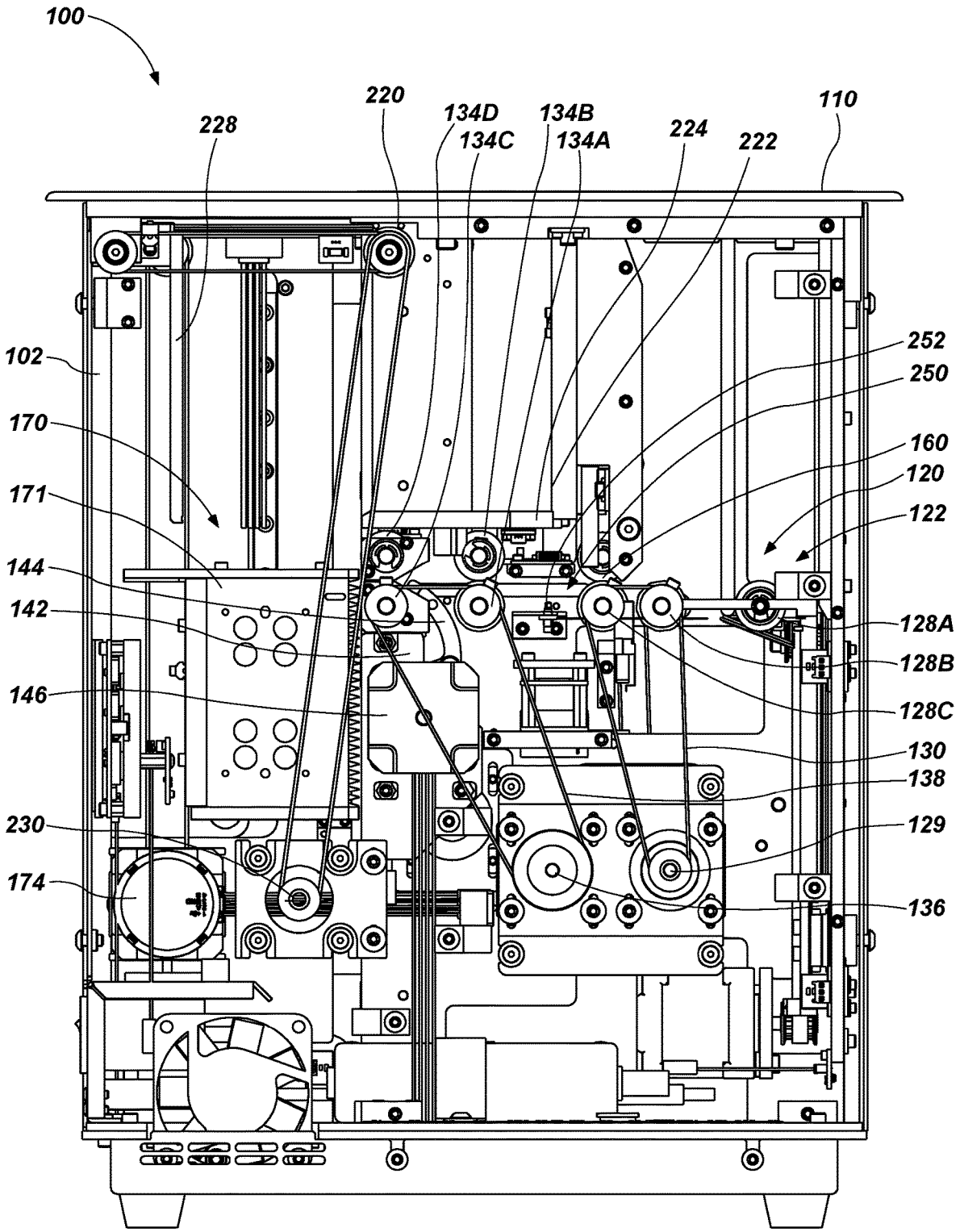
FIG. 3 is a first side elevational view of a left side of the card shuffler with an outer cover removed to expose internal components of the card shuffler.

FIGS. 3 through 6 illustrate the card shuffler 100 with the outer cover 104 and other components, such as frame members, removed from the view to reveal internal components and mechanisms of the card shuffler 100. As shown in FIG. 3, the card shuffler 100 includes a card input mechanism 120, a card storage device 170 for temporarily storing cards within the card shuffler 100, and a card output mechanism 220. The card input mechanism 120 is configured to move cards from the card input area 106 (FIG. 2) into the card storage device 170, and the card output mechanism 220 is configured to move cards from the card storage device 170 to the card output area 108 (FIG. 2).

The card input mechanism 120 includes an input elevator 122 including a card support 124 (FIG. 2) that is configured to translate vertically along a linear path between an upper loading position and a lower unloading position, and a motor 126 configured to drive movement of the card support 124 between the loading and unloading positions. As shown in FIG. 2, the card support 124 has an upper support surface 125 for supporting a stack of cards thereon. In the loading position, the card support 124 is located proximate the upper surface 110 of the card shuffler 100 to allow a user to place a stack of cards to be shuffled on the support surface 125 of the card support 124 in the card input area 106. This position may be above, below or at the gaming surface elevation. In the unloading position, the card support 124 is located at another position within the card shuffler 100 from which cards are moved out from the stack and toward the card storage device 170.

Referring again to FIGS. 3 through 6, the card input mechanism 120 includes one or more pick-off rollers 128A-128C. The pick-off rollers 128A-128C are used to sequentially move a bottom card in a stack of cards on the support surface 125 out from the stack of cards in a lateral, horizontal direction toward the card storage device 170. Two or more of the pick-off rollers 128A-128C may be driven in unison by a motor 129 using a belt 130 engaged with complementary pulleys mounted on axles carrying the pick-off rollers 128A-128C. One or more of the pick-off rollers 128A-128C, such as the pick-off roller 128A, optionally may comprise an idler roller that is not driven by the motor 129, but rather idly rolls along the surface of a card moving past the idler roller responsive to rotation of other driven pick-off rollers, such as 128B and 128C, driven by the motor 129.

As discussed in further detail below with reference to FIGS. 11 and 12, the card input mechanism 120 may further include an adjustable brake roller assembly 156 that includes a brake roller 160 disposed proximate the pick-off roller 128C so as to dispose a card gap between the brake roller 160 and the pick-off roller 128C through which cards pass as they move through the card input mechanism 120 toward the card storage device 170.

With continued reference to FIGS. 3 through 6, the card input mechanism 120 further includes one or more speed-up rollers 134A-134D, and a motor 136 configured to drive rotation of one or more of the speed-up rollers 134A-134D. The speed-up rollers 134A-134D are used to accept a card from the pick-off rollers 128A-128C, and to insert the card into the card storage device 170. The speed-up rollers 134A-134D may be located and configured to contact and grab a leading edge of a card just prior to the point at which a trailing edge of the card passes beyond and is released from the pick-off rollers 128A-128C. Thus, as the leading edge of the card contacts the speed-up rollers 134A-134D, as controlled and determined by selective rotation of the pick-off rollers 128A-128C, the card will be grabbed and pulled out from the pick-off rollers 128A-128C and inserted into the card storage device 170 by the speed-up rollers 134A-134D.

As with the pick-off rollers 128A-128C, two or more of the speed-up rollers 134A-134D may be driven in unison by the motor 136 using a belt 138 engaged with complementary pulleys mounted on axles carrying the speed-up rollers 134A-134D. One or more of the speed-up rollers 134A-134D, such as the speed-up roller 134B and the speed-up roller 134D, optionally may comprise idler rollers that are not driven by the motor 136, but rather idly roll along the surface of a card moving past the idler roller responsive to rotation of other driven speed-up rollers, such as 134A and 134C, driven by the motor 136.

During a shuffling operation of the card shuffler 100, the speed-up rollers 134A-134D may be continuously rotated at a substantially constant rotational speed. Rotation of the pick-off rollers 128A-128C, however, may be selectively started and stopped by a control system 280 (FIG. 13) of the card shuffler 100. When rotation of the pick-off rollers 128A-128C is commenced, the pick-off rollers 128A-128C may rotate at a rotational speed that is less than the rotational speed of the speed-up rollers 134A-134D.

The card input mechanism 120 further includes a packing device 142 that is used to ensure that cards inserted into the card storage device 170 are fully inserted into the card storage device 170. The packing device 142 includes a card packer 144, and a motor 146 configured to drive movement of the card packer 144 between a first extended position (see FIG. 14D) and a second retracted position (see FIG. 14C). Referring briefly to FIG. 14C, the card packer 144 may be mounted on an axle 148, about which rotation of the card packer 144 may be driven by the motor 146. Referring again to FIGS. 3 through 6, the card packer 144 may be moved to the retracted position to allow a card to pass by the card packer 144 and into the card storage device 170. After the trailing edge of the moving card has passed over the card packer 144, the card packer 144 may be moved into the extended position, which may "pack" the card into the card storage device 170 in such a manner as to ensure that the card is pushed fully into the card storage device 170 and does not bounce back out from the card storage device 170.

Thus, the card packer 144 of the packing device 142 may rock back and forth with each successive passing card, ensuring that each card is fully seated within the card storage device 170.

The card input mechanism 120 may further include a card weight device 154 for applying a downward force on any stack of cards resting on the card support 124. The force applied on the stack of cards may ensure that sufficient frictional force is provided between the bottommost card in the stack of cards on the card support 124 and the pick-off rollers 128A-128C to ensure that the pick-off rollers 128A-128C can reliably remove the bottommost cards sequentially one at a time from the stack until each card in the stack has been removed. The card weight device 154 may comprise a lever that may be moved into an activated position in which the card weight device 154 is in direct physical contact with the upper surface of the topmost card in the stack of cards on the card support 124, and applies a downward force to the cards, after the input elevator 122 has been lowered into the card shuffler 100 below the card input area 106. The lever also may be moved into a deactivated position in which the lever does not engage the stack of cards on the card support 124. A card weight motor 152 (see FIG. 13) may be used to drive movement of the card weight device 154 between the activated position and the deactivated position. After all cards in the stack of cards on the card support 124 have been moved into the card storage device 170 by the card input mechanism 120, the card weight motor 152 may be actuated to retract the card weight device 154 into the deactivated position so as to allow additional cards to be placed onto the card support 124.

Figure 8A:
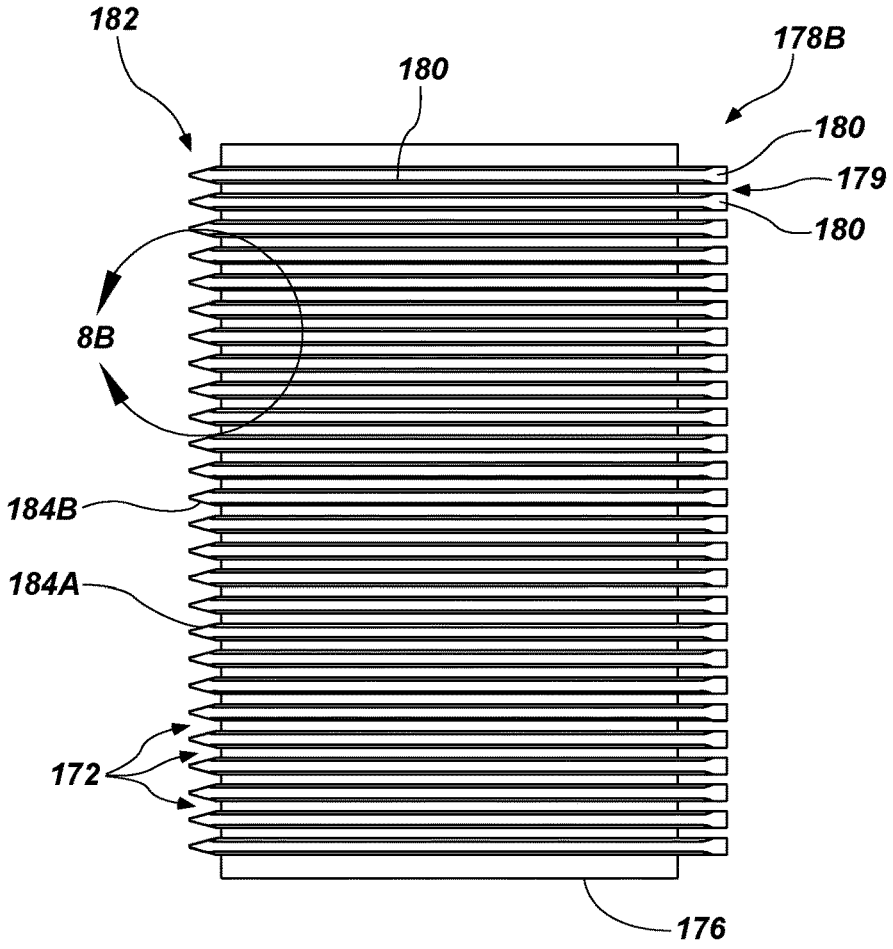
FIG. 8A is a side elevational view of a component of the rack.
Figure 8B:
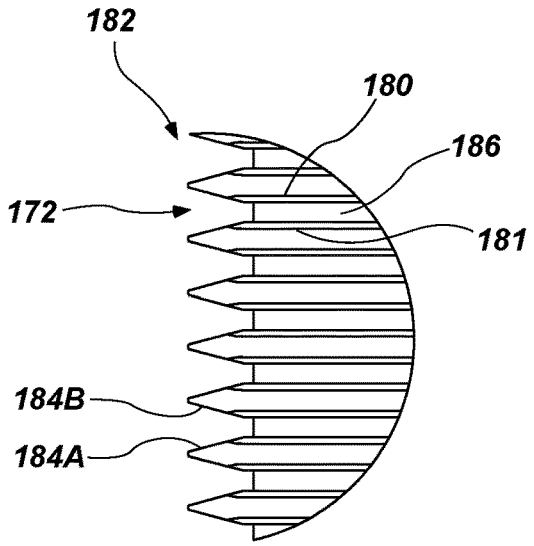
FIG. 8B is an enlarged view of a portion of FIG. 8A.

The card storage device 170 includes a rack 171 that includes a plurality of card storage compartments 172 therein (see FIGS. 8A and 8B). Each of the card storage compartments 172 may be sized and configured to contain one or more cards therein. In some embodiments, each of the card storage compartments 172 may be sized and configured to contain two or more cards therein. In some embodiments, each card storage compartment 172 may be sized and configured to hold only two cards therein. For example, each card may have a thickness of between about 0.0107 inch and about 0.0129 inch. Each compartment may be about 0.047±0.002 inch in some embodiments. For embodiments in which two card may be inserted in each card storage compartment, the number of card storage compartments 172 may be about one half of a number of cards that are expected to be shuffled using the card shuffler 100 plus one or more overflow compartments. For example, if the card shuffler 100 is configured to shuffle a single fifty-two (52) card deck of standard playing cards, which optionally may include two additional cards (e.g., Jokers), the rack 171 may include between twenty-six (26) and twenty-nine (29) card storage compartments 172. It may be desirable to provide one or more extra shelves so that the machine can deliver a card to the one or more extra shelves when a prior delivery attempt to a different compartment failed. For example, if a card is bent and cannot be inserted into a selected compartment, the card shuffler 100 may move the card into an extra compartment (which, in some embodiments, may be larger in size than other compartments to accommodate such a bent card). In embodiments for processing two decks of 52 to 54 cards each, the rack can contain between fifty four (54) and fifty eight (58) compartments.

The card rack 171 is configured to translate in the vertical direction along a linear path. The card storage device 170 includes a motor 174 configured to drive movement of the rack 171 up and down in the vertical direction. The motor 174 includes an encoder, which may be used to identify relative positions of the rack 171 from a known home position. The home position may correspond to the location at which a bottom surface 176 of the rack 171 (FIG. 8A) is vertically aligned with a card disposed between the speed-up rollers 134A-134D.

To identify and calibrate the home position in a set-up or a calibration operational mode of the card shuffler 100, the rack 171 may be moved to the lowermost position within the card shuffler 100, and the encoder associated with the motor 174 may be reset, or the value of the encoder at the lowermost position may be recorded. The rack 171 may be moved upward within the card shuffler 100 to a location at which the bottom surface 176 of the rack 171 will certainly be located in a plane located vertically above any card gripped between the speed-up rollers 134A-134D. The card shuffler 100 then may cause the speed-up rollers 134A-134D to move a card into the space below the rack 171 without losing the grip on the card and completely inserting the card into the space below the rack 171. The card then may be drawn back away from the space below the rack 171 by the speed-up rollers 134A-134D, and the rack 171 may be lowered by a small incremental distance. The card shuffler 100 then may again cause the speed-up rollers 134A-134D to attempt to move the card into the space below the rack 171 without losing the grip on the card by the speed-up rollers 134A-134D. This process of attempting to insert the card into the space below the bottom surface 176 of the rack 171 and then incrementally lowering the rack 171 may be repeated until the card abuts against the side of the rack 171, such that the speed-up rollers 134A-134D are prevented from inserting the card into the space an expected distance, which may be detected by, for example, using a sensor (as discussed below) or monitoring an electrical current of the motor 136 driving the speed-up rollers 134A-134D. The location of the rack 171 at this point, as determined by the value of the encoder associated with the motor 174, may be set as the home position in the control system 280 (FIG. 13) of the card shuffler 100. In additional embodiments, the rack 171 may be moved to the lowermost position within the card shuffler 100, and the encoder associated with the motor 174 may be reset, or the value of the encoder at the lowermost position may be recorded. The rack 171 may be moved upward within the card shuffler 100 to a location at which the bottom surface 176 of the rack 171 will certainly be located in a plane located vertically below any card gripped between the speed-up rollers 134A-134D, but wherein all card storage compartments are located vertically above any card gripped between the speed-up rollers 134A-134D. The card shuffler 100 then may cause the speed-up rollers 134A-134D to attempt to move a card into the rack 171. If the card is not able to be inserted into the rack 171, the card then may be drawn back away from the rack 171 by the speed-up rollers 134A-134D, and the rack 171 may be raised by a small incremental distance. The card shuffler 100 then may again cause the speed-up rollers 134A-134D to attempt to move the card into the rack 171 or into a space below the rack 171 without losing the grip on the card by the speed-up rollers 134A-134D. This process of attempting to move the card into a space occupied by the rack 171 and then incrementally raising the rack 171 may be repeated until the card is able to move into the space below the rack 171 without losing the grip on the card by the speed-up rollers 134A-134D, which may be detected by, for example, using a sensor (as discussed below) or monitoring an electrical current of the motor 136 driving the speed-up rollers 134A-134D. The location of the rack 171 at this point, as determined by the value of the encoder associated with the motor 174, may be set as the home position in the control system 280 (FIG. 13) of the card shuffler 100.

FIGS. 7 through 10 illustrate the card storage device 170 separate from other components of the card shuffler 100. As shown therein, the rack 171 optionally may include a first side bracket assembly 178A and a second side bracket assembly 178B. Each of the side bracket assemblies 178A, 178B include multiple slots 179 formed therein so as to define ribs 180, 181 between the slots 179. The side bracket assemblies 178A, 178B may be aligned with one another and coupled together using one or more cross members 188, such that a central void 189 is defined between the side bracket assemblies 178A, 178B, and such that slots 179 in the first side bracket assembly 178A align with corresponding complementary slots 179 in the second side bracket assembly 178B. Each card storage compartment 172 is defined by a slot 179 in the first side bracket assembly 178A and a corresponding and complementary slot 179 in the second side bracket assembly 178B.

The central void 189 between the side bracket assemblies 178A, 178B may be sized and configured to allow an ejector 228 (FIGS. 3 and 4) to be positioned within or adjacent the rack 171 alongside cards positioned within the card storage compartments 172, and to translate horizontally in a lateral direction to eject cards out from the rack 171, as discussed in further detail below. As shown in FIGS. 8A and 8B, ends 182 of the ribs 180, 181 proximate the speed-up rollers 134A-134D may include tapered upper surfaces 184A and tapered lower surfaces 184B. Cards contacting a tapered surface are deflected and driven into the compartment 172 adjacent to a card already present in the compartment. By aligning the card being fed with an upper tapered surface, the card may be driven into the compartment 172 above a card already present. By aligning the card being fed with a lower tapered surface, the card may be driven into the compartment 172 below a card already present. When the device is used to place cards in a pre-selected order, such as original deck order, the tapered surfaces are essential to achieve a desired order. When a random order is desired, the tapered surfaces may also be used to achieve a desired random distribution. For example, the processor may select a location for each card to be fed at the beginning of a shuffling cycle. Each compartment has two locations, an upper and lower. If a card was assigned to location 1, another card would be driven in below the first card in location 2.

As discussed in further detail below, the card shuffler 100 may be configured to selectively position the rack 171 any one of three different positions for each of the card storage compartments 172 in the rack 171. In particular, the card shuffler 100 may be configured to selectively position the rack 171 such that a card being inserted into a selected card storage compartment 172 by the speed-up rollers 134A-134D registers with a space 186 between the upper and lower ribs 180 and 181 defining that card storage compartment 172 when the card is being fed into an empty compartment. When a card is already present in the compartment 172, the next card may be fed such that the next card is aligned with the tapered lower surface 184B of the upper rib 180 defining that card storage compartment 172, or such that the card is aligned with the tapered upper surface 184A of the lower rib 181 defining that card storage compartment 172, depending on whether the processor is directing the device to deliver the next card on top of or below the first card inserted.

Referring again to FIGS. 3 through 6, the card shuffler 100 includes a card output mechanism 220 (FIG. 3) for moving cards within the rack 171 of the card storage device 170 out from the rack 171 and to the card output area 108 (FIG. 2). As shown in FIG. 3, the card output mechanism 220 includes an output elevator 222 including a card support 224 (see also FIG. 2) that is configured to translate vertically along a linear path between a lower loading position and an upper unloading position, and a motor 226 (FIG. 4) configured to drive movement of the card support 224 between the loading and unloading positions. The card support 224 has an upper support surface 225 (FIG. 2) for supporting a stack of cards thereon. In the loading position, the card support 224 is located at a position within the card shuffler 100 at which all cards in the rack 171 may be moved out from the rack 171 and onto the support surface 225 of the card support 224. In the unloading position, the card support 224 is located proximate the upper surface 110 of the card shuffler 100 in the card output area 108 to allow a user to remove a stack of shuffled cards from the support surface 225 of the card support 224, as shown in FIG. 2. The card support 224 may be located above, below or at the top surface 110. As also shown in FIG. 2, a lever member 227 may be attached to the card support 224. The lever member 227 may be located and configured to impinge against and lift the lid 112 automatically as the card support 224 moves to the upper unloading position. As the card support 224 is lowered to the lower loading position, the lid 112 may automatically close due to the force of gravity, the force of member 227, one or more springs or other biasing members, etc.

As shown in FIGS. 3 and 4, the card output mechanism 220 includes an ejector 228 that is used to eject all cards within the card storage compartments 172 in the rack 171 out from the rack 171, simultaneously and together in batch form as a group, and onto the card support surface 225 of the card support 224 in the form of a stack of shuffled cards. The ejector 228 may comprise an elongated and vertically oriented bar or rod having a length at least as long as the height of the rack 171. The ejector 228 may be mounted to the frame 102 at a location in a plane vertically above the rack 171. The ejector 228 may be configured to translate horizontally along a linear path between a first position on a first lateral side of the rack 171 proximate the card support 224 and the speed-up rollers 134A-134D, and a second position on an opposite second lateral side of the rack 171 from the card support 224 and the speed-up rollers 134A-134D. The card output mechanism 220 further includes an ejector motor 230 (FIG. 3) configured to selectively drive movement of the ejector 228 between the first position and the second position.

As previously mentioned, the rack 171 includes a central void 189 defined between the side brackets 178A, 178B. The central void 189 and the ejector 228 may be sized and configured to allow the ejector 228 to move through the central void 189 from the second position of the ejector 228 (on the side of the rack 171 opposite the card support 224) to the first position of the ejector 228 (on the same side of the rack 171 as the card support 224) when the rack 171 is in the upper position, which will cause the ejector 228 to eject any and all cards in the card storage compartments 172 of the rack 171 to be simultaneously ejected out from the rack 171 and onto the card support surface 225 of the card support 224.

In additional embodiments, however, the rack 171 may not be positioned in the uppermost position when the ejector 228 is used to eject cards in the card storage compartments 172 out from the rack 171, and may be positioned at a selected location, such that cards are ejected from a selected number of card storage compartments 172 that is less than the total number of card storage compartments 172. In other words, the rack 171 may be positioned such that any card storage compartments 172 vertically above a horizontal plane in which the lowermost end of the ejector 228 is located will be ejected out from the rack 171 upon actuation of the ejector 228. In such a configuration, the ejector 228 of the card output mechanism 220 is configured to simultaneously eject cards out from two or more card storage compartments 172 of the movable rack 171, and is capable of simultaneously ejecting cards out from less than all card storage compartments 172 of the movable rack 171.

The card shuffler 100 optionally may include a card reading and/or imaging system 250 configured to capture data representing at least rank and suit information included in one or more images of each card passing through the card shuffler 100, so as to allow the card shuffler 100 to identify one or more characteristics of the cards, such as the rank and/or suit of standard playing cards. In some embodiments, however, data pertaining to cards read using the card imaging system 250 may not be used in the shuffling operations performed by the card shuffler 100 for the purpose of determining the random card order, although the data may be used in the shuffling operations for the purpose of card verification. The data pertaining to card data read using the card imaging system 250 may be used to verify the completeness of a set of cards by ensuring that no card expected to be in the set of cards is missing from the set of cards (e.g., a missing card in a single deck of standard playing cards), and/or that cards not expected to be present in the set of cards are not present in the set of cards (e.g., a duplicate or extra card in a single deck of standard playing cards).

As shown in FIG. 3, the card imaging system 250 may include an image sensor 252 for capturing images of cards. The term "image" as used herein means at least a portion of one of suit and rank indicia on a card and does not necessarily mean a full image of any card. The image sensor 252 may be located and configured, for example, to capture images of cards as the cards pass through the card input mechanism 120 between the pick-off rollers 128A-128C and the speed-up rollers 134A-134D. In other embodiments, the card image sensor is located in the card input area 106 beneath the card support 124 when the card support 124 is in a lowest position. In some embodiments, the card imaging system 250 may comprise a camera device that includes a complementary metal oxide semiconductor (CMOS) image sensor or a charge coupled device (CCD) image sensor. For example, the card sensing system may include a video camera imaging system as described in U.S. Pat. No. 7,677,565, which issued Mar. 16, 2010 to Grauzer et al., the disclosure of which is incorporated herein in its entirety by this reference.

Figure 9:
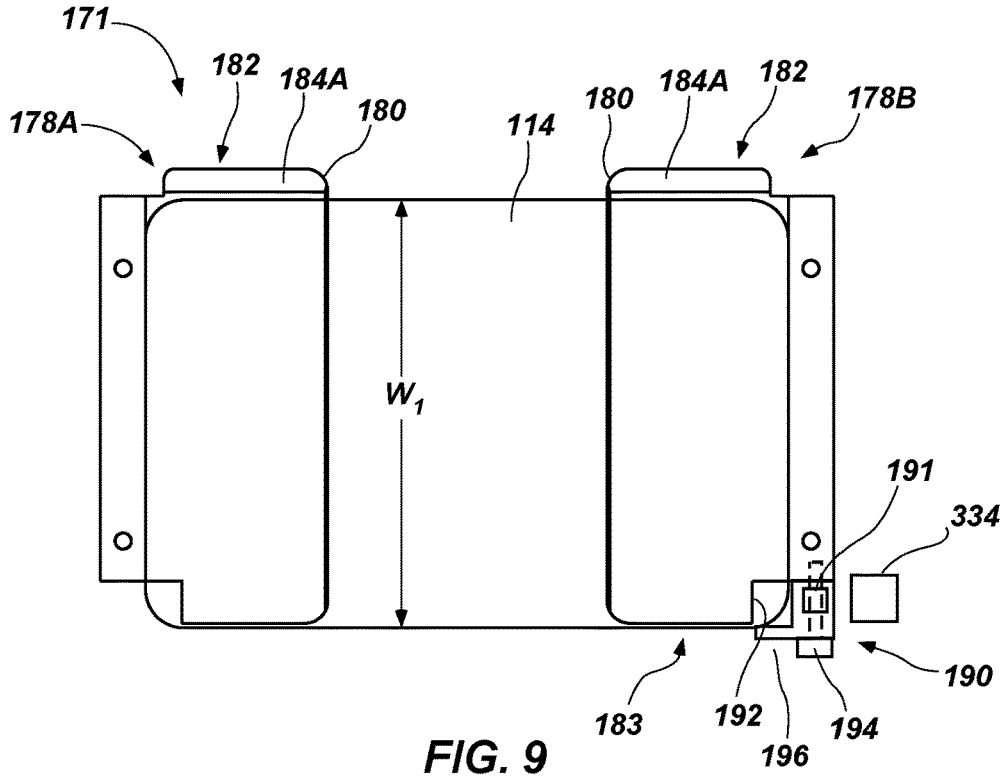
FIG. 9 is a top plan view of components of the rack illustrating the components assembled in a first configuration for use with cards of a first size.
Figure 10:
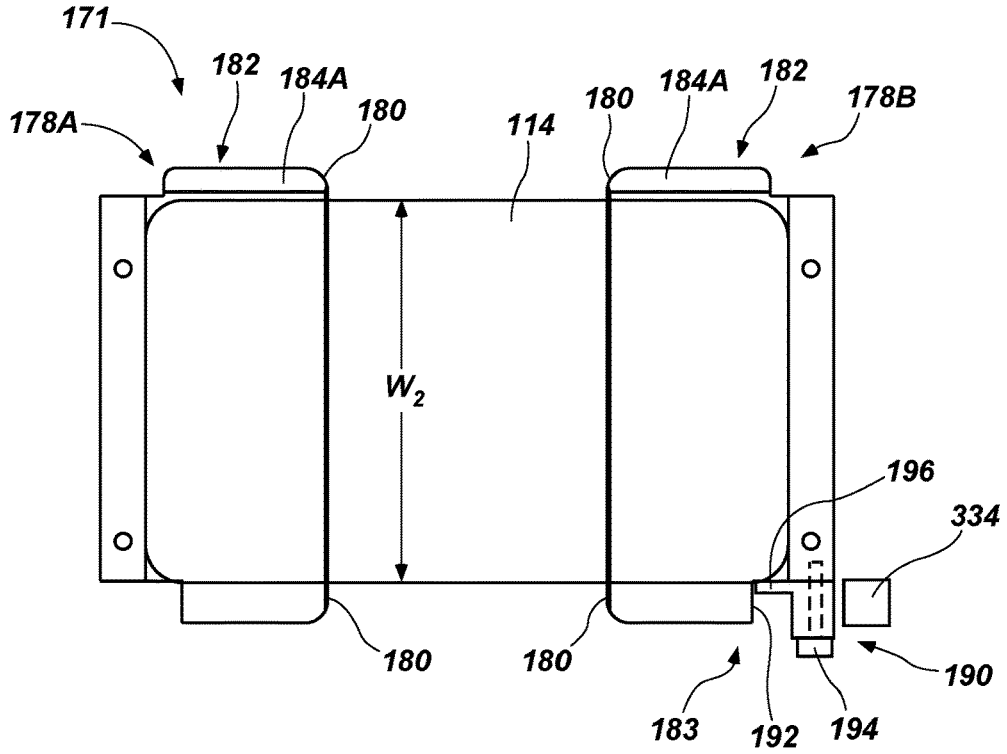
FIG. 10 is a top plan view like that of FIG. 9 illustrating the components of the rack assembled in a second configuration for use with cards of a different second size.

In some embodiments, the rack 171 of the card storage device 170 may be adaptable for use with cards having different sizes. Referring to FIGS. 9 and 10, in some embodiments, the rack 171 of the card storage device 170 may include a card size adjustment member 190 capable of being attached to, or otherwise positioned relative to the rack 171 in a first orientation for use with cards of a first size (e.g., a first height and/or width) or in a different second orientation for use with cards of a second size (e.g., a second height and/or width). For example, a notch 192 may be provided in a back side 183 of one or both of the side brackets 178A, 178B. The card size adjustment member 190 then may be configured as an elongated bar or rod (extending into the plane of FIGS. 9 and 10) that may be attached to one or both of the side brackets 178A, 178B within the notch 192 using one or more fasteners 194 (e.g., screws). The card size adjustment member 190 may include a projection 196 against which edges of cards 114 may abut when the cards 114 are inserted into the card storage compartments 172 in the rack 171.

As shown in FIG. 9, the card size adjustment member 190 may be attached to the second side bracket 178B within the notch 192 such that the projection 196 is located farther from the ends 182 of the ribs 180,181 having the tapered surfaces 184A, 184B, such that a card 114 having a first width $W_1$ (e.g., a standard poker card having a width of about 2.5 inches) may be received completely within any of the card storage compartments 172 in the rack 171. Referring to FIG. 10, the card storage device 170 may be adapted for use with cards 114 having a smaller second width $W_2$ (e.g., a standard bridge card having a width of about 2.25 inches) by moving the card size adjustment member 190 relative to the second side bracket 178B of the rack 171 to a different second orientation, wherein the projection 196 is located closer to the ends 182 of the ribs 180, 181 having the tapered surfaces 184A, 184B. Thus, the width of the card storage compartments 172 may be between about 0.20 inches and about 0.30 inches (e.g., about 0.25 inches) less, due to the position of the projection 196, when the card size adjustment member 190 is attached to the second side bracket 178B in the second orientation compared to when the card size adjustment member 190 is attached to the second side bracket 178B in the first orientation. Thus, the card size adjustment member 190 is capable of being positioned relative to the rack 171 in a first orientation (FIG. 9) and a different second orientation (FIG. 10), and each of the plurality of card storage compartments 172 in the rack 171 has a first size when the card size adjustment member 190 is positioned relative to the rack 171 in the first orientation and a different second size when the card size adjustment member 190 is positioned relative to the rack 171 in the second orientation.

In some embodiments, the card shuffler 100 may include a sensor 334 configured to detect when the card size adjustment member 190 is in the first orientation (shown in FIG. 9) or the second orientation (FIG. 10) relative to the rack 171. For example, a magnet 191 may be provided on or in the card size adjustment member 190 at a selected location, and a Hall effect sensor 334 may be located and configured to sense or otherwise detect the proximity of the magnet 191 to the Hall effect sensor 334 when the card size adjustment member 190 is in the first orientation (shown in FIG. 9) or in the second orientation (FIG. 10), but not both. For example, the magnet 191 may be located proximate the sensor 334 when the card size adjustment member 190 is in the first orientation (FIG. 9), but not when the card size adjustment member 190 is in the second orientation (FIG. 10). The sensor 334 may be coupled to the control system 280 (FIG. 13) of the card shuffler 100, such that the control system 280 may determine whether the rack 171 is configured for use with cards 114 having the first larger width $W_1$ (FIG. 9) or with cards 114 having the second smaller width $W_2$ (FIG. 10).

In some embodiments, the card shuffler 100 may also be adaptable for use with cards having different thicknesses. For example, the card shuffler 100 may include an adjustable brake roller assembly 156 shown in FIGS. 11 and 12. The brake roller assembly 156 may include a bracket 158 and a brake roller 160. The brake roller assembly 156 may be mounted within the card shuffler 100 such that the brake roller 160 is disposed proximate the pick-off roller 128C (as shown in FIG. 3) so as to dispose a card gap between the brake roller 160 and the pick-off roller 128C through which cards pass as they move through the card input mechanism 120 toward the card storage device 170. The brake roller 160 may be configured to move relative to the bracket 158 to selectively adjust the thickness of the card gap between the brake roller 160 and the pick-off roller 128C. The bracket 158 may be fixedly mounted to the frame. For example, as shown in FIGS. 11 and 12, the brake roller assembly 156 may include a rotatable dial 162. Rotation of the dial 162 may cause the brake roller 160 to move toward or away from the bracket 158, which may be mounted at a fixed location within the card shuffler 100, so as to adjust the card gap between the brake roller 160 and the pick-off roller 128C. The rotatable dial 162 may be biased to discrete rotational positions, such that rotation of the dial 162 between rotationally adjacent rotational positions causes the card gap to increase or decrease by predefined distances. In some embodiments, most, if not all, of the predefined distances may be at least substantially uniform (e.g., about 0.003 inches).

Figure 12:
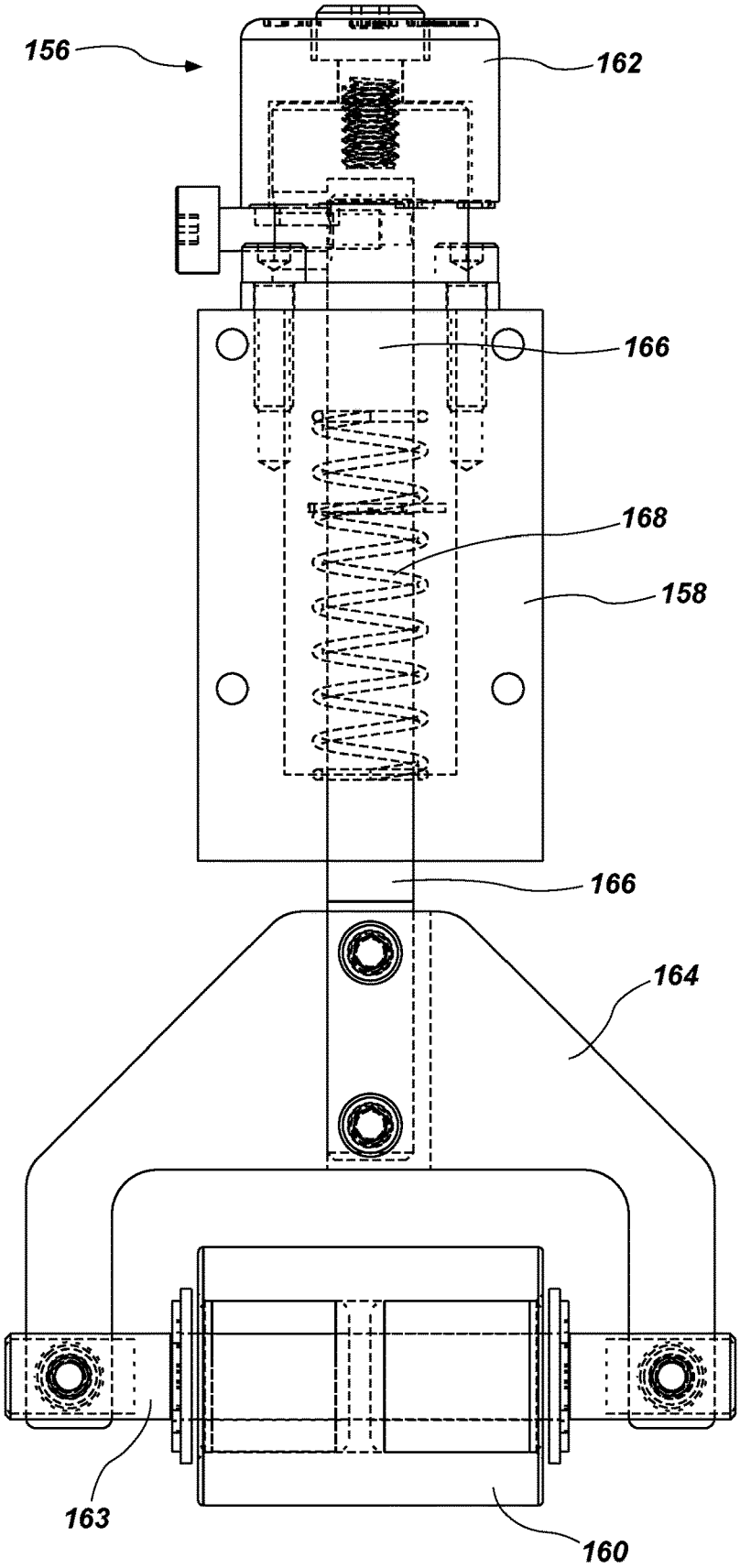
FIG. 12 is an elevational view of a back side of the brake roller assembly of FIG. 11.

As shown in FIG. 12, in one particular non-limiting embodiment, the brake roller 160 may be mounted on an axle 163. The axle 163 may be attached to a U-shaped bracket 164, which in turn may be attached to a first end of a rod 166 extending through the bracket 158 of the brake roller assembly 156. An opposite second end of the rod 166 may be engaged to the dial 162 by a threaded coupling. The dial 162 may be fixed in position relative to the bracket 158 such that, as the dial 162 is rotated relative to the bracket 158, the threaded coupling between the dial 162 and the rod 166 causes the rod 166 to move up or down within the bracket 158 depending on the direction of rotation of the dial 162. A spring 168 may be used to bias the rod 166 (and, hence, the brake roller 160) in the upward direction away from the pick-off roller 128C (FIG. 3).

Figure 11:
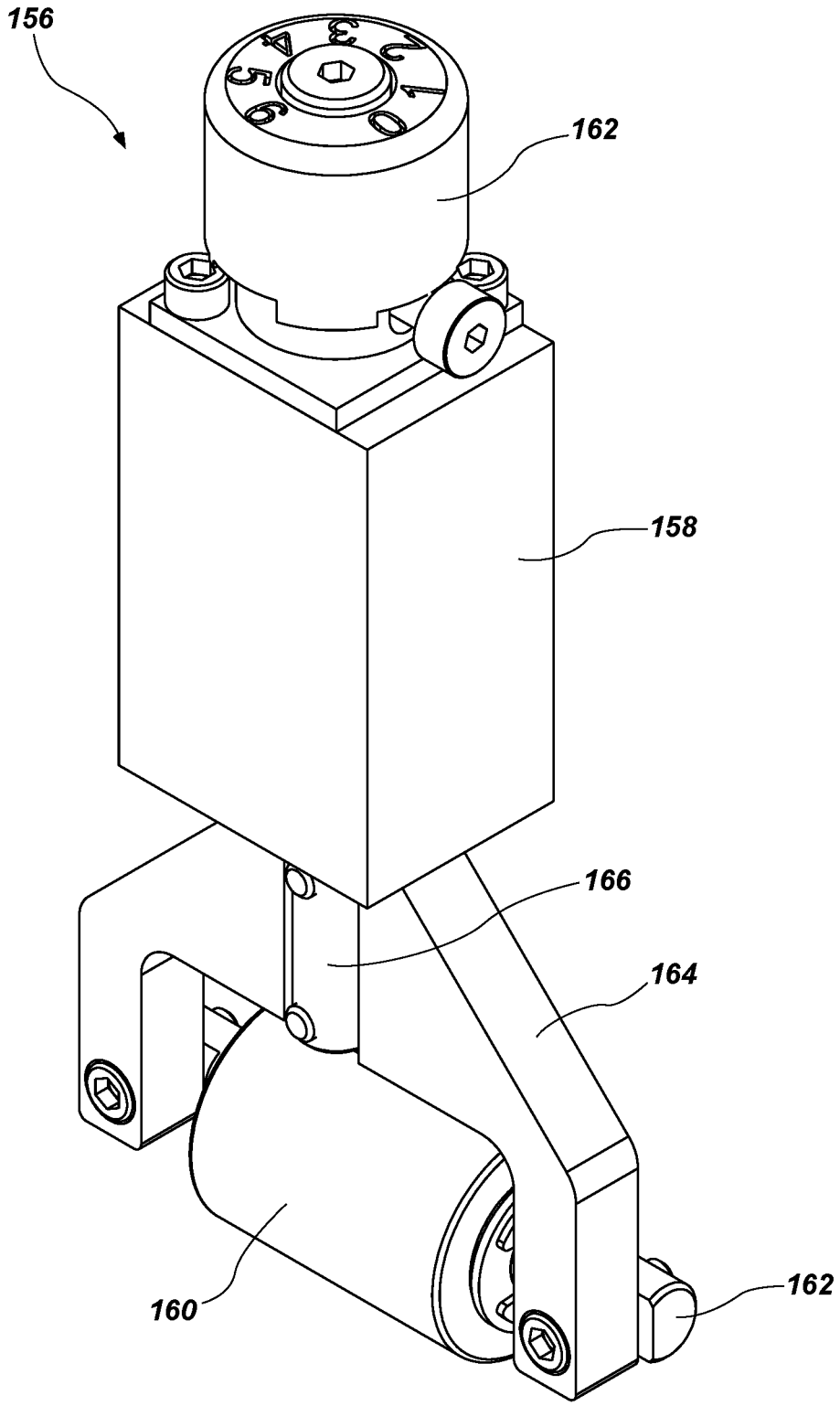
FIG. 11 is a front isometric view of a brake roller assembly of the card shuffler.

Using the adjustable brake roller assembly 156 shown in FIGS. 11 and 12, the card shuffler 100 may be adapted for use with cards of different thicknesses. Cards may be driven through the card gap between the pick-off roller 128C and the brake roller 160 of the brake roller assembly 156, and the brake roller 160 may be moved relative to the bracket 158 of the brake roller assembly 156 to selectively adjust the card gap between the brake roller 160 and the pick-off roller 128C by selectively rotating the dial 162. The dial 162 may be selectively rotated until the card gap is sized to allow a single card to pass through the card gap, but to prevent two or more cards from passing together through the card gap at the same time. In this matter, the brake roller 160 sequentially breaks single cards away from the stack of cards on the card support 124 of the card input mechanism 120, one card at a time.

Figure 13:
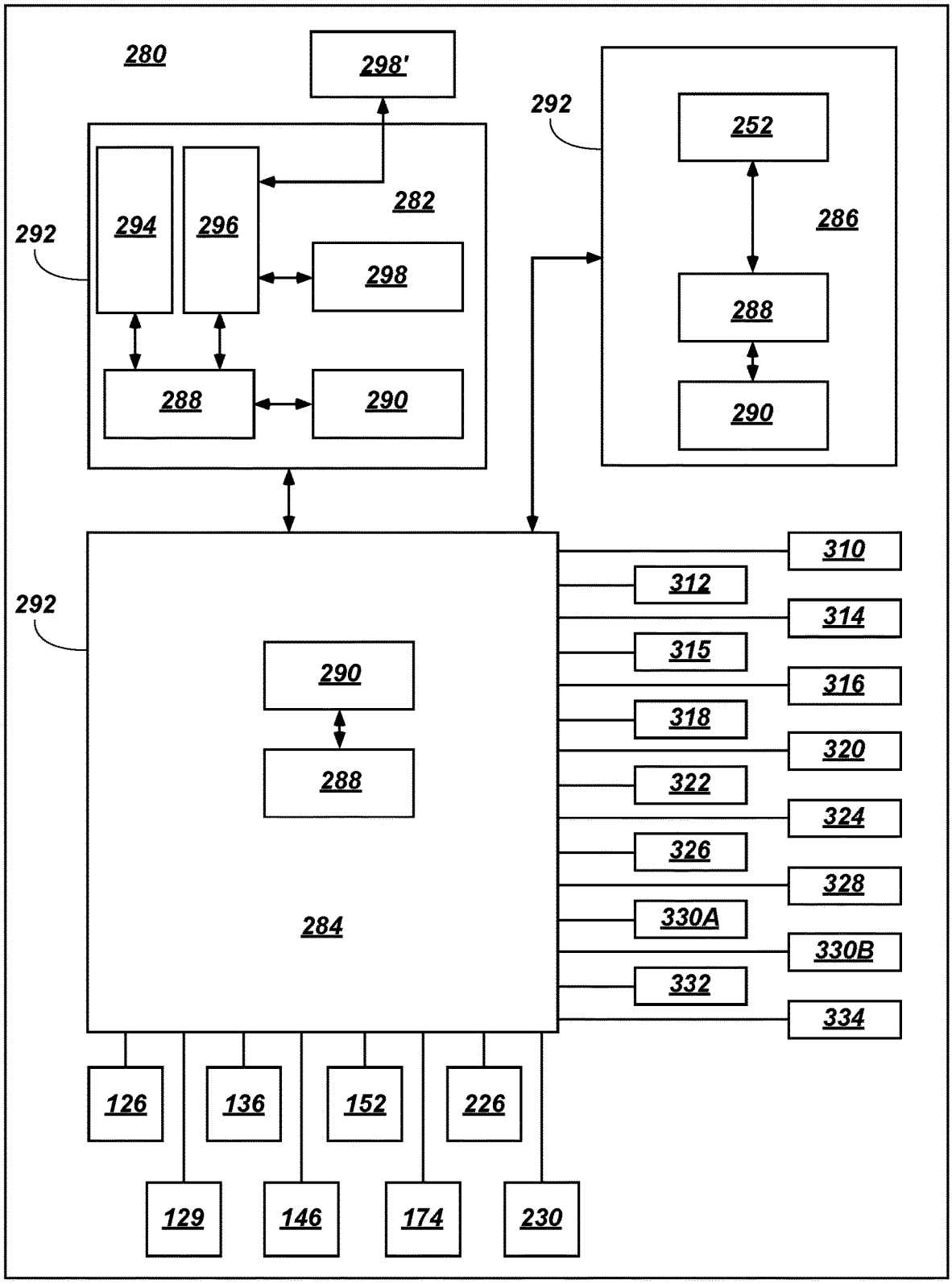
FIG. 13 is a block diagram illustrating various components of a control system of the card shuffler.

Referring to FIG. 13, the card shuffler 100 may comprise a control system 280 for controlling operation of the various active components of the card shuffler 100, for receiving data input from a user of the card shuffler 100, and for outputting data and/or information to a user of the card shuffler 100. FIG. 13 illustrates a non-limiting example embodiment of a control system 280 that may be used for controlling the card shuffler 100. The control system 280 may include one or more control modules for performing different functions of the control system 280, which control modules may be operatively coupled together. For example, the control system 280 may include a main control module 282, a motor/sensor control module 284, and an imaging control module 286. As shown in FIG. 13, the main control module 282 may be configured to communicate electrically with (i.e., send electronic signals to, and/or receive electronic signals from) each of the motor/sensor control module 284 and the imaging control module 286. The communication between modules 282, 284, and 286 may be either direct or indirect. For example, one or more wires or other electrical communication pathways may extend between the main control module 282 and each of the motor/sensor control module 284 and the imaging control module 286. In some embodiments, the imaging control module 286 may be configured to communicate electrically with the motor/sensor control module 284, either indirectly through the main control module 282 or directly by way of one or more wires or other electrical communication pathways that extend directly between the imaging control module 286 and the motor/sensor control module 284.

Each of the main control module 282, the motor/sensor control module 284, and the imaging control module 286 may include one or more electronic signal processors 288 for processing electronic signals, and one or more memory devices 290 (e.g., random access memory (RAM), read-only memory (ROM), Flash memory, etc.) for storing electronic data therein. Each of the main control module 282, the motor/sensor control module 284, and the imaging control module 286 may comprise a printed circuit board 292, to which the electronic signal processors 288 and memory devices 290 may be respectively coupled.

Figure 6:
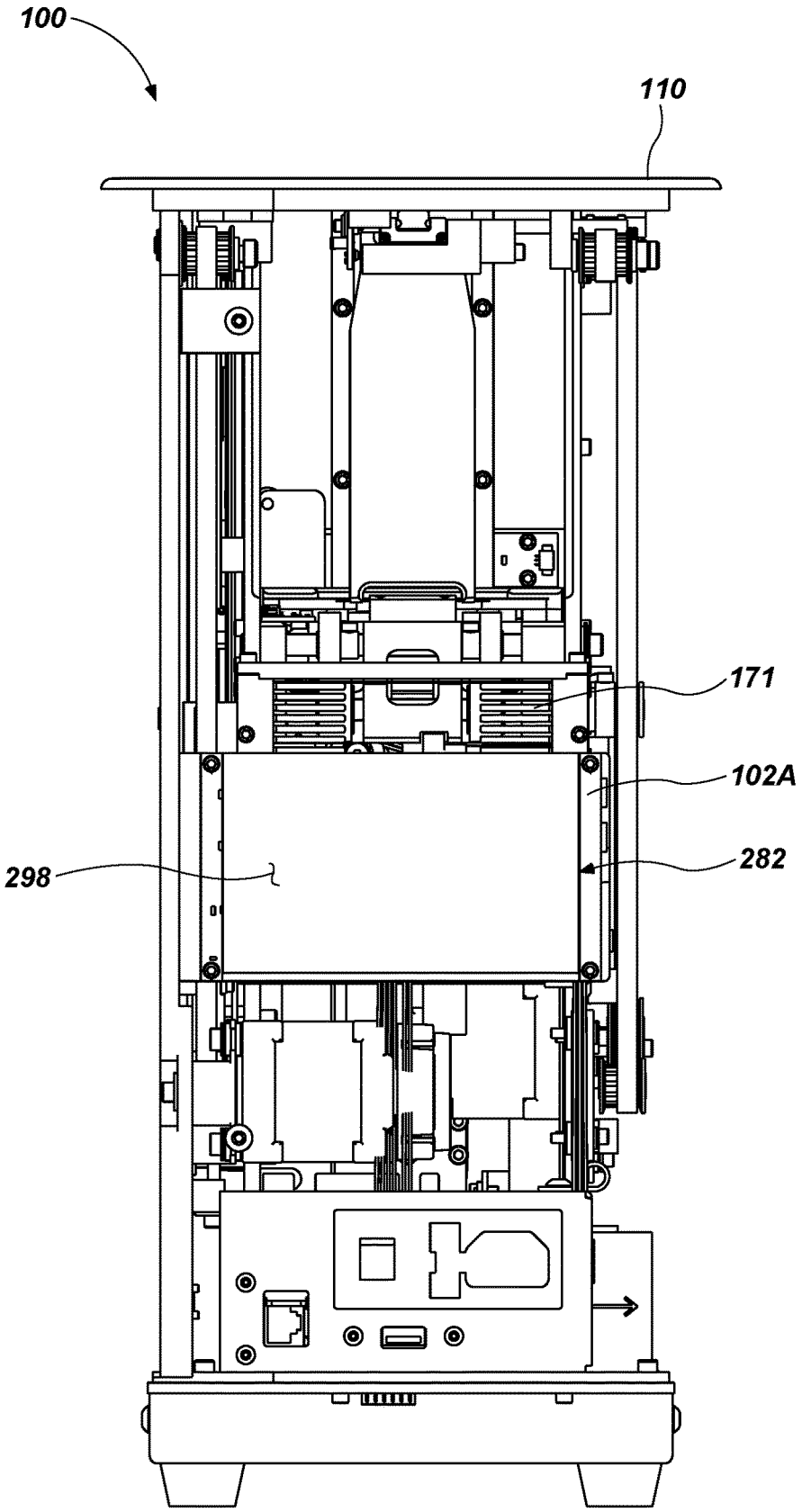
FIG. 6 is a fourth side elevational view of a back side of the card shuffler with the outer cover removed.
Figure 7:
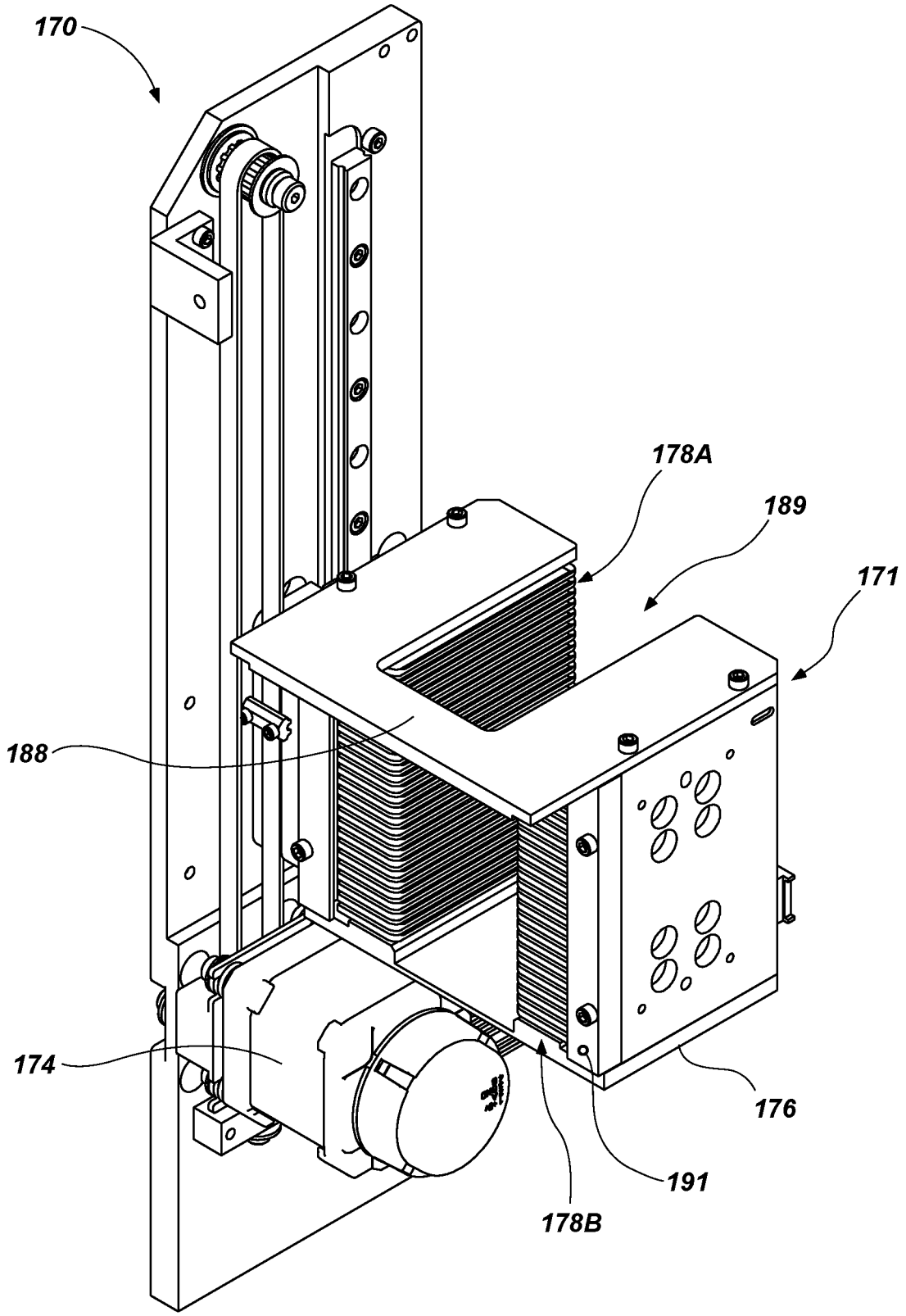
FIG. 7 is an isometric view of a rack of the card shuffler that includes multiple card storage compartments and an associated mechanism for vertically moving the rack up and down within the card shuffler.

The main control module 282, the motor/sensor control module 284, and the imaging control module 286 may be mounted within the card shuffler 100. In some embodiments, the main control module 282, the motor/sensor control module 284, and the imaging control module 286 may be mounted at different locations within the card shuffler 100. For example, as shown in FIG. 6, the main control module 282 may be mounted to a side member 102A of the frame 102. The motor/sensor control module 284 may be mounted to a lower base member 204B (FIG. 4) of the frame 102 (although the motor/sensor control module 284 is not visible in FIG. 4), and the imaging control module 286 may be mounted to another side member 204C (FIG. 5) of the frame 102 (although the imaging control module 286 is not visible in FIG. 5). In some embodiments, the image sensor 252 of the card imaging system 250 may be mounted directly to the printed circuit board 292 of the imaging control module 286, and the imaging control module 286 may be mounted within the card shuffler 100 at a location at which the image sensor 252, while mounted to the printed circuit board 292, may capture images of cards as the cards pass through the card input mechanism 120 between the pick-off rollers 128A-128C and the speed-up rollers 134A-134D, as previously described.

With continued reference to FIG. 13, the main control module 282 may include a data input device 294 configured to allow a user to input data into the control system 280, and a data output device 296 configured to display information to a user. In some embodiments, the data input device 294 and the data output device 296 may comprise a single, unitary device, such as a touch-screen display that can be used both to display information to a user, and to receive input from a user. In some embodiments, the control system 280 may include a first control panel 298 located within the interior of the automatic card shuffler 100 such that the first control panel 298 is inaccessible to a user of the automatic card shuffler 100 from outside the automatic card shuffler 100, and a second control panel 298' located at least partially outside the automatic card shuffler 100 such that the second control panel 298' is accessible to a user of the automatic card shuffler 100 from outside the automatic card shuffler 100. The first and second control panels 298, 298' each may comprise touch-screen displays, which may be operatively coupled with the main control module 282. In some embodiments, the first and second control panels 298, 298' may be mirrored with one another, such that what is displayed on one is exactly the same as what is displayed on the other, and such that the card shuffler 100 may be controlled by inputting data into either of the control panels 298, 298'. In other embodiments, the control panel 298 may comprise a primary host control panel, and the control panel 298' may comprise a secondary control panel. In such embodiments, depending on a selectable operational mode of the card shuffler 100, either the primary host control panel 298 or the secondary control panel 298' may be used. When the secondary control panel 298' is being used, the user interface to be displayed on the secondary control panel 298' may be forwarded to the secondary control panel 298' from the host primary control panel 298. When the secondary control panel 298' is being used, the first control panel 298 may display a message indicating that the secondary control panel 298' is being used. Input received from the secondary control panel 298' may be forwarded to the host primary control panel 298.

The first control panel 298 may not be visible or otherwise accessible to a user of the card shuffler 100 during normal operation, and the second control panel 298' may be located outside the card shuffler 100 such that the second control panel 298' is visible and accessible to a user of the card shuffler 100 during normal operation of the card shuffler 100.

In some embodiments, the second control panel 298' may comprise a modular display unit that may be mounted to a surface of a gaming table at a location separate from the main console of the card shuffler 100 (shown in FIGS. 1 through 6), which comprises the card input mechanism 120, the card storage device 170, and the card output mechanism 220, and may be operatively coupled with the main control module 282 of the control system 280 using a wired or wireless connection. As previously mentioned, the main console of the card shuffler 100 may be configured to be mounted to a playing card table such that the upper surface 110 of the card shuffler 100 is flush with the surface of the playing card table. As shown in FIG. 1, the main console is substantially flat in one embodiment. The second control panel 298' also may be configured to be flush-mounted to the surface of the playing card table at a location separated by a distance from the location at which the main console of the card shuffler 100 is to be mounted. In other embodiments, the second control panel 298' may be mounted above the surface of the playing card table.

The first control panel 298 may be mounted directly to the printed circuit board 292 of the main control module 282 in some embodiments. The first control panel 298 may be adapted and used for installation, initial set-up, and maintenance of the card shuffler 100, while the second control panel 298' may be adapted and used for controlling operation of the card shuffler 100 during normal use of the card shuffler 100 for shuffling, sorting, and verification of cards. The input device 294 may be used for maintenance, upgrades and repairs when the input device 294 is located in a position spaced apart from the shuffler 100.

In other embodiments, however, the card shuffler 100 may include a single data input device 294 and a single data output device 296, such as a single control panel 298 comprising a touch-screen display, which may be located anywhere on the card shuffler 100 (e.g., on the inside or the outside of the card shuffler 100) or remote from the card shuffler 100.

The main control module 282 may include one or more computer programs stored electronically in the memory device or devices 290 thereof, which computer programs may be configured to control operation of the various active components of the card shuffler 100.

The motor/sensor control module 284 may be configured to control operation of the various motors within the card shuffler 100, and to receive signals from various sensors within the card shuffler 100. The various sensors of the card shuffler 100 may be used by the control system 280 to identify current operational states of the various active components of the card shuffler 100, such as locations of the movable components of the card shuffler 100.

For example, each of the motor 126 for the input elevator 122, the motor 129 for the pick-off rollers 128A-128C, the motor 136 for the speed-up rollers 134A-134D, the motor 146 for the card packer 144, the card weight motor 152 for the card weight device 154 (FIG. 5), the motor 174 for the rack 171, the motor 226 for the output elevator 222, and the motor 230 for the ejector 228 may be electrically coupled with the motor/sensor control module 284 to allow the motor/sensor control module 284 to independently, selectively activate and deactivate the motors as needed to control operation of the card shuffler 100.

The card shuffler 100 may include a number of sensors, which also may be operatively coupled with the motor/sensor control module 284. By way of example and not limitation, the card shuffler 100 may include a card sensor 310 configured to detect the presence of one or more cards on the card support 124 of the card input mechanism 120, a first input elevator sensor 312 located and configured to detect when the input elevator 122 is in the uppermost position, and a second input elevator sensor 314 located and configured to detect when the input elevator 122 is in the lowermost position. A card weight sensor 315 may be located and configured to detect whether the card weight device 154 is in the activated and/or deactivated position. A card sensor 316 may be located and configured to detect the presence of a card as the card moves off the card support 124 responsive to actuation of the pick-off rollers 128A-128C. The card sensor 316 may be activated by the leading edge of the card substantially immediately as the card begins to move off from the card support 124.

A sensor 318 (or sensors) may be located and configured to detect when a card moving responsive to actuation of the pick-off rollers 128A-128C approaches the speed-up rollers 134A-134D. The sensor 318 may be located and configured such that the sensor 318 may be triggered by a moving card prior to the leading edge of the moving card engaging the speed-up rollers 134A-134D. In some embodiments, the sensor 318 may be used to trigger activation of the image sensor 252 of the card imaging system 250 to acquire one or more images of the card. Optionally, the sensor 318 may be used by the motor/sensor control module 284 to momentarily deactivate movement of the pick-off rollers 128A-128C while the image sensor 252 of the card imaging system 250 acquires one or more images of the card, after which the motor/sensor control module 284 may reactivate movement of the pick-off rollers 128A-128C to cause the card to be engaged by the speed-up rollers 134A-134D and inserted into the card storage device 170. The sensor 318 may comprise a photoactive sensor that includes an emitter for emitting radiation toward any card present proximate the sensor 318, and one or more receivers for receiving radiation emitted by the emitter and reflected from a surface of a card. In some embodiments, the photoactive sensor may include two radiation receivers oriented at different locations along the direction of movement of the cards, such that the photoactive sensor may determine a direction of movement of any card moving proximate the sensor 318 by detecting which of the two radiation receivers receives reflected radiation first as a card moves past the sensor 318.

A sensor 320 may be located and configured to detect when a card moving responsive to activation of the speed-up rollers 134A-134D passes by the speed-up rollers 134A-134D and begins to enter the card storage device 170. In some embodiments, the sensor 320 may comprise a photoactive sensor that includes one or more emitters for emitting radiation toward any card present proximate the sensor 320, and two or more receivers for receiving radiation emitted by the emitter and reflected from a surface of a card. The two or more radiation receivers may be oriented at different locations along the direction of movement of the cards, such that the photoactive sensor may determine a direction of movement of any card moving proximate the sensor 320 by detecting which of the two radiation receivers receives reflected radiation first as a card moves past the sensor 320. Thus, the sensor 320 may be capable of detecting the presence of a card proximate the sensor 320, and capable of detecting whether the card is moving into the card storage device 170 or out from the card storage device 170. The speed-up rollers 134A-134D may be capable of pushing a card toward and into the card storage device 170, and capable of pulling a card back away from the card storage device 170. For example, in the case of a card jam wherein a card being inserted into the card storage device 170 is not actually inserted into the card storage device 170 as intended, the direction of rotation of the speed-up rollers 134A-134D may be reversed to withdraw the card from the card storage device 170, after which the position of the card storage device 170 may be adjusted and the speed-up rollers 134A-134D activated to again attempt to insert the card into the card storage device 170. If the card cannot be inserted into the card storage device 170 upon a predetermined number of attempts, the card may be inserted into an overflow card storage compartment. If the attempt to insert the card into the overflow card storage compartment is not successful, operation of the card shuffler 100 may be interrupted and an error message provided to a user via the data output device 296 of the control system 280. When the card shuffler is configured to accept two cards per compartment, card jams may be more likely to occur when inserting the second card into the same compartment.

The card shuffler 100 may further include one or more packer sensors 322 located and configured to sense a position of the card packer 144. For example, a packer sensor 322 may be located and configured to sense when the card packer 144 is in the retracted position. One or more rack sensors 324 may be located and configured to sense a vertical position of the rack 171. For example, a rack sensor 324 may be located and configured to sense when the rack 171 is in the lowermost position. The card shuffler 100 may further include one or more ejector sensors 326. For example, the card shuffler 100 may include an ejector out sensor 326 located and configured to sense when the ejector 228 is disposed in the first position on the lateral side of the rack 171 proximate the card support 224, and an ejector in sensor 326 located and configured to sense when the ejector 228 is disposed in the second position on an opposing lateral side of the rack 171 remote from the card support 224.

The card shuffler 100 may include a card sensor 328 located and configured to detect the presence of one or more cards on the card support 224 of the card output mechanism 220, a first output elevator sensor 330A located and configured to detect when the output elevator 222 is in the lowermost position, and a second output elevator sensor 330B located and configured to detect when the output elevator 222 is in the uppermost position. The card shuffler 100 may include a lid sensor 332 located and configured to detect when the lid 112 is in the closed position, as shown in FIG. 1. As previously discussed with reference to FIGS. 9 and 10, the card shuffler 100 may include a card size sensor 334 located and configured to detect when the card size adjustment member 190 is in the first orientation (shown in FIG. 9) or the second orientation (FIG. 10) relative to the rack 171.

The card shuffler 100 may be used to shuffle cards, to sort cards, and/or to verify cards or sets of cards.

For example, the card shuffler 100 may be used to perform a shuffling operation on a stack of cards, as described below with reference to FIGS. 14A through 14H and FIG. 15. The card shuffler 100 may be placed in a shuffling mode using the data input device 294 of the control system 280. If the input elevator 122 and the output elevator 222 are not in the raised uppermost positions and the lid 112 open (as shown in FIG. 2), a start button 299 (FIGS. 1 and 2) on the upper surface 110 of the card shuffler 100 may be pressed to cause the input elevator 122 and the output elevator 222 to raise to uppermost positions and raise the lid 112.

Figure 14A:
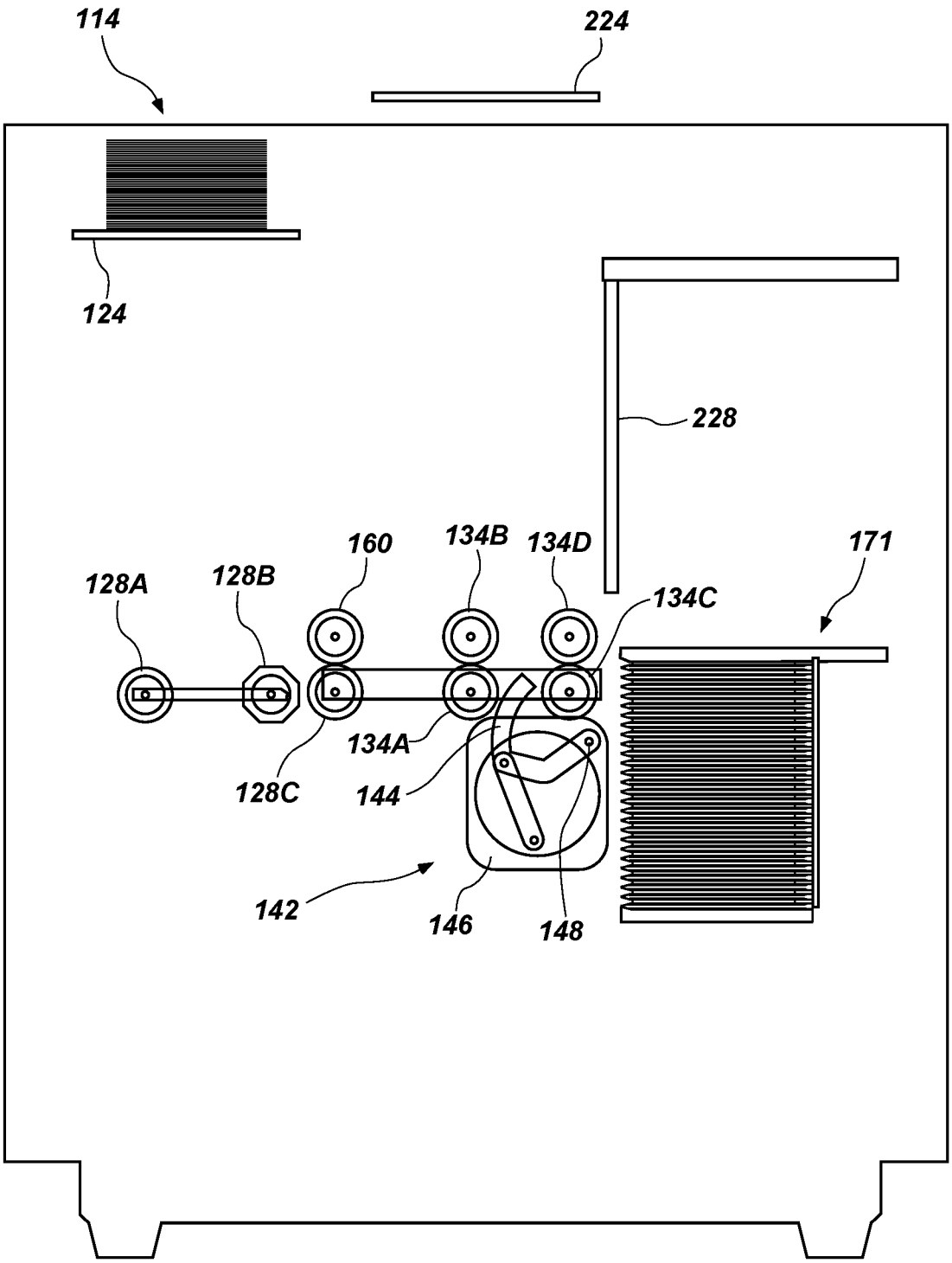
FIGS. 14A-14H are simplified and schematically illustrated cross-sectional views taken through the card shuffler apparatus along a plane parallel to the left and right sides of the automatic card shuffler (and perpendicular to the front and back sides of the automatic card shuffler), wherein various components and features of the card shuffler have been removed to facilitate illustration and description of operation of the card shuffler.
Figure 14B:
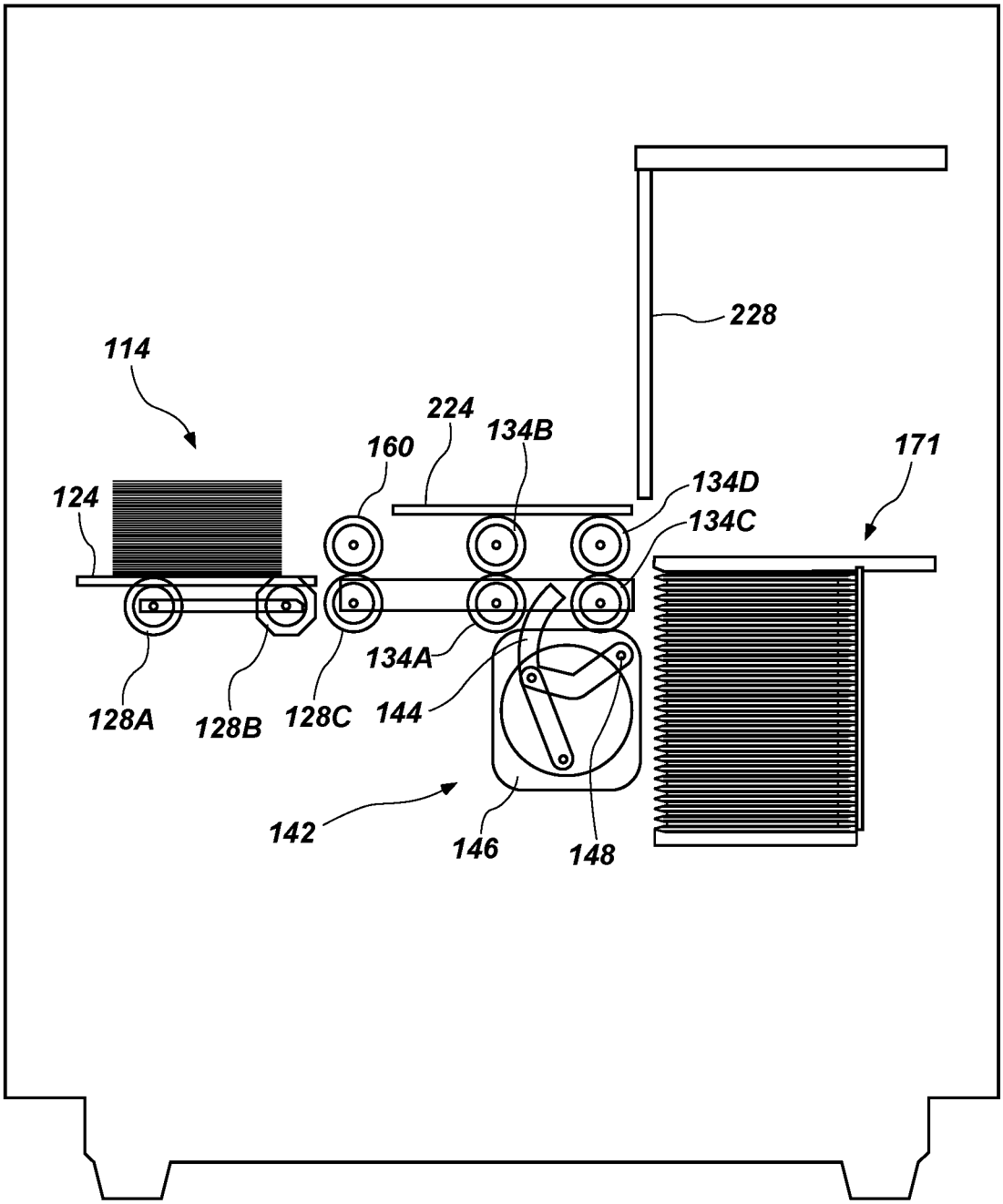
Figure 14C:
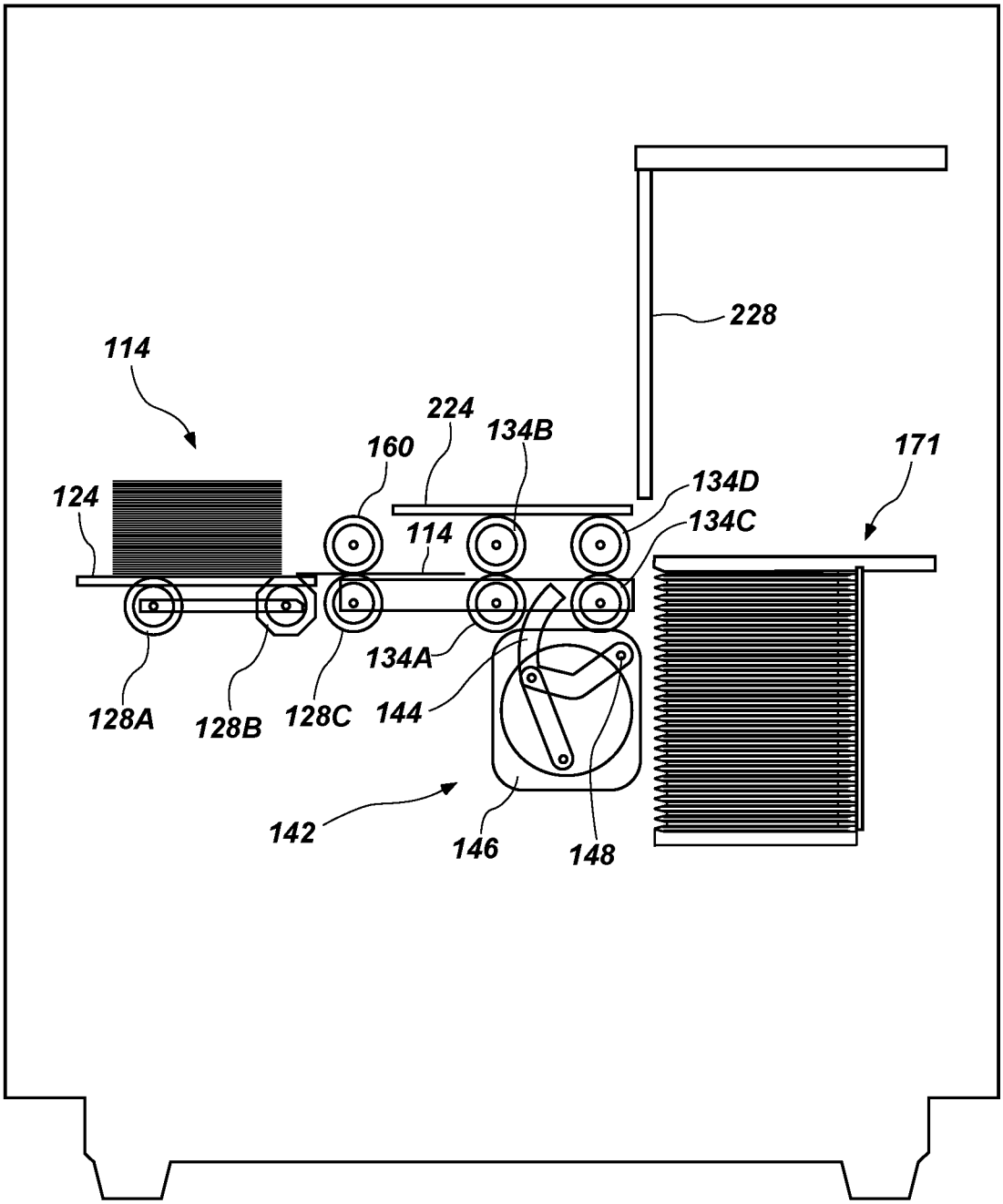
Figure 15:
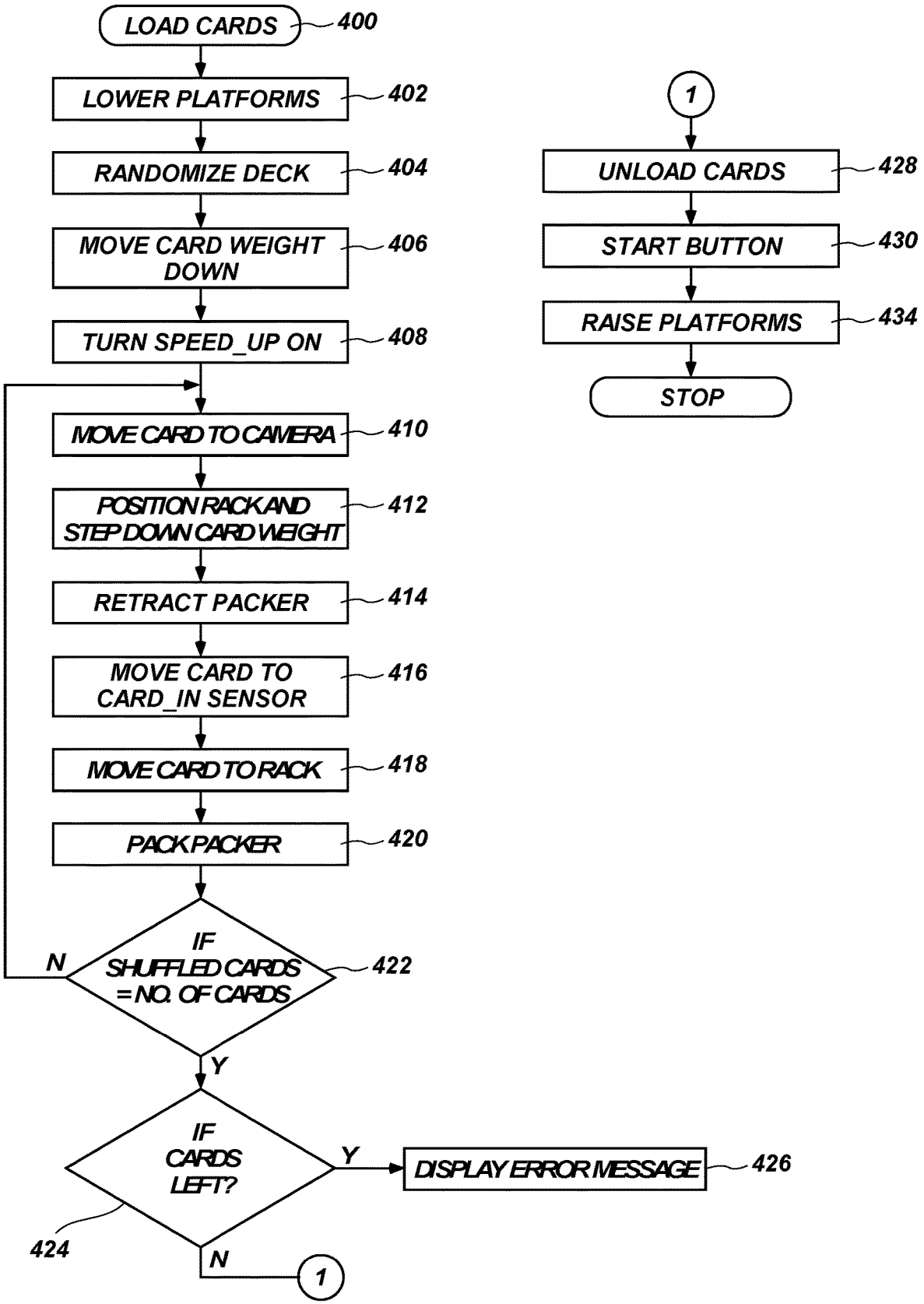
FIG. 15 is a flowchart illustrating operation of the card shuffler during a shuffling operation.

Referring to FIG. 14A, a stack of cards 114 such as a standard 52-card deck, for example may be placed by a user on the card support 124 of the input elevator 122, as represented in action 400 in FIG. 15. In some embodiments, the control system 280 may be configured such that, upon detecting the presence of cards 114 on the card support 124 of the input elevator 122 using the card sensor 310 and the absence of cards on the card support 224 of the output elevator 222 using the card sensor 328 for a predetermined amount of time (e.g., five seconds), the control system 280 may automatically commence a shuffling operation by lowering the input elevator 122 and the output elevator 222 to the lowermost positions and automatically closing the lid 112, as shown in FIG. 14B and represented as action 402 in FIG. 15. In some embodiments, the shuffling operation may be initiated responsive to a user input on the card shuffler itself and/or a remote device.

As previously mentioned, the card shuffler 100 may be configured for use in shuffling single fifty-two (52) card decks of standard playing cards, which may optionally include one or more additional cards, such as one or two Jokers, for example, for a total of fifty-four (54) cards to be shuffled. In a configuration suitable for shuffling a standard 52-card deck, the rack 171 may include exactly twenty-seven (27) card storage compartments 172 (FIGS. 7 through 10), twenty-six of which may be sized and configured to hold two or less (but no more than two in some embodiments) cards therein at any given time, plus one spare compartment reserved for receiving a card that was unsuccessfully inserted into a different compartment. Thus, the rack 171 may include fifty-three (53) card storage positions, wherein an upper position and a lower position are designated within each card storage compartment 172 and only one centrally located position is located in the spare compartment. In some embodiments, more than one additional shelves are provided to create a location to load cards that cannot be loaded into a designated compartment. Because each card storage compartment 172 may include zero, one, or two cards therein at any given time, the upper and lower positions within each card storage compartment 172 are virtual positions until one card has been inserted into each card storage compartments 172 by the card input mechanism 120, at which time a next card is positioned in either a lower position in each card storage compartment 172 or in an upper position in each card storage compartment 172.

In other embodiments where a 53-card (with one Joker) or a 54-card deck (with two Jokers) is being randomized, it might be desirable to provide 28 or 29 compartments rather than 27. When 53 or 54 cards are being randomized, 27 compartments are needed to provide 53 or 54 delivery positions and at least one additional compartment is needed to receive a card that failed to feed into one of the other 27 compartments.

To shuffle cards or "randomize" the deck, as indicated at action 404 in FIG. 15, the control system 280 of the card shuffler 100 creates a table that randomly assigns and correlates the cards in the stack to one of the fifty two (52) card storage positions in the rack 171. The control system 280 sequentially numbers the cards from the bottom card in the stack of cards 114 toward the top of the stack of cards 114 by sequentially assigning an integer to each card. The control system 280 also sequentially numbers the card storage positions in the rack 171. For example, the top card storage position in the rack 171 may be designated as card storage position "0," and the bottom card storage position in the rack 171 by be designated as card storage position "51," and the card storage positions therebetween may be sequentially numbered. A portion of the positions may be assigned to an upper portion of a compartment and another portion may be assigned to a lower portion. In one embodiment, between 27 and 29 compartments are needed to put a deck of between 52 and 54 cards in a desired order (random or pre-determined). Typically one, and in other embodiments two, extra compartments are provided to accept cards that cannot be delivered to the assigned compartment due to card jams, warped cards, damaged cards, etc.

Thus, the control system 280 may utilize a random number generator in the form of a hardware component or a software component to randomly assign and correlate cards in the stack of cards 114 resting on the card support 124 of the card input elevator 122 to card storage positions in the rack 171. For example, the control system 280 may include a random number generator, which may be used to randomly assign and correlate 54 cards in the stack of cards 114 resting on card support 124 to the card storage positions in the rack 171. The control system 280 may generate a Card Position Table, such as Table 1 below, which includes randomly assigned card storage positions for each sequential card in the stack of cards 114 on the card support 124 of the card input elevator 122. The Card Position Table may be stored in a memory device 290 of the control system 280 (FIG. 13). In the following table, 54 cards are delivered to a total of 27 compartments, and there are no unused compartments for receiving a card that previously failed to insert into a selected position in a compartment.

TABLE 1

| Card Position Table | |
|---|---|
| Card | Position |
| 0 | 44 |
| 1 | 21 |
| 2 | 37 |
| 3 | 2 |
| 4 | 19 |
| 5 | 45 |
| 6 | 52 |
| 7 | 36 |
| 8 | 28 |
| 9 | 6 |
| . | . |
| . | . |

TABLE 1-continued

| Card Position Table | |
|---|---|
| Card | Position |
| . | . |
| 48 | 53 |
| 49 | 20 |
| 50 | 39 |
| 51 | 35 |
| 52 | 27 |
| 53 | 48 |

As shown in this example, cards are randomized based on a reassignment of card order based on the original card order, not based on card rank and or suit values. In one embodiment, the shuffler does not utilize its card recognition capabilities to randomize an order of cards. In other embodiments, the card recognition system recognizes an original order, and the random number generator determines a final order based on a randomized original order of rank and suit information. After randomizing the deck by randomly assigning the fifty four (54) card storage positions to the cards in the stack of cards 114 on the card support 124 of the card input elevator 122, the card shuffler 100 may move a card weight (not shown) down onto the stack of cards 114 to apply a downward force on the stack of cards 114, as indicated at action 406 in FIG. 15. The card shuffler 100 then may actuate rotation of the speed-up rollers 134A-134D, as indicated at action 408 in FIG. 15. The card shuffler 100 then may employ the card input mechanism 120 to sequentially move the cards in the stack of cards 114 resting on the card support 124 into randomly selected card storage positions within the rack 171 of the card storage device 170.

The control system 280 may selectively control movement of the various components of the card input mechanism 120 and the card storage device 170 to cause the cards in the stack of cards 114 to be inserted into the rack 171 and positioned in their randomly assigned card storage positions. To accomplish insertion of the cards into the rack 171, the rack 171 is moved up and down in the vertical direction to a proper position relative to the speed-up rollers 134A-134D (which are disposed at a fixed, static location within the card shuffler 100) for insertion of each card into the appropriate card storage compartment 172 and into its assigned card storage position. If the card being inserted into the compartment is the first card inserted, the card feeder is aligned to register with the center of the compartment. If the card is the second card being fed into a compartment already containing a card, then the card feeder is aligned with tapered surface 184A or 184B, depending upon whether the second card is inserted below or above the first card inserted.

When a card is inserted into a card storage compartment 172 in the rack 171, there are two states that may exist. The first possible state is the state wherein no other card is present in the respective card storage compartment 172, and the second possible state is the state wherein one card is already present in the respective card storage compartment 172. The control system 280 may include to a First Rack Position Table and a Second Rack Position Table, each of which may be stored in the memory device 290 of the control system 280. The First Rack Position Table may include the positions at which the rack 171 is to be located for insertion of a card centrally into a card storage compartment 172 when there is no card already present in the respective card storage compartment 172. In an alternate embodiment, where there is no card in the compartment (the first state), the rack 171 may have one or more default alignments—to align and register with the center space of the compartment or to align with the tapered lower surface 184B of the upper rib 180 or with the tapered upper surface 184A of the lower rib 181. Selection between these alignments can be used to, for example, minimize rack vertical translation distances during the process. Center alignment can be adopted as the preferred first state alignment. The Second Rack Position Table may include the positions at which the rack 171 is to be located for insertion of a card into a card storage compartment 172 where there is already a card present in the respective card storage compartment 172. Thus, the First Rack Position Table correlates appropriate rack locations to each of the twenty-seven (27) card storage compartments 172, and the Second Rack Position Table correlates appropriate rack locations to each of the fifty four (54) card storage positions in the rack 171. An example First Rack Position Table is shown in Table 2 below, and an example Second Rack Position Table is shown in Table 3 below.

TABLE 2

1st Rack Position Table

| Compartment | Rack Location |
|---|---|
| 0 | 0.125 |
| 1 | 0.250 |
| 2 | 0.375 |
| 3 | 0.500 |
| 4 | 0.625 |
| . | . |
| . | . |
| . | . |
| 24 | 3.125 |
| 25 | 3.250 |
| 26 | 3.375 |

TABLE 3

2nd Rack Position Table

| Position | Rack Location |
|---|---|
| 0 | 0.085 |
| 1 | 0.165 |
| 2 | 0.210 |
| 3 | 0.290 |
| 4 | 0.335 |
| 5 | 0.415 |
| 6 | 0.460 |
| 7 | 0.540 |
| 8 | 0.585 |
| 9 | 0.665 |
| . | . |
| . | . |
| . | . |
| 48 | 3.085 |
| 49 | 3.165 |
| 50 | 3.210 |
| 51 | 3.290 |
| 52 | 3.335 |
| 53 | 3.415 |

In Tables 2 and 3 above, the number of cards inserted is 54, and the number of compartments in the rack is 26. The locations are given in distance dimensions, wherein the distance is a relative distance from a lower, bottom surface 176 of the rack 171, the location of which may be periodically identified by the control system 280 in a calibration process, as described in further detail subsequently herein. Each position in Table 2 corresponds to a position of a horizontal plane vertically centered within the card storage compartment 172 between the ribs 180, 181 that define the respective card storage compartment 172 therebetween. Each position in Table 3 corresponds to the position of a horizontal plane vertically centered along the respective tapered upper surfaces 184A (for lower positions within card storage compartments 172) or tapered lower surfaces 184B (for upper positions within card storage compartments 172) at the ends 182 of the ribs 180, 181 (See FIG. 8B).

Using the Card Position Table and the First and Second Rack Position Tables, the control system 280 controls operation of the card input mechanism 120 and the card storage device 170 to sequentially position each card into the appropriate card storage compartment 172 (and appropriate upper or lower card storage position therein) so as to randomize the order of the cards in the rack 171. As a particular card is inserted into the rack 171, the control system 280 references the Card Position Table to determine in which of the fifty four (54) card storage positions the card is to be positioned. The control system 280 determines whether there is already a card located in the respective card storage compartment 172 in which the card storage position is located. If there is not a card already present in the card storage compartment 172, the control system 280 references Table 2 to determine where to position the rack 171 such that, when the card is inserted into the rack 171 by the speed-up rollers 134A-134D, the card will be inserted into the center of the card storage compartment 172. If there is a card already present in the card storage compartment 172, the control system 280 references Table 3 to determine where to position the rack 171 such that, when the card is inserted into the rack 171 by the speed-up rollers 134A-134D, the card will be inserted either above or below the card already present in the card storage compartment 172. Thus, after selectively inserting the second card into any given card storage compartment 172 above or below the first card inserted into the card storage compartment 172, the two cards in the card storage compartment 172 will be appropriately positioned in the upper card storage position and the lower card storage position, respectively, in that card storage compartment 172.

FIG. 14C illustrates a first card 114 being driven from the bottommost position in the stack of cards 114 on the card support 124 by the pick-off rollers 128A-128C. As indicated in action 410 of FIG. 15, the control system 280 causes the moving card 114 to be moved to the position at which the card image sensor (an example is a camera) 252 may acquire one or more images of at least a portion of the card 114. As each card 114 moves from the pick-off rollers 128A-128C toward the speed-up rollers 134A-134D, movement of the leading edge of each card 114 over the sensor 318 (FIG. 13) will be detected by the sensor 318. The control system 280, upon detection of the signal generated by the sensor 318, may cause the card imaging system 250 to acquire one or more images of at least a portion of the card 114 using the card image sensor 252. The card imaging system 250 may use the acquired images to identify indicia on the card 114 (e.g., the rank and suit of a standard playing card). Upon moving all cards 114 into the card storage device 170 as described below, the control system 280 may compare the actual identity of each card in the set of cards in the rack 171 (determined using the card imaging system 250) to identities of an expected set of cards, so as to verify that cards that should not be present in the set are not included (e.g., duplicate cards of any particular rank and suit), and that cards that should be present are not absent. Thus, the accuracy and completeness of a set of cards being shuffled by the card shuffler 100 (e.g., a single deck of standard playing cards) may be automatically verified by the control system 280 of the card shuffler 100 with each shuffling operation performed by the card shuffler 100. The card shuffler 100 may be configured to dispense the shuffled cards from the rack 171 only if the verification process determines the accuracy and completeness of the set of cards. In the event the verification process determines that the set of cards is incomplete or otherwise inaccurate, the card shuffler 100 may be configured not to dispense the shuffled cards and to display an error message or other signal to a user using the data output device 296 of the control system 280.

After acquiring one or more images of the card 114, the card 114 may be moved into the rack 171 using the speed-up rollers 134A-134D and the card packer arm 144 of the card packing device 142. As indicated at action 412 in FIG. 15, the control system 280 may move the rack 171 to the appropriate vertical position for insertion of the card 114 into the rack 171, as described above. The control system 280 then may retract the card packer arm 144 of the packing device 142 (as needed) as indicated at action 414 of FIG. 15. The control system 280 then may actuate rotation of the pick-off rollers 128A-128C to cause the card 114 to be gripped by the rotating speed-up rollers 134A-134D, which will move the card 114 toward the card in/card out sensor 320 and into the rack 171, as indicated at actions 416 and 418, respectively, in FIG. 15.

Figure 14D:
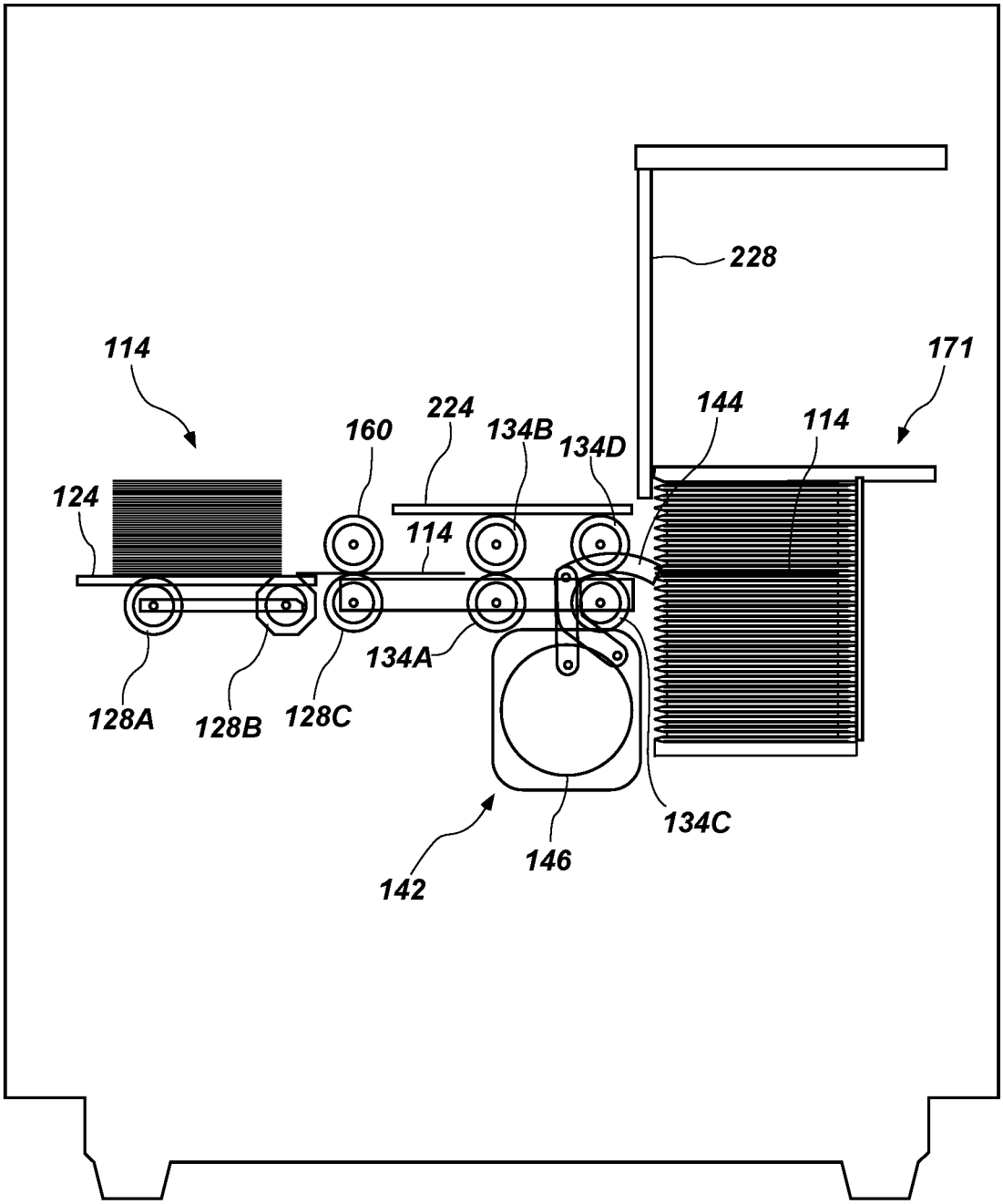
Figure 14E:
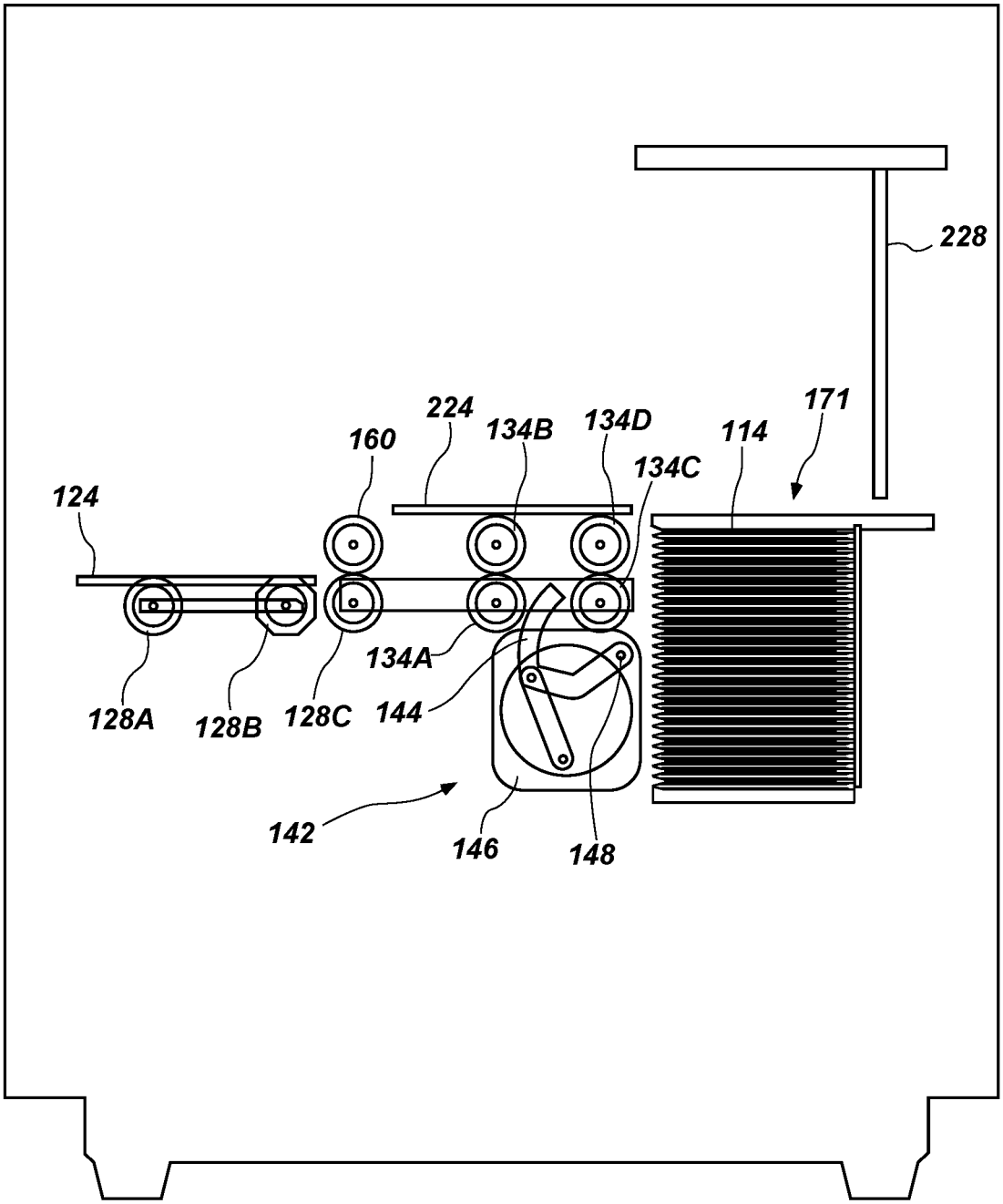

As shown in FIG. 14D, the control system 280 then may actuate the card packer arm 144 of the card packing device 142 using the packer motor 146, as indicated at action 420 in FIG. 15, which ensures that the card 114 is fully inserted within the corresponding card storage compartment 172 in the rack 171, as previously discussed. The control system 280 then determines whether or not the number of cards that have been inserted into the rack 171 corresponds to the initial total number of cards in the stack of cards 114 on the card support 124. If not, the control system 280 repeats actions 410 through 420, as indicated at action 422 in FIG. 15, until all cards 114 have been inserted into the rack 171, as shown in FIG. 14E. If the number of cards 114 that have been inserted into the rack 171 corresponds to the initial total number of cards in the stack of cards 114 on the card support 124, the control system 280 then determines whether any cards 114 unexpectedly remain present on the card support 124 using the card sensor 310 as indicated at action 424. If so, the card shuffler 100 ceases operation and an error message may be displayed on the data output device 296 (FIG. 13), as indicated in action 426 in FIG. 15. If not, the control system 280 unloads the cards 114 from the rack 171 as indicated at action 428 in FIG. 15 and described below.

As previously mentioned, the ejector 228 may be positioned by the control system 280 on the side of the rack 171 adjacent the card support 224 of the output elevator 222 and the speed-up rollers 134A-134D (as shown in FIGS. 14A-14D) during the shuffling operation while the rack 171 moves vertically up and down and cards 114 are inserted into the rack 171 by the card input mechanism 120. Once all cards 114 have been inserted into the rack 171 and the set of cards has been verified for accuracy and completion by the control system 280 using the card imaging system 250, the cards 114 may be ejected out from the rack 171 using the ejector 228. The control system 280 may cause the rack 171 to move vertically downward to the lowermost position to provide clearance to horizontally move the ejector 228 over the rack 171 to a position on a side of the rack 171 opposite the card support 224 of the output elevator 222, as shown in FIG. 14E.

Figure 14F:
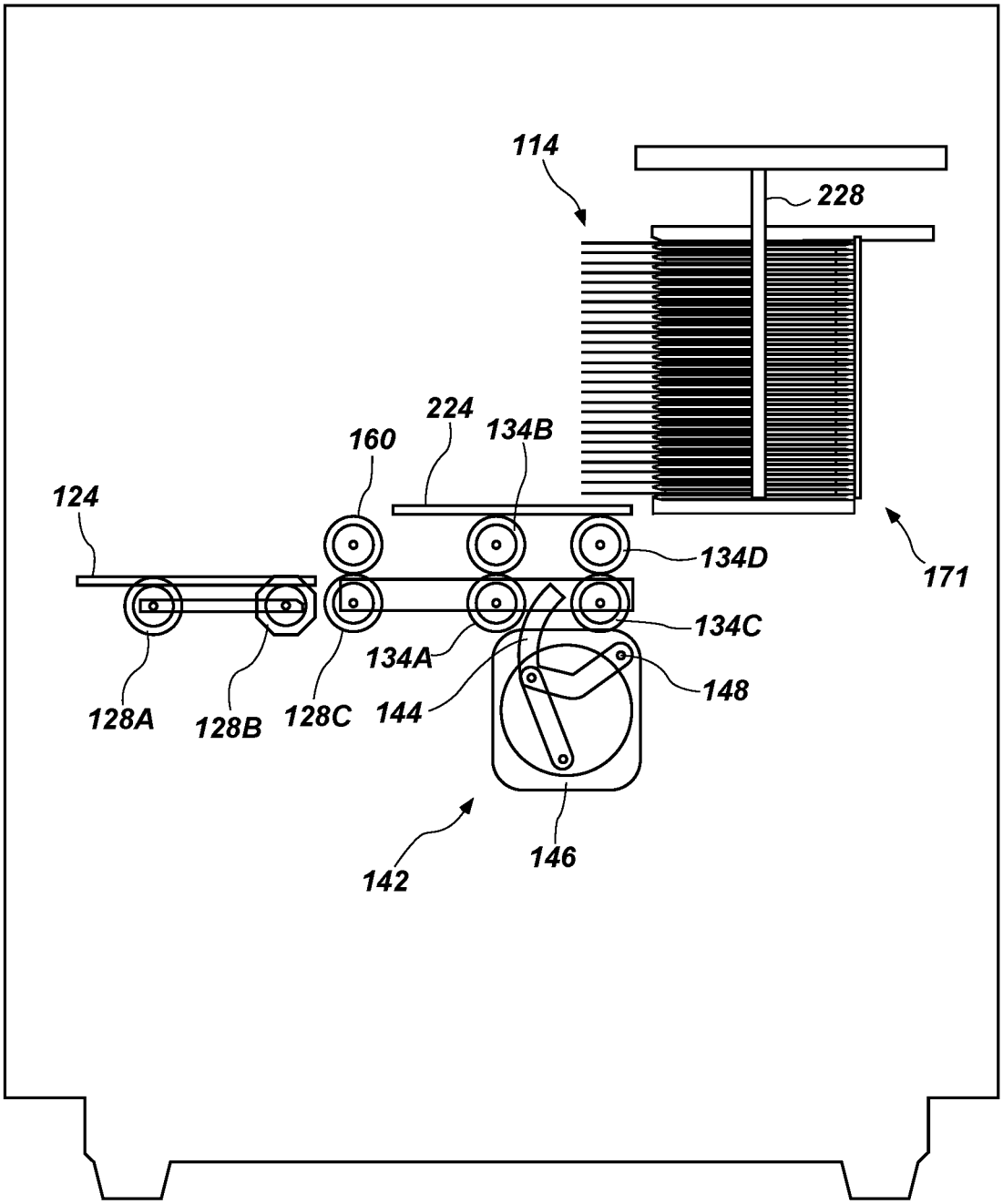
Figure 14G:
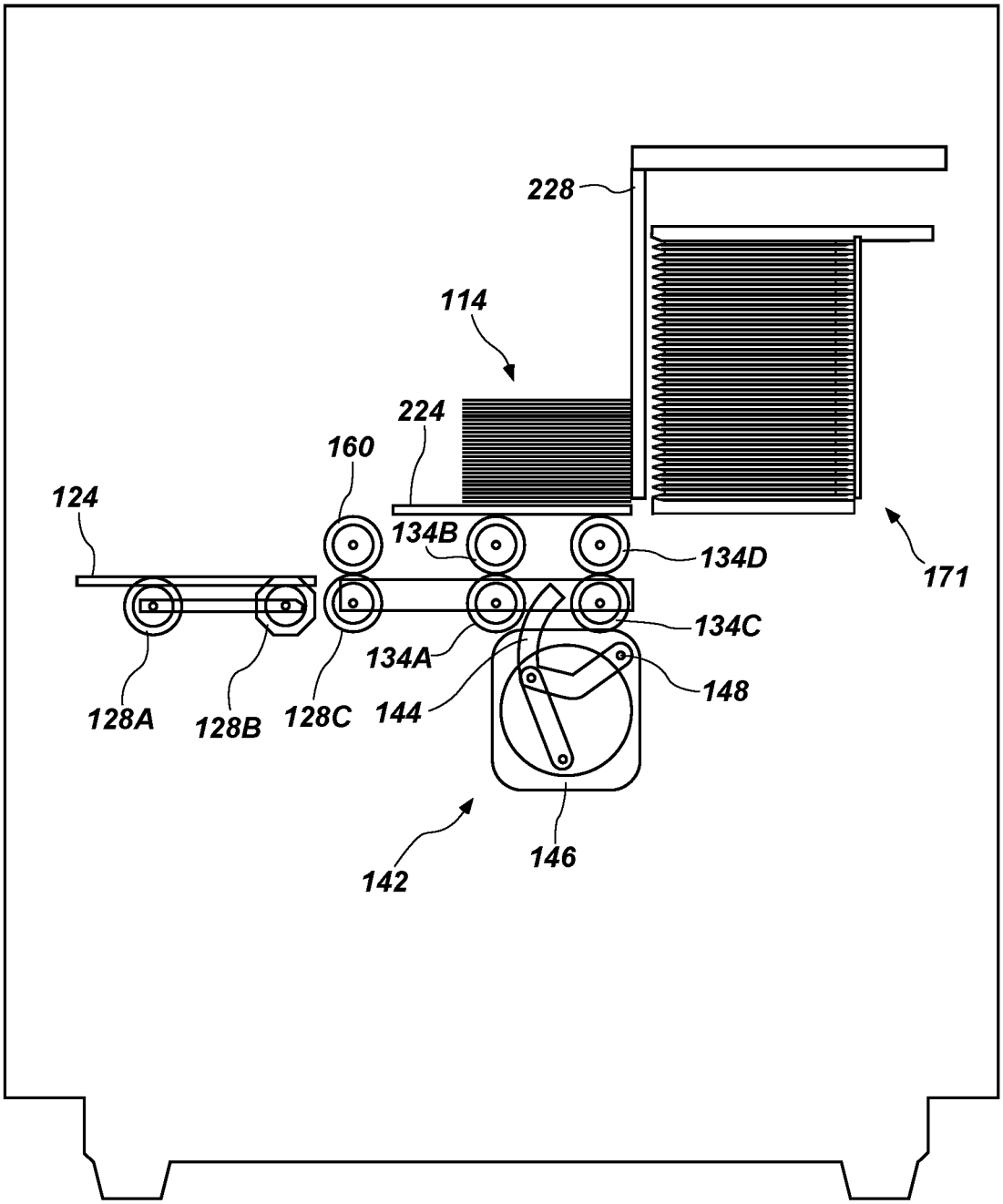

Referring to FIG. 14F, the control system 280 then may cause the rack 171 to move in the vertically upward direction to the uppermost position of the rack 171 while the ejector 228 remains positioned on the side of the rack 171 opposite the card support 224 of the output elevator 222. Upon moving the rack 171 to the uppermost position, the ejector 228 may be disposed laterally adjacent the rack 171 on the side thereof opposite the card support 224. The control system 280 then may cause the ejector 228 to move in the horizontal direction laterally toward the card support 224. As the ejector 228 moves in the horizontal direction toward the card support 224, the ejector 228 abuts against the edges of the cards 114 opposite the card support 224, passes through a central void 189 between the side brackets 178A, 178B (FIG. 7) and pushes the cards 114 out from the card storage compartments 172 and onto the card support 224 of the card output elevator 222 in the form of a stack of shuffled cards 114 (FIG. 14G). The cards may be simultaneously ejected out from the rack 171 together as a batch and onto the card support 224. FIG. 14F illustrates the ejector 228 at a midpoint in the ejection process at which the ejector 228 is disposed within the rack 171 and the cards 114 are partially ejected out from their respective card storage compartments 172 in the rack 171 by the ejector 228.

Figure 14H:
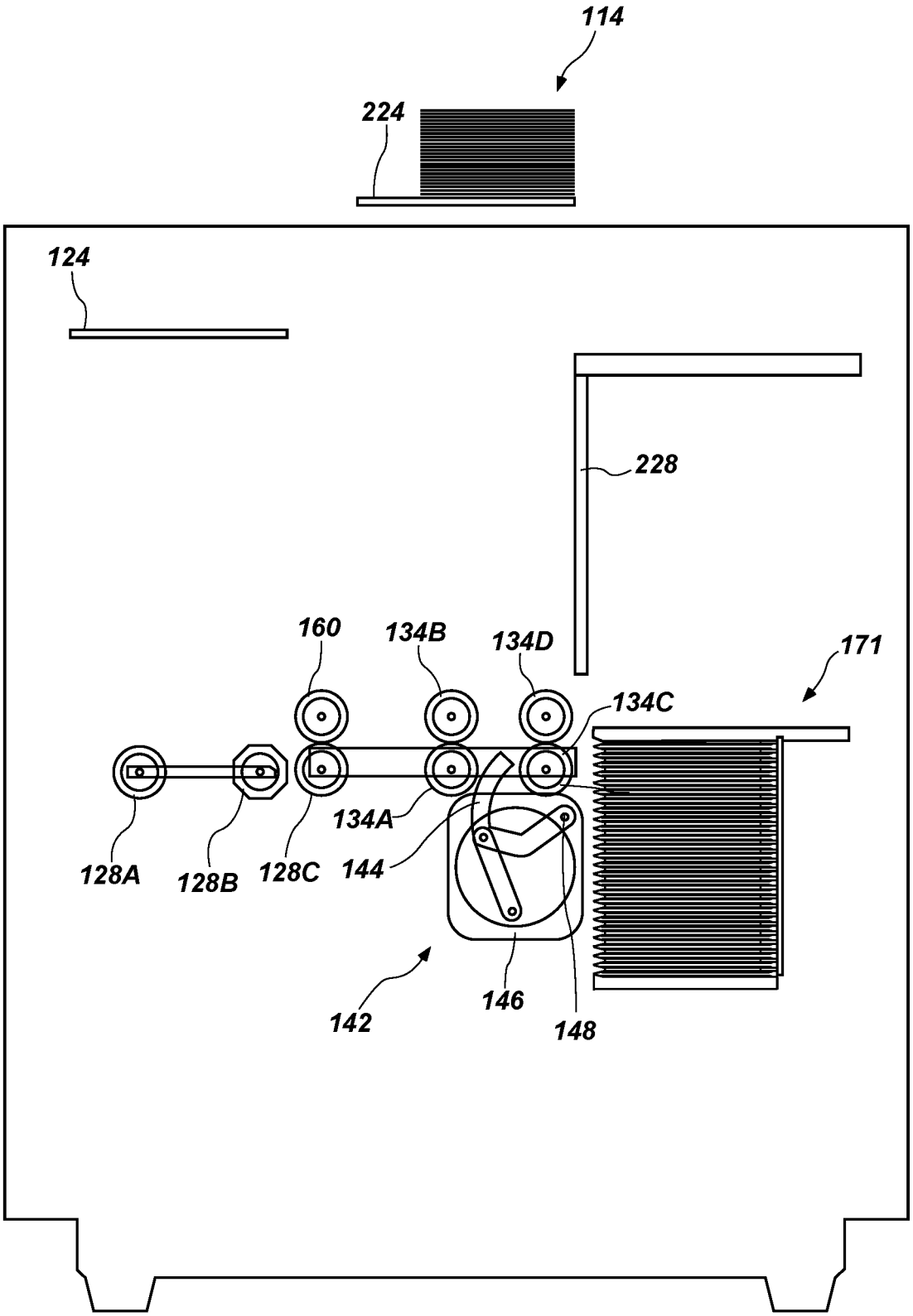

FIG. 14G illustrates the cards 114 completely ejected out from the rack 171 and dropped onto the card support 224 by the ejector 228. As shown in FIG. 14G, the cards 114 have dropped onto the card support 224 in the form of a stack of randomly shuffled cards 114. After the cards 114 are ejected onto the card support 224, the control system 280 may cause the output elevator 222 and the input elevator 122 to move vertically upward to the uppermost positions, as shown in FIG. 14H, and to raise the lid 112, as shown in FIG. 2. The control system 280 may detect when a user removes the stack of shuffled cards 114 from the card support 224 of the output elevator 222 using the card sensor 328. Once the stack of shuffled cards 114 is removed from the card support 224, the control system 280 may wait a predetermined amount of time (e.g., five seconds) for a user to place another stack of cards 114 onto the card support 124 of the card input elevator 122. In other embodiments, another stack of cards may be inserted while the shuffler is shuffling so that as soon as a shuffled group of cards is elevated, the next set of cards can be processed. If cards are removed from the card support 224 and cards are placed on the card support 124 within the predetermined amount of time, the control system 280 may cause the card input elevator 122 and the card output elevator 222 to move vertically downward to the lowermost positions and close the lid 112, and to then wait for a user to again press the start button 299 (FIGS. 1 and 2) to use the card shuffler 100 in shuffling cards, as indicated at action 430 in FIG. 15. After the start button 299 is pushed by a user, the control system 280 may again cause the output elevator 222 and the input elevator 122 to move vertically upward to the uppermost positions and to raise the lid 112, as indicated at action 434 in FIG. 15.

Upon first raising the input elevator 122 and the output elevator 222 to the uppermost positions immediately after cards are unloaded from the rack 171 onto the card support 224, if cards are removed from the card support 224 and additional cards are placed on the card support 124 within the predetermined amount of time, the card shuffler 100 may automatically commence another shuffling operation and return to action 402 in FIG. 15 to shuffle the additional stack of cards 114 placed on the card support 124 without requiring the user to press the start button 299 (FIGS. 1 and 2) for each shuffling operation. Thus, the card shuffler 100 may be used repeatedly to shuffle stacks of cards 114 automatically and continuously simply by placing stacks of cards 114 to be shuffled on the card support 124 of the input elevator 122 and removing stacks of shuffled cards 114 from the card support 224 of the output elevator 222 between shuffling operations.

As previously mentioned, the card shuffler 100 also may be used to sort cards in a stack of cards placed on the card support 124 of the card input elevator 122 into a predefined order, such as a sequential "new deck" order for a standard deck of playing cards. The card shuffler 100 may be placed in a sort mode of operation (and/or a shuffle mode of operation) using the data input device 294 of the control system 280. When the card shuffler 100 is in the sort mode, the start button 299 (FIGS. 1 and 2) may be pressed to cause the input elevator 122 and the output elevator 222 to rise to the uppermost positions and open the lid 112. The stack of cards to be sorted may be placed on the card support 124 of the card input elevator 122. After the card sensor 310 detects the presence of the stack of cards on the card support 124 for a predetermined amount of time (e.g., five seconds), the control system 280 may automatically commence a sorting operation by lowering the input elevator 122 and the output elevator 222 to the lowermost positions and closing the lid 112. In some embodiments, the sorting operation may be initiated responsive to a user input on the card shuffler itself and/or a remote device.

Once the input elevator 122 and the output elevator 222 have moved to the lowermost positions with the stack of cards resting on the card support 124 of the input elevator 122, the card input mechanism 120 and the card imaging system 250 may be used to sequentially identify the rank and suit of the cards in the stack (using the card imaging system 250), and to respectively move the cards into predetermined positions within the rack 171 of the card storage device 170, such that the cards are ordered within the rack 171 in a predetermined, selected order in a direction extending from the top of the rack 171 to the bottom of the rack 171, or from the bottom of the rack 171 to the top of the rack 171.

To sort cards, the control system 280 of the card shuffler 100 may reference a Sort Table, which may be stored in a memory device 290 of the control system 280. The Sort Table correlates the identity of specific cards in a predefined set of cards (e.g., a deck of standard playing cards) to one of the fifty four (54) card storage positions in the rack 171 in the predefined order (e.g., new deck order), in one embodiment.

The control system 280 may selectively control movement of the various components of the card input mechanism 120 and the card storage device 170 to cause the cards in the stack of cards to be inserted into the rack 171 and positioned in their assigned card storage positions corresponding to the selected, predefined order. As previously described, the rack 171 is moved up and down in the vertical direction to a proper position relative to the speed-up rollers 134A-134D (which are disposed at a fixed, static location within the card shuffler 100) for insertion of each card into the appropriate card storage compartment 172 and into its assigned card storage position.

The Sort Table and the First and Second Rack Position Tables may be referenced and used by the control system 280 in controlling operation of the card input mechanism 120, the card imaging system 250, and the card storage device 170 to sequentially position each card into the appropriate card storage compartment 172 (and appropriate upper or lower card storage position therein) so as to position the cards in the rack 171 in the predefined, selected order. As a particular card is inserted into the rack 171, the control system 280 references the Sort Table to determine in which of the fifty four (54) card storage positions the specific identified card is to be positioned. As previously discussed, the control system 280 determines whether there is already a card located in the respective card storage compartment 172 in which the card storage position is located. If there is not a card already present in the card storage compartment 172, the control system 280 references Table 2 to determine where to position the rack 171 such that, when the card is inserted into the rack 171 by the speed-up rollers 134A-134D, the card will be inserted into the center of the card storage compartment 172. If there is a card already present in the card storage compartment 172, the control system 280 references Table 3 to determine where to position the rack 171 such that, when the card is inserted into the rack 171 by the speed-up rollers 134A-134D, the card will be inserted either above or below the card already present in the card storage compartment 172 at an offset location of the selected card storage compartment 172.

After selectively inserting the second card into any given card storage compartment 172 above or below the first card inserted into the card storage compartment 172, the two cards in the card storage compartment 172 will be appropriately positioned in the upper card storage position and the lower card storage position, respectively, in that card storage compartment 172. Any cards that fail to be inserted (e.g., due to a card jam) as determined by the control system 280 may instead be inserted into an overflow compartment as discussed in more detail below. Although most card jams occur when a second card is being inserted into a compartment already containing a card, jams can occasionally occur when a first card is being inserted into a compartment. In one example of the invention, a first card insert jam may cause the machine to declare a failed shuffle and terminate the shuffle. In another embodiment, the first card insert jam causes the processor to reinsert the card in an unused compartment. For example, when the shuffler is shuffling 52 cards using 27 compartments, one of the compartments is dedicated as an "overflow" compartment that is capable of receiving a card that could not be fed into another compartment.

For example, in the case of a card jam wherein a card being inserted into the card storage device 170 is not actually inserted into the card storage device 170 as intended, the direction of rotation of the speed-up rollers 134A-134D may be reversed to withdraw the card from the card storage device 170, after which the position of the card storage device 170 may be adjusted and the speed-up rollers 134A-134D activated to again attempt to reinsert the card into another compartment of the card storage device 170. If the card cannot be inserted into the primary location of the card storage device 170 upon a predetermined number of attempts, the control system may instead attempt to insert the card into the designated overflow compartment. If the card cannot be inserted into the card storage device 170 upon a predetermined number of attempts to insert the card to an overflow compartment, operation of the card shuffler 100 may be interrupted and an error message provided to a user via the data output device 296 of the control system 280.

Embodiments of the disclosure may also be configured to reduce the occurrences of jamming that may occur during a shuffle operation, sort operation, and/or other operations of the card shuffler 100. In some situations, the cards may be squeezed between the card already within a compartment 172 and the edge of the compartment 172 (e.g., either upper or lower depending on the position of the card being inserted). In some embodiments, the control system 280 may cause the rack 171 to align the compartment 172 to the appropriate upper or lower card storage position as there is already a card present within the compartment 172. The control system 280 may cause rotation of the speed-up rollers 134A-134D partially into the compartment 172 either above or below the card within the compartment 172. Prior to fully inserting the card into the compartment 172, the storage compartment 172 may move the rack 171 to another location in the direction of the center of the respective compartment 172. In some situations, the rack 171 may be moved from either the upper or lower card storage position to the center position of the compartment 172 while the card is in the process of being inserted into the compartment. Doing so may reduce the number of jammed card experienced by the card shuffler.

After placing the cards in the rack 171 such that the cards are in the predetermined, selected order within the rack 171, the cards may be ejected out from the rack 171, as previously discussed, to place the stack of sorted cards onto the card support 224 of the card output elevator 222. The control system 280 then may cause the output elevator 222 and the input elevator 122 to move vertically upward to the uppermost positions and to raise the lid 112, thereby allowing a user to remove the stack of sorted cards from the card support 224 of the card output elevator 222.

Embodiments of the disclosure may also include improvements to the shuffling process to better randomize the deck in the event of a jam or other failure of inserting a card into its primary compartment assignment. As discussed above, at least one extra card storage compartment (also referred to as an "overflow compartment") may be provided in the rack 171 that may be selected for receiving cards that initially failed to be inserted into the original card storage compartment 172 (e.g., due to card jams, warped cards, damaged cards, etc.). In other words, the card shuffler 100 may deliver a card into the overflow compartment when a prior delivery attempt to a different compartment failed. In some embodiments, the overflow compartment reserved for failed attempts may be a fixed position within the rack 171, such as the top card storage compartment, the bottom card storage compartment, and/or an intermediate card storage compartment. A fixed position means that the same card storage compartment(s) is reserved as the overflow compartment from one shuffle to the next shuffle. One advantage of having a fixed position is that the extra card storage compartment may be constructed to be larger in size compared with the other card storage compartments to accommodate a bent card or other problem that caused the failure.

For example, Table 4 shows a compartment table indicating the status of each card storage compartment in the rack 171. Card storage compartment 0 may correspond to the top card storage compartment of the rack 171 and card storage compartment 27 may be the bottom card storage compartment as discussed above. Card storage compartments 0 to 26 are listed as "primary" (i.e., used by the card shuffler 100 as one of the original locations during a shuffle). Card storage compartment 27 is listed as "overflow" (i.e., used by the card shuffler 100 as an overflow location during the shuffle if inserting a card into one of the original card storage locations fails). The card positions may also be randomly assigned to each card of the deck for inserting the cards randomly into the compartments during a shuffle as discussed above. In this case, the positions may range from 0 to 53 for two positions per compartment corresponding to compartments 0 to 26 being primary compartments, and reserving compartment 27 as the overflow compartment. Table 5 shows an example of 54 card (assigned card numbers 0 to 53) being randomly assigned to the different card positions.

TABLE 4

| Compartment Table | |
|---|---|
| Compartment | Status |
| 0 | Primary |
| 1 | Primary |
| 2 | Primary |
| 3 | Primary |
| 4 | Primary |
| . | . |
| . | . |
| . | . |
| 24 | Primary |
| 25 | Primary |
| 26 | Primary |
| 27 | Overflow |

TABLE 5

| Card Position Table | |
|---|---|
| Card | Position |
| 0 | 44 |
| 1 | 21 |
| 2 | 37 |
| 3 | 2 |
| 4 | 19 |
| 5 | 45 |
| 6 | 52 |
| 7 | 36 |
| 8 | 28 |
| 9 | 6 |
| . | . |
| . | . |
| . | . |
| 48 | 53 |
| 49 | 20 |
| 50 | 39 |
| 51 | 35 |
| 52 | 27 |
| 53 | 48 |

Figure 16:
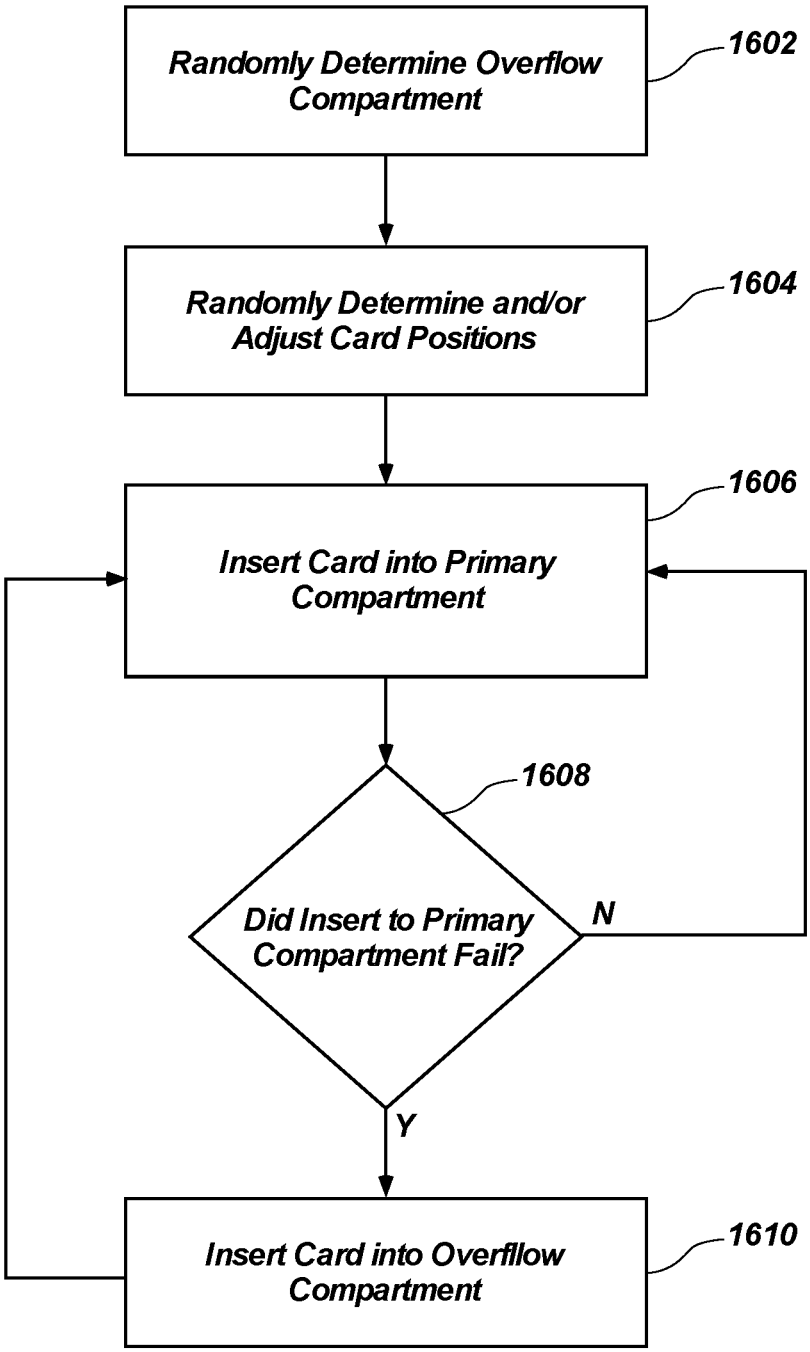
FIG. 16 is a flowchart illustrating operation of the card shuffler during a shuffling operation according to another embodiment of the disclosure in which the overflow compartment may not be a fixed compartment in the rack.

FIG. 16 is a flowchart illustrating operation of the card shuffler during a shuffling operation according to another embodiment of the disclosure in which the overflow compartment may not be a fixed compartment in the rack 171. In particular, the flowchart of FIG. 16 may, in some respects, be a simplified version of the flowchart of FIG. 15 as will be described below.

At action 1602, the overflow compartment may be selected during the shuffle. The selection may be determined randomly (e.g., via the random number generator) by the control system 280 at the beginning of the shuffle. As a result, the same card storage compartment may not be used as the overflow compartment from one shuffle to the next. This may have the advantage of improving the randomness of the card shuffle, particularly when there is a particular card in a deck that consistently results in a failure during the shuffle. For example, one card in a deck may be bent or warped—causing the card to regularly fail to insert into its assigned upper or lower position during each shuffle. With a fixed overflow compartment, the same card may be assigned to the same position within the otherwise shuffled deck (e.g., at the bottom of the deck). By randomly assigning the overflow compartment, the card may be inserted at different positions within the deck even if the card consistently fails at its original position.

To accommodate a randomly assigned overflow compartment, the assigned card positions may be determined and/or adjusted responsive to the overflow compartment assignment at action 1604. For example, Table 6 shows a compartment table indicating the status of each card storage compartment in the rack 171. In this example, there are 28 compartments (numbered from 0 to 27) that can accommodate 54 cards with one overflow compartment. As shown in Table 6, compartment 4 is assigned to be the overflow compartment according to a random assignment by the control system. As a result, card storage compartments 0 to 3 and 5 to 27 are listed as being available as regular card storage compartments to be used during the card shuffling process. The card positions may also be randomly assigned to each card of the deck by the control system 280 for inserting the cards randomly into the primary positions within the card storage compartments during a shuffle as discussed above. In this case, the positions may range from 0 to 53 for two positions per compartment corresponding to compartments 0 to 3 and 4 to 27 being available, and reserving compartment 4 as the overflow compartment.

In some embodiments, the position assignment process may be configured to adjust the assigned card positions by adjusting (e.g., incrementing) any pre-assigned positions that may be impacted by the randomly assigned overflow compartment. For example, Table 7 shows an example of 54 cards (assigned card numbers 0 to 53) being randomly assigned to the different card positions and then having at least some of those pre-assigned positions adjusted. Because compartment 4 has been randomly assigned to be the overflow compartment, positions 8 and 9 may not be available for primary use during the shuffling process. Thus, any pre-assigned positions for positions 8 and above may be incremented by two. Table 7 shows this process in which positions 0 to 7 remain unchanged, and pre-assigned positions 8 and above are incremented—leaving claims 8 and 9 unassigned so that compartment 4 may be used as the overflow compartment during the current shuffle. For the next shuffle, a different compartment may be randomly assigned as the overflow compartment and any pre-assigned compartment positions may be adjusted accordingly.

TABLE 6

Compartment Table

| Compartment | Status |
|---|---|
| 0 | Primary |
| 1 | Primary |
| 2 | Primary |
| 3 | Primary |
| 4 | Overflow |
| . | . |
| . | . |
| . | . |
| 23 | Primary |
| 24 | Primary |
| 25 | Primary |
| 26 | Primary |
| 27 | Primary |

TABLE 7

Card Position Table

| Card | Old Position | New Position |
|---|---|---|
| 0 | 44 | 46 |
| 1 | 21 | 23 |
| 2 | 37 | 39 |
| 3 | 2 | 2 |
| 4 | 19 | 21 |
| 5 | 45 | 47 |
| 6 | 52 | 54 |
| 7 | 36 | 38 |
| 8 | 28 | 30 |
| 9 | 6 | 6 |
| . | . | . |
| . | . | . |
| . | . | . |
| 46 | 14 | 16 |
| 47 | 9 | 11 |
| 48 | 53 | 55 |
| 49 | 20 | 22 |
| 50 | 39 | 41 |
| 51 | 35 | 37 |
| 52 | 27 | 29 |
| 53 | 48 | 50 |

In another embodiment, the position assignment process may be configured to adjust the assigned card positions responsive to the random overflow compartment in its original card position assignment. In this case, the control system 280 may first randomly assign the overflow compartment and then account for that compartment assignment when assigning the card positions. For example, if compartment 4 is assigned to be the overflow compartment, the control system 280 may take that assignment into account when assigning the card positions in the first instance. The random card position available for initial assignment by the control system 280 may range from 0 to 7 and 10 to 55—effectively ignoring positions 8 and 9 during the initial position assignment process. For the next shuffle, a different compartment may be randomly assigned as the overflow compartment and the card positions available for assignment may be adjusted accordingly.

In another embodiment, the position assignment process may include adjusting the range from 0 to 53, but then only reassign positions 8 and 9 rather than adjusting other card position assignments. In this case, when the control system 280 may first receive a random number to assign a card to position 8, the control system 280 instead assigns the card to position 54 in compartment 27. Similarly, when the control system 280 receives a random number to assign a card to position 9, the control system 280 instead assigns the card to position 55 in compartment 27. Thus, positions 8 and 9 may be effectively ignored during original card position assignment, thus reserving compartment 4 to be used as the overflow compartment during the shuffle process.

The examples given above describe embodiments in which one overflow compartment is utilized. Of course, similar methods may also be used for embodiments in which two or more overflow compartments are randomly assigned. For example, an embodiment with 28 compartments may accommodate 52 cards with two overflow compartments. In such an embodiment having two overflow compartments in which pre-assigned positions are incremented, some position assignments may be incremented by two positions whereas other position assignments may be incremented by four positions depending on where the positions are relative to the each randomly assigned overflow compartment. The number of compartments may limit the number of cards and/or overflow compartments that can be utilized.

With the overflow compartment(s) and the card positions randomly determined, the cards may be inserted into the assigned compartment positions at action 1606. Inserting the card into its primary position may be similar to the actions 406 to 422 (FIG. 15) described above. In some situations, a card may fail to be inserted into its primary position randomly assigned by the control system 280. At action 1608, the control system 280 may confirm whether the insertion into the primary compartment failed. If not, the next card may be inserted into its primary compartment. If so, the card may be inserted into the randomly assigned overflow compartment at action 1610. If more than one randomly assigned overflow compartment exists, the control system 280 may ensure than each overflow compartment is used to receive a card before beginning to insert multiple cards within the same overflow compartment. Again, this may improve the randomness of the shuffle for instances in which more than one card consistently fails in multiple shuffles.

The example embodiments of the disclosure described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosure, in addition to those shown and described herein, such as alternate useful combinations of the elements described, will become apparent to those skilled in the art from the description. Such modifications and embodiments are also intended to fall within the scope of the appended claims, including legal equivalents.

What is claimed is:

1. An automatic card shuffler, comprising:
- a card input mechanism;
- a rack with card storage compartments for holding more than one card;
- an elevator configured to move the rack relative to the card input mechanism;
- a control system configured to:
  - select at least one card storage compartment as an overflow compartment;
  - randomly select a primary card position within the card storage compartments for each card moving through the card input mechanism, wherein the control system is configured to randomly select the primary card position for each card prior to selecting the at least one card storage compartment as the overflow compartment;
  - align the rack relative to the card input mechanism such that each card moving through the card input mechanism is inserted into its randomly selected primary card position; and
  - align the rack relative to the card input mechanism such that at least one card is inserted into the overflow compartment responsive to the at least one card failing to be inserted into its randomly selected primary card position.

2. The automatic card shuffler of claim 1, wherein the control system is configured to adjust one or more of the primary card positions responsive to the least one card storage compartment being selected as the overflow compartment.

3. The automatic card shuffler of claim 2, wherein the control system is configured to adjust one or more of the primary card positions by incrementing pre-assigned primary card positions corresponding to compartments having index values greater than the overflow compartment.

4. The automatic card shuffler of claim 2, wherein the control system is configured to adjust one or more of the primary card positions by reassigning a pre-assigned primary card position corresponding to the at least one card storage compartment selected to be the overflow compartment.

5. The automatic card shuffler of claim 1, wherein the control system is configured to ignore positions corresponding to the overflow compartment from being selected as the primary card position.

6. The automatic card shuffler of claim 1, wherein the control system is configured to select two card storage compartments as overflow compartments.

7. The automatic card shuffler of claim 1, wherein the control system is configured to:
- align the rack to an offset location relative to a center location of a card storage compartment receiving the card from the card input mechanism; and
- align the rack from the offset location toward the center location as the card is inserted into the compartment.

8. The automatic card shuffler of claim 7, wherein the control system is configured to partially insert the card at the offset location and complete insertion of the card at the center location.

9. The automatic card shuffler of claim 8, wherein the offset location is selected from the group consisting of an upper location and a lower location relative to the center location.

10. The automatic card shuffler of claim 1, wherein each of the compartments is sized and configured to hold two cards in the compartment.

11. The automatic card shuffler of claim 10, wherein each of the compartments is sized and configured to prevent insertion of more than two cards in the compartment.

12. An automatic card shuffler, comprising:
- a card input mechanism;
- a rack with card storage compartments for holding more than one card;
- an elevator configured to move the rack relative to the card input mechanism;
- a control system configured to:
  - randomly select at least one card storage compartment as an overflow compartment;
  - randomly select a primary card position within the card storage compartments for each card moving through the card input mechanism;
  - align the rack relative to the card input mechanism such that each card moving through the card input mechanism is inserted into its randomly selected primary card position; and
  - align the rack relative to the card input mechanism such that at least one card is inserted into the overflow compartment responsive to the at least one card failing to be inserted into its randomly selected primary card position.

13. An automatic card shuffler, comprising:
- a card infeed area;
- a rack having compartments configured to hold at least two cards delivered to the rack from the card infeed area;
- a card mover configured to move cards from the card infeed area into the compartments of the rack when aligned with the card infeed area; and a control system configured to:

control the rack to move to a first position of a first compartment when a first card is located within the first compartment;

control the card mover to at least partially insert a second card from the card infeed area into the first compartment with the rack aligned with the first position;

control the rack to move to a second position of the first compartment; and control the card mover to complete insertion of the second card into the first compartment with the rack aligned with the second position of the first compartment.

14. The automatic card shuffler of claim 13, wherein the first position of the first compartment is an offset position relative to a center position of the first compartment, and the second position is the center position of the first compartment.

15. The automatic card shuffler of claim 13, wherein the control system is further configured to:

control the rack to move to a first position of a second compartment when a third card is located within the second compartment;

control the card mover to attempt to insert a fourth card from the card infeed area into the second compartment with the rack aligned with the first position of the second compartment;

control the card mover to reverse insertion of the fourth card responsive to detecting a failure of the attempt; and control the rack to move to align with an overflow compartment selected by the control system.

16. A method of handling cards, the method comprising:

randomly determining at least one compartment of a rack of a card shuffler to be an overflow compartment;

randomly determining and correlating primary card positions with cards to be shuffled by the card shuffler, wherein randomly determining and correlating the primary card positions includes adjusting the primary card positions from an initial determination responsive to the random determination of the at least one compartment to be the overflow compartment;

transferring a first card with a card mover from a card infeed area into a first compartment according to its randomly defined primary card position; and transferring a second card with the card mover from the card infeed area into the overflow compartment responsive to the card mover failing to insert the second card in its randomly defined primary card position.

17. The method of claim 16, further comprising:

moving the rack to a midpoint of the first compartment responsive to no cards currently being present within the first compartment when the first card is transferred; and moving the rack to an offset location of the first compartment responsive to another card currently being present within the first compartment when the first card is transferred.

18. The method of claim 17, moving the rack from the offset location to the midpoint of the first compartment while the first card is being transferred into the first compartment.

* * * * *